US009804551B2

(12) United States Patent
Ikeda et al.

(10) Patent No.: US 9,804,551 B2
(45) Date of Patent: Oct. 31, 2017

(54) END MEMBER WHICH ALLOWS TRANSMISSION OF ROTARY POWER

(71) Applicant: Mitsubishi Chemical Corporation, Chiyoda-ku (JP)

(72) Inventors: Shuichi Ikeda, Odawara (JP); Yohei Matsuoka, Odawara (JP); Shinichi Iijima, Glendale, CA (US); Teruyuki Mitsumori, Chiyoda-ku (JP); Daishi Kato, Yokohama (JP); Hiroshi Takata, Yokohama (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 0 days.

(21) Appl. No.: 15/273,236

(22) Filed: Sep. 22, 2016

(65) Prior Publication Data

US 2017/0075287 A1 Mar. 16, 2017

Related U.S. Application Data

(63) Continuation of application No. 14/925,217, filed on Oct. 28, 2015, now Pat. No. 9,494,917.

(30) Foreign Application Priority Data

Oct. 31, 2014 (JP) ..... 2014-223409
Dec. 4, 2014 (JP) ..... 2014-245883
Feb. 12, 2015 (JP) ..... 2015-025342

(51) Int. Cl.
*G03G 15/00* (2006.01)
*G03G 21/18* (2006.01)
*G03G 21/16* (2006.01)

(52) U.S. Cl.
CPC ..... *G03G 15/757* (2013.01); *G03G 21/1647* (2013.01); *G03G 21/1839* (2013.01);
(Continued)

(58) Field of Classification Search
CPC ..... G03G 21/1647; G03G 21/1839; G03G 21/1857; G03G 21/186
(Continued)

(56) References Cited

U.S. PATENT DOCUMENTS 5,768,659 A 6/1998 Kameda
5,903,803 A 5/1999 Kawai et al.
(Continued)

FOREIGN PATENT DOCUMENTS

CN 201945803 U 8/2011
CN 202041766 U 11/2011
(Continued)

OTHER PUBLICATIONS

Japanese Institute of Invention and Innovation, Journal of Technical Disclosure No. 2010-502197, 2010, 18 pages.
(Continued)

*Primary Examiner* — William J Royer
(74) *Attorney, Agent, or Firm* — Oblon, McClelland, Maier & Neustadt, L.L.P.

(57) ABSTRACT

Provided is an end member which allows appropriate transmission of rotary power, and smooth attachment and detachment with respect to an apparatus body. The end member includes a tubular bearing member and a shaft member that is held by the bearing member. The shaft member includes a turning shaft which moves in an axial line direction in accordance with turning about an axial line, a rotary power reception member which is arranged at one end of the turning shaft and includes an engagement member engaging with a drive shaft of an image forming apparatus body, and a regulation member which is pressed to engage with or be detached from the turning shaft or the rotary power reception member, whereby the engagement member switches
(Continued)

between an engagement posture and a non-engagement posture with respect to the drive shaft

14 Claims, 78 Drawing Sheets

(52) U.S. Cl.
CPC ..... *G03G 21/1846* (2013.01); *G03G 21/1864* (2013.01); *G03G 2221/1657* (2013.01)

(58) Field of Classification Search
USPC ..... 399/111, 167
See application file for complete search history.

(56) References Cited

U.S. PATENT DOCUMENTS

| | | | | |
|---|---|---|---|---|
| 6,128,454 | A | 10/2000 | Kawai et al. | |
| 6,349,188 | B1 | 2/2002 | Kawai et al. | |
| 8,165,495 | B2 | 4/2012 | Tonges et al. | |
| 8,571,445 | B2 | 10/2013 | Komatsu et al. | |
| 8,615,184 | B2 | 12/2013 | Zhou et al. | |
| 8,688,002 | B2 | 4/2014 | Taba | |
| 9,268,303 | B2 * | 2/2016 | Ikeda | G03G 21/186 |
| 2004/0086300 | A1 | 5/2004 | Kawai et al. | |
| 2005/0163526 | A1 | 7/2005 | Kawai et al. | |
| 2006/0008287 | A1 | 1/2006 | Noda et al. | |
| 2006/0198654 | A1 | 9/2006 | Noda et al. | |
| 2007/0104510 | A1 | 5/2007 | Kawai et al. | |
| 2007/0104511 | A1 | 5/2007 | Kawai et al. | |
| 2008/0056754 | A1 | 3/2008 | Noda et al. | |
| 2008/0063429 | A1 | 3/2008 | Watanabe et al. | |
| 2008/0260428 | A1 | 10/2008 | Ueno et al. | |
| 2009/0074452 | A1 | 3/2009 | Noda et al. | |
| 2009/0074453 | A1 | 3/2009 | Noda et al. | |
| 2009/0290908 | A1 | 11/2009 | Noda et al. | |
| 2010/0278559 | A1 | 11/2010 | Komatsu et al. | |
| 2011/0211863 | A1 | 9/2011 | Watanabe et al. | |
| 2013/0071141 | A1 | 3/2013 | Ueno et al. | |
| 2013/0164031 | A1 | 6/2013 | Ueno et al. | |
| 2014/0064783 | A1 | 3/2014 | Ueno et al. | |
| 2014/0086634 | A1 | 3/2014 | Ueno et al. | |
| 2014/0112685 | A1 | 4/2014 | Komatsu et al. | |
| 2014/0205322 | A1 | 7/2014 | Watanabe et al. | |
| 2016/0018777 | A1 * | 1/2016 | Iijima | G03G 21/1647 399/111 |

FOREIGN PATENT DOCUMENTS

| | | | |
|---|---|---|---|
| JP | 8-339147 | A | 12/1996 |
| JP | 2875203 | | 3/1999 |
| JP | 2003-195722 | A | 7/2003 |
| JP | 2008-233868 | | 10/2008 |
| WO | WO 2012/113289 | A1 | 8/2012 |
| WO | WO 2012/152203 | A1 | 11/2012 |
| WO | WO 2014/157113 | A1 | 10/2014 |

OTHER PUBLICATIONS

Extended European Search Report issued Mar. 11, 2016 in Patent Application No. 15190996.7.

* cited by examiner (a)

END MEMBER WHICH ALLOWS TRANSMISSION OF ROTARY POWER

CROSS REFERENCE TO RELATED APPLICATION(S)

This application is a continuation for U.S. patent application Ser. No. 14/925,217, filed Oct. 28, 2015 and is based upon and claims the benefits of priorities of Japanese Patent Applications No. 2014-223409 filed on Oct. 31, 2014, No. 2014-245883 filed on Dec. 4, 2014 and No. 2015-25342 file on Feb. 12, 2015, the contents of which are incorporated herein by reference in its entirety.

BACKGROUND OF THE INVENTION

1. Field of the Invention

The present invention relates to a process cartridge which is mounted in an image forming apparatus such as a laser printer or a copying machine, an end member which is arranged in the process cartridge, and a method of separating a process cartridge from an image forming apparatus body.

2. Description of the Related Art

An image forming apparatus represented by a laser printer, a copying machine, and the like includes a process cartridge which is attachable and detachable with respect to a body of the image forming apparatus (hereinafter, also referred to as "an apparatus body").

The process cartridge is a member which forms contents to be shown such as letters and figures, and transfers the contents to a recording medium such as paper. The process cartridge includes a photosensitive drum in which the transferred contents are formed, and various types of means for operating on the photosensitive drum so as to form the contents to be transferred are collectively arranged in the process cartridge. As examples thereof, means for performing photographic developing, electrification, and cleaning can be exemplified.

The same process cartridge is attached to and detached from the apparatus body for maintenance or the old process cartridge is detached from the apparatus body so as to be replaced with a new process cartridge to be mounted in the apparatus body. A user of the image forming apparatus individually performs such attachment and detachment of the process cartridge. Therefore, from a viewpoint thereof, it is desirable that attachment and detachment of the process cartridge is easily performed.

Meanwhile, the photosensitive drum included in the process cartridge needs to rotate while being centered around an axial line during an operation. Therefore, during at least an operation, the photosensitive drum is configured to engage with a drive shaft of the apparatus body in a direct manner or through another member so as to rotate by receiving rotary power from the drive shaft. Accordingly, in order to perform attachment and detachment of the process cartridge with respect to the apparatus body, the drive shaft of the apparatus body and the photosensitive drum need to be disengaged (detached) from each other and remounted each time.

Here, if the photosensitive drum (the process cartridge) can move in an axial line direction of the drive shaft of the apparatus body so as to perform attachment and detachment, the aforementioned structure for attachment and detachment becomes relatively simple. However, from a viewpoint of miniaturizing the image forming apparatus, ensuring a space for attachment and detachment of the process cartridge, and the like, it is preferable that the process cartridge is drawn out in a direction different from the axial line direction of the drive shaft so as to be detached from the apparatus body and the process cartridge is thrust in the same direction so as to be mounted in the apparatus body.

Japanese Patent No. 2875203 as Patent Document 1 discloses that when a cover of the apparatus body is in a closed state, a drive force from the apparatus body side can be transmitted to the photosensitive drum, and when the cover is in an open state, a movement for detachment is performed so as to prevent the drive force from being transmitted to the photosensitive drum. Accordingly, the process cartridge can be attached to and detached from the apparatus body in the direction different from the axial line direction of the drive shaft.

In addition, there is a technology in which the photosensitive drum is provided with a gear, and the gear is caused to mesh with another gear which is driven by the apparatus body, thereby rotating the photosensitive drum.

JP-A-2008-233868 as Patent Document 2 discloses an invention in which the drive shaft of the apparatus body engages with a photosensitive drum unit through a rotary power transmission component having a trunnion structure attached to the photosensitive drum thereby rotating the photosensitive drum. Since the rotary power transmission component can vary the angle of the photosensitive drum with respect to the axial line on account of the trunnion structure, the drive shaft of the apparatus body and the photosensitive drum unit can easily engage with and be detached from each other.

WO 2012/113289 A1 as Patent Document 3 discloses a technology in which a claw member arranged in a bearing member engaging with the drive shaft is provided to be movable in a radial direction on account of an elastic member such as a spring. Accordingly, since the bearing member and the drive shaft reliably engage with each other, rotary power is appropriately transmitted, and since the claw member is movable during attachment and detachment, it is possible to achieve smoothly performed attachment and detachment.

Moreover, WO 2012/152203 A1 as Patent Document 4 discloses a technology in which the claw member attached to the shaft member engaging with the drive shaft is raised by pressing a projection at the center of the shaft member. Accordingly, since the bearing member and the drive shaft reliably engage with each other, rotary power is appropriately transmitted, and since the claw member is movable during attachment and detachment, it is possible to achieve smoothly performed attachment and detachment.

Japan Institute of Invention and Innovation, Journal of Technical Disclosure, No. 2010-502197 as Non-Patent Document 1 discloses a technology in which the bearing member engaging with the drive shaft is provided so as to be movable in the axial line direction on account of the elastic member such as the spring. Accordingly, during attachment and detachment between the bearing member and the drive shaft, the bearing member is urged by the elastic member so as to move and retract in the axial line direction, and thus, it is possible to achieve smoothly performed attachment and detachment.

Patent Document 1: Japanese Patent No. 2875203
Patent Document 2: JP-A-2008-233868
Patent Document 3: WO 2012/113289 A1
Patent Document 4: WO 2012/152203 A1
Non-Patent Document 1: Japan Institute of Invention and Innovation, Journal of Technical Disclosure, No. 2010-502197

SUMMARY OF THE INVENTION

However, the present invention disclosed in Japanese Patent No. 2875203 includes a process in which a rotor moves in an axial line direction of the rotor in association with opening and closing of a lid during attachment and detachment of a process cartridge, thereby requiring a mechanism therefor. Moreover, in a technology in which a photosensitive drum is provided with a gear, even though the process cartridge can directly move in a direction different from the axial line direction of the photosensitive drum, there may be an occurrence of irregularity in rotations of the photosensitive drum due to the characteristics of the gear.

According to the present invention disclosed in JP-A-2008-233868, even though the process cartridge can directly move in the direction different from the axial line direction of the photosensitive drum (in a direction substantially orthogonal thereto), a rotary power transmission component needs to be configured so as to be inclinable, thereby resulting in a complicated structure. Accordingly, it is sometimes difficult to cause the axial line of a drive transmission shaft to coincide with the axial line of the driven transmission shaft.

According to the present invention disclosed in WO 2012/113289 A1 and WO 2012/152203 A1, even though attachment and detachment of a drive shaft are smoothly performed in a direction in which a claw member is movable, the claw member is not movable when performing attachment and detachment in a direction perpendicular thereto. Therefore, it is sometimes difficult to perform attachment and detachment. In addition, a disadvantage is likely to occur in assemblability, and reusability of configuration members is not taken into consideration.

According to the present invention disclosed in Japan Institute of Invention and Innovation, Journal of Technical Disclosure, No. 2010-502197, since a shaft member is movable in only the axial line direction, a groove for a rotary power transmission portion insufficiently engages with the rotary power transmission portion on the drive shaft side. Moreover, due to a tapered portion provided therein, rotary power may not be appropriately transmitted. In addition, the shaft member may be caught during attachment and detachment of the process cartridge depending on the posture in a rotary direction, resulting in difficulties in attachment and detachment.

In consideration of the above-described problems, the present invention aims to provide an end member which allows appropriate transmission of rotary power, and smooth attachment and detachment with respect to an apparatus body. In addition, there are provided a photosensitive drum unit including the end member, a process cartridge, and a shaft member which includes the end member.

Hereinafter, some aspects of the present invention will be described.

A first aspect of the present invention provides a process cartridge to be mounted in an image forming apparatus body, the process cartridge including: a casing; and a photosensitive drum unit that is arranged inside the casing, wherein the photosensitive drum unit includes a photosensitive drum and an end member which is arranged in at least one end of the photosensitive drum, wherein the end member includes a tubular bearing member and a shaft member which is held by the bearing member, wherein the shaft member includes a turning shaft which is movable in an axial line direction, wherein the casing is provided with a recessed operation portion which is used when a user draws out the process cartridge from the image forming apparatus body, and wherein the recessed operation portion has a blocked portion in a recessed part corresponding to the end member side engaging with a drive shaft of the image forming apparatus body, from a center in a width direction that is a direction extending an axial line of the photosensitive drum unit.

A second aspect of the present invention provides a process cartridge according to the first aspect, wherein the turning shaft is configured to move in the axial line direction in accordance with turning about an axial line.

A third aspect of the present invention provides a process cartridge to be mounted in an image forming apparatus body, the process cartridge including: a casing; and a photosensitive drum unit that is arranged inside the casing, wherein the photosensitive drum unit includes a photosensitive drum and an end member which is arranged in at least one end of the photosensitive drum, wherein the end member includes a bearing member and a shaft member which is held by the bearing member, wherein the bearing member includes a bearing member body and a shaft member holding member which is arranged inside the bearing member body in a detachably attached manner and holds the shaft member, wherein the shaft member includes a turning shaft which is movable in an axial line direction, wherein the casing is provided with a recessed operation portion which is used when a user draws out the process cartridge from the image forming apparatus body, and wherein the operation portion has a blocked portion in a recessed part corresponding to the end member side engaging with a drive shaft of the image forming apparatus body, from a center in a width direction that is a direction extending an axial line of the photosensitive drum unit.

A fourth aspect of the present invention provides a process cartridge according to the third aspect, wherein the turning shaft is configured to move in the axial line direction in accordance with turning about an axial line.

A fifth aspect of the present invention provides a process cartridge according to the third aspect, wherein the shaft member holding member and the bearing member body are attainable to and detachable from each other in a snap-fit structure.

A sixth aspect of the present invention provides a process cartridge according to the fifth aspect, wherein the snap-fit structure includes protrusion portions respectively included in both the shaft member holding member and the bearing member body, the protrusion portions being attachable to and detachable from each other as the protrusion portions engage with and are detached from each other.

A seventh aspect of the present invention provides a process cartridge according to the third aspect, wherein the shaft member holding member contains an elastic member which urges the shaft member in the axial line direction.

An eighth aspect of the present invention provides a method of separating a process cartridge which is mounted in an image forming apparatus body, from the image forming apparatus body, wherein the process cartridge includes a casing and a photosensitive drum unit which is arranged inside the casing, wherein the photosensitive drum unit includes a photosensitive drum and an end member which is arranged in at least one end of the photosensitive drum, wherein the end member includes a tubular bearing member and a shaft member which is held by the bearing member, and wherein the shaft member includes a turning shaft which is movable in an axial line direction, the method including separating the process cartridge from the image forming apparatus body so as to cause an angle formed between an axial line of the photosensitive drum unit included in the process cartridge and an axial line of a drive shaft of the image forming apparatus body to range from 1.5° to 10°.

A ninth aspect of the present invention provides a method according to the eighth aspect, wherein the bearing member includes a bearing member body and a shaft member holding member which is arranged inside the bearing member body in a detachably attached manner and holds the shaft member.

A tenth aspect of the present invention provides a method according to the eighth aspect, wherein the shaft member includes a rotary power reception member which is arranged at one end of the turning shaft and includes an engagement member engaging with the drive shaft of the image forming apparatus body, and a regulation member which is pressed to engage with or be detached from the turning shaft or the rotary power reception member, whereby the engagement member switches between an engagement posture and a non-engagement posture with respect to the drive shaft.

An eleventh aspect of the present invention provides a method according to the eighth aspect, wherein the turning shaft of the shaft member moves in the axial line direction in accordance with turning about the axial line.

A twelfth aspect of the present invention provides a method according to the eighth aspect, wherein the process cartridge includes an operation portion which is operated by a user when performing detachment, and wherein the operation portion is provided with an oblique detachment encouraging means to detach the process cartridge so as to cause an angle formed between the axial line of the photosensitive drum unit included in the process cartridge and the axial line of the drive shaft of the image forming apparatus body to range from 1.5° to 10°.

A thirteenth aspect of the present invention provides a method according to the twelfth aspect, wherein the oblique detachment encouraging means is a mark provided in the process cartridge.

A fourteenth aspect of the present invention provides a method according to the twelfth aspect, wherein the operation portion is formed to have a recessed shape, and the oblique detachment encouraging means is a part for blocking a portion of the operation portion.

According to any one of the aspects of the present invention, it may be possible to transmit rotary power equivalent to that in the related art and to perform attachment and detachment more smoothly with respect to an apparatus body.

DETAILED DESCRIPTION OF THE EXEMPLARY EMBODIMENTS

Figure 1:
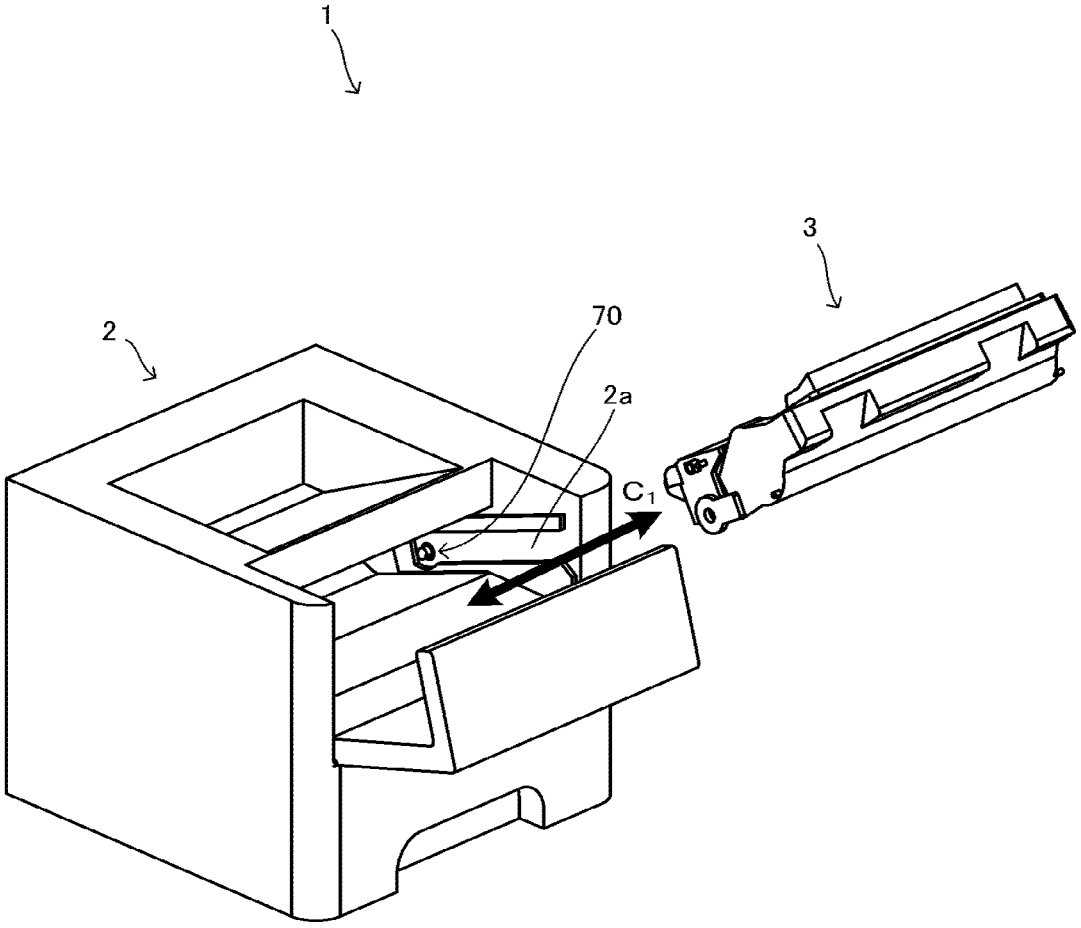
FIG. 1 is a conceptual diagram of an image forming apparatus body and a process cartridge.

Hereinafter, the present invention will be described with reference to embodiments illustrated in the drawings. However, the present invention is not limited to the embodiments.

FIG. 1 is a diagram illustrating a first embodiment. FIG. 1 is an exploded perspective view schematically illustrating an image forming apparatus 1 including a process cartridge 3 and an image forming apparatus body 2 (hereinafter, may be referred to as "an apparatus body 2") which is mounted with the process cartridge 3 to be used. The process cartridge 3 can be mounted in and be detached from the apparatus body 2 by being moved as indicated by Arrow $C_1$ in FIG. 1.

Figure 2:
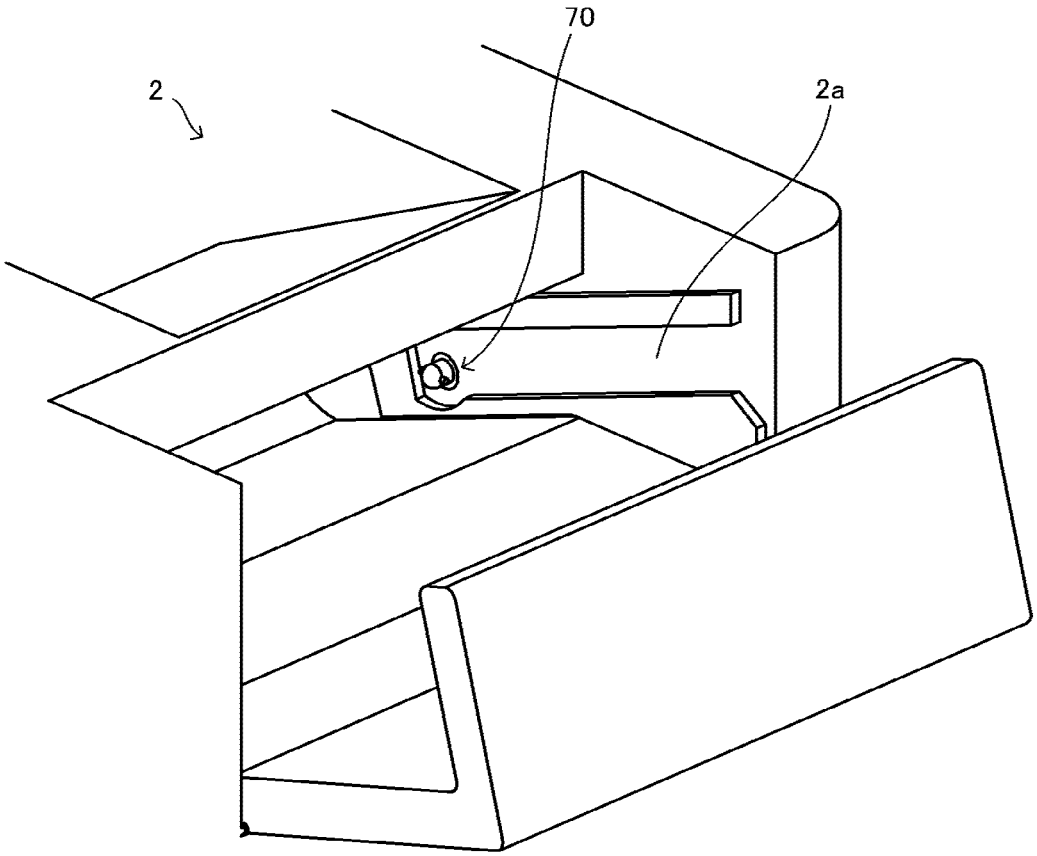
FIG. 2 is a partially enlarged diagram showing the image forming apparatus body.

FIG. 2 shows a diagram focused on a drive shaft 70 and a guide 2*a* in the apparatus body 2 illustrated in FIG. 1. As seen in FIGS. 1 and 2, the apparatus body 2 is provided with the guide 2*a* which is a groove for guiding attachment and detachment of the process cartridge 3, and the drive shaft 70 protrudes into an inner end of the guide 2*a*. A detailed embodiment of the drive shaft 70 will be described later. However, the drive shaft 70 protrudes from the bottom surface of the guide 2*a* in a depth direction of the guide 2*a* (protrudes so as to be orthogonal to a longitudinal direction of the guide 2*a*).

Figure 3A:
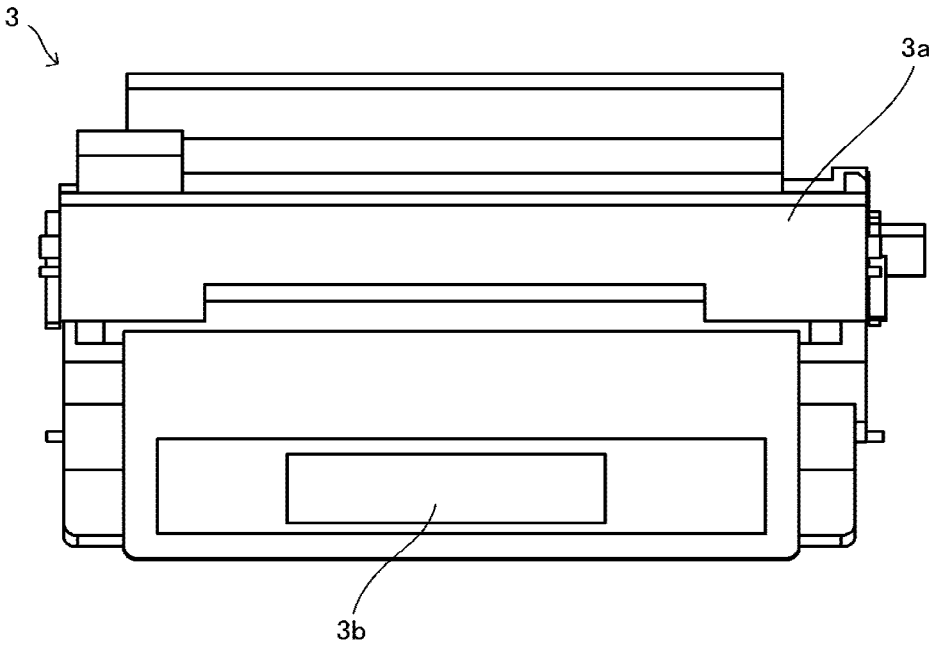
FIG. 3A is a plan view of the process cartridge.
Figure 3B:
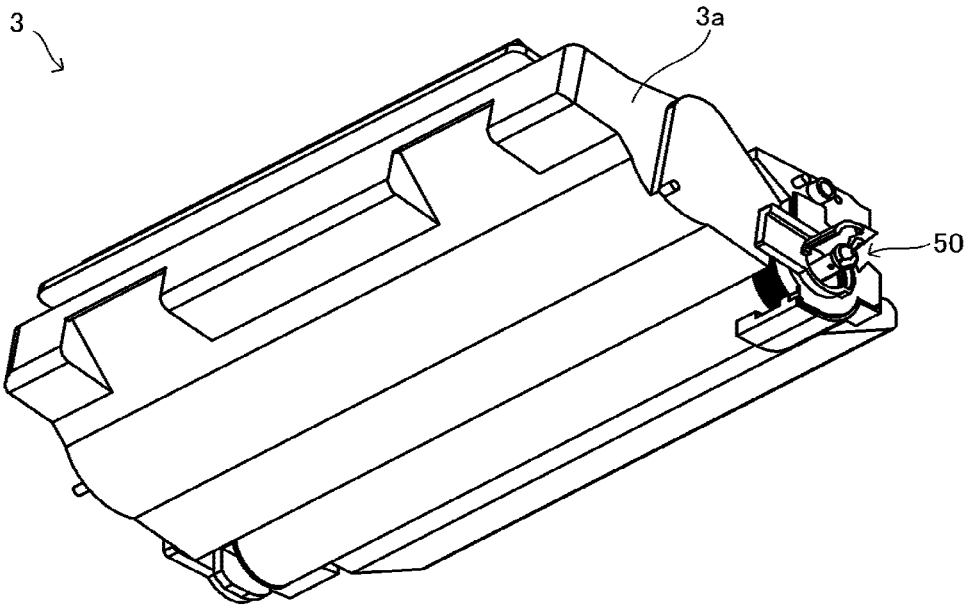
FIG. 3B is a perspective view of the process cartridge.

Meanwhile, FIGS. 3A and 3B illustrate the appearance of the process cartridge 3. FIG. 3A is a diagram of the process cartridge 3 in a planar view (a diagram showing a surface which becomes the top when being mounted in the apparatus body 2), and FIG. 3B is a perspective view when the process cartridge 3 is seen from the bottom surface side (the side opposite to the planar view). Particularly, as seen in FIG. 3B, a shaft member 50 is arranged so as to protrude from an end member 30, shown in FIG. 5, on a side surface of the process cartridge 3. Accordingly, as described below, the drive shaft 70 on the apparatus body 2 side engages with the shaft member 50, thereby transmitting rotary power. More details will be described later.

In addition, a casing 3*a* of the process cartridge 3 is provided with an operation portion 3*b*, which is configured to be operated particularly when the process cartridge 3 is detached from the apparatus body 2, by a user grasping the operation portion 3*b* or by hooking multiple fingers thereon. Therefore, the operation portion 3*b* may be formed to have a convex shape or, on the contrary, may be formed to have a recessed shape.

Figure 4:
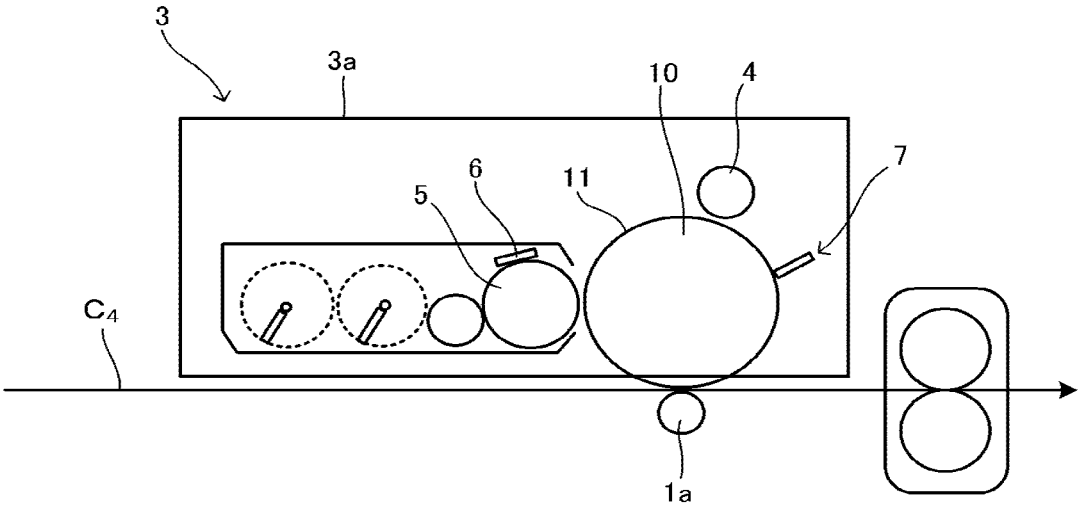
FIG. 4 is a conceptual diagram illustrating a configuration of the process cartridge.

FIG. 4 schematically shows an example of an inner structure of the process cartridge 3. As seen in FIG. 4, inside the casing 3*a*, the process cartridge 3 includes a photosensitive drum unit 10 (refer to FIG. 5), an electrification roller unit 4, a developing roller unit 5, a regulation member 6, and a cleaning blade 7. While the process cartridge 3 is in a posture being mounted in the apparatus body 2, a recording medium such as paper moves along the line indicated by the reference sign $C_4$ in FIG. 4, thereby transferring an image to the recording medium.

Attachment and detachment of the process cartridge 3 with respect to the apparatus body 2 are performed substantially as follows. Since the photosensitive drum unit 10 included in the process cartridge 3 rotates by receiving a rotary drive force from the apparatus body 2, during at least an operation, the drive shaft 70 of the apparatus body 2 engages with the shaft member 50 in the end member 30 of the photosensitive drum unit 10 so as to be in a state where rotary power can be transmitted (for example, refer to FIG. 19).

Meanwhile, during attachment and detachment of the process cartridge 3 with respect to the apparatus body 2, engagement and detachment between the drive shaft 70 and the end member 30 needs to be promptly performed so as not to mutually hinder movement on the counter side regardless of the postures.

In this manner, the end member 30 of the photosensitive drum unit 10 appropriately engages with the drive shaft 70 of the apparatus body 2, thereby transmitting a rotary drive force.

Hereinafter, each of the configurations will be described.

The process cartridge 3 includes the electrification roller unit 4, the developing roller unit 5, the regulation member 6, the cleaning blade 7, and the photosensitive drum unit 10, which are included inside the casing 3*a*. Each of the elements is configured to be as follows.

The electrification roller unit 4 electrifies a photosensitive drum 11 of the photosensitive drum unit 10 with a voltage applied from the apparatus body 2. Electrification is executed as the electrification roller unit 4 rotates following after the photosensitive drum 11 and comes into contact with the outer circumferential surface of the photosensitive drum 11.

The developing roller unit 5 includes a developing roller which supplies a photographic developer to the photosensitive drum 11. Then, the developing roller unit 5 develops an electrostatic latent image which is formed in the photosensitive drum 11. A stationary magnet is built in the developing roller unit 5.

The regulation member 6 is a member which adjusts quantity of the photographic developer adhering to the outer circumferential surface of the developing roller of the developing roller unit 5 and applies a frictional electrification charge to the photographic developer itself.

The cleaning blade 7 is a blade which comes into contact with the outer circumferential surface of the photosensitive drum 11 and uses the distal end thereof so as to eliminate a photographic developer remaining after transferring is performed.

Figure 5:
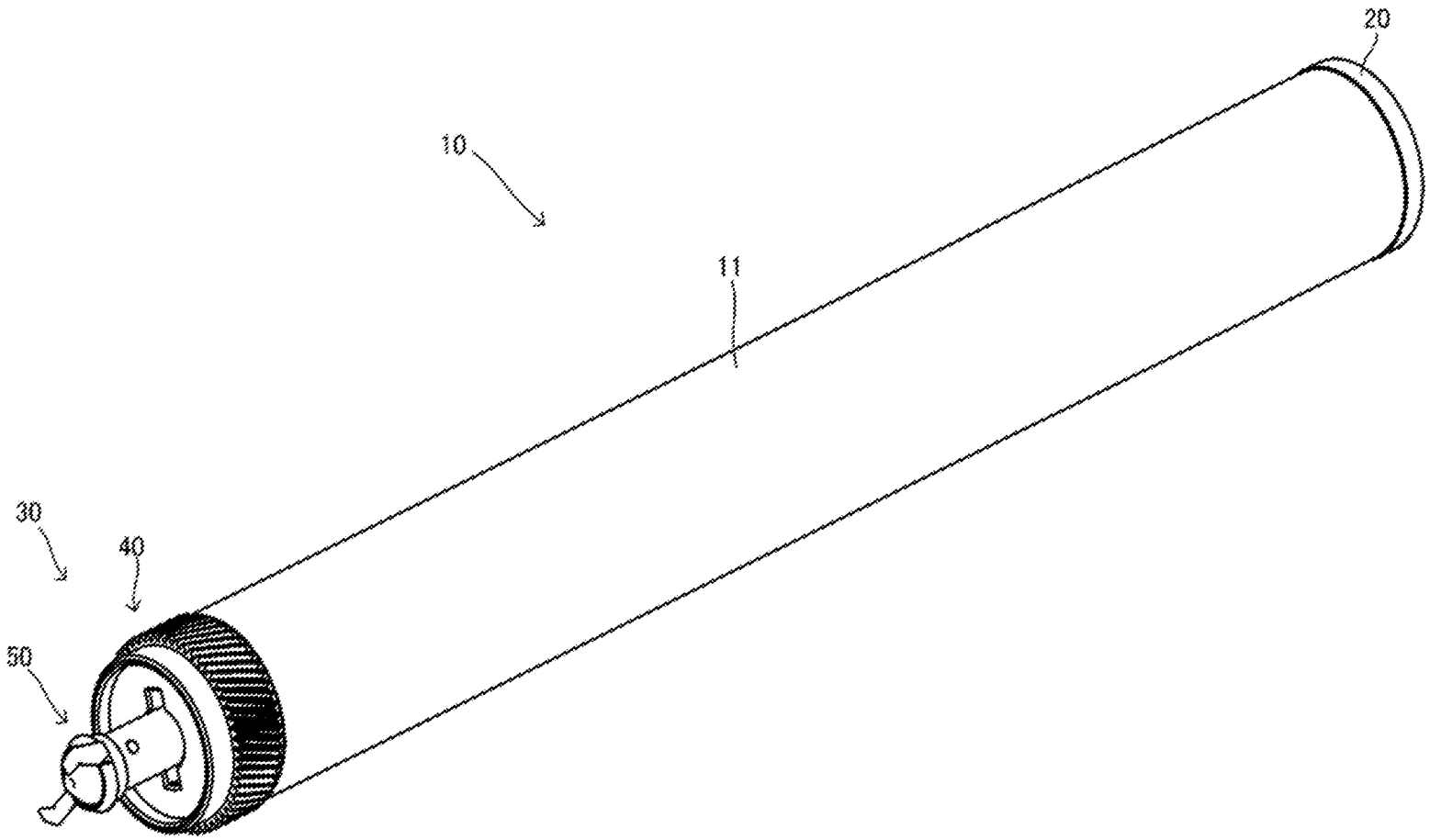
FIG. 5 is a perspective view of the appearance of a photosensitive drum unit 10.

The photosensitive drum unit 10 includes the photosensitive drum 11 in which letters, figures, and the like to be transferred to a recording medium are formed. FIG. 5 illustrates a perspective view of the appearance of the photosensitive drum unit 10. As seen in FIG. 5, the photosensitive drum unit 10 includes the photosensitive drum 11, a lid member 20, and the end member 30.

The photosensitive drum 11 is a member formed by covering the outer circumferential surface of a base body which is a columnar rotor, with a photosensitive layer. Letters, figures, and the like to be transferred to a recording medium such as paper are formed in the photosensitive layer.

The base body has a cylindrical shape formed with a conductive material composed of aluminum or an aluminum alloy. Without being particularly limited, the type of the aluminum alloy used in the base body is preferably an aluminum alloy of series 6000, series 5000, and series 3000 which are designated by the JIS standard (JTS H 4140) and are widely used in the base body of photosensitive drums.

In addition, the photosensitive layer to be formed on the outer circumferential surface of the base body is not particularly limited, and a known layer can be applied in accordance with a purpose thereof.

The base body can be manufactured by forming the cylindrical shape through cutting, extruding, drawing-out, and the like. The photosensitive drum 11 can be fabricated by coating the outer circumferential surface of the base body with a photosensitive layer so as to be laminated.

At least two end members are attached to one end of the photosensitive drum 11 in order to rotate the photosensitive drum 11 which is centered around an axial line thereof, as described below. The one end member is the lid member 20, and the other end member is the end member 30.

The lid member 20 is the end member which is arranged at an end on a side where the drive shaft 70 of the apparatus body 2 is not engaged, between the ends of the photosensitive drum 11 in an axial line direction. The lid member 20 is formed of a resin. A fitting portion which fits the inside of the cylinder of the photosensitive drum 11 is formed coaxially with a bearing portion which is arranged so as to cover one end surface of the photosensitive drum 11. The bearing portion has a circular plate shape covering the end surface of the photosensitive drum 11 and includes a portion which receives a shaft provided in the casing 3*a*. In addition, an earth plate formed with a conductive material is arranged in the lid member 20. Accordingly, the photosensitive drum 11 and the apparatus body 2 are electrically connected to each other.

The present embodiment shows an example of the lid member 20. However, without being limited thereto, it is possible to apply a lid member of other embodiments which can be generally obtained. For example, a gear may be arranged in the lid member in order to transmit rotary power.

In addition, the conductive material may be provided on the end member 30 side.

Figure 6:
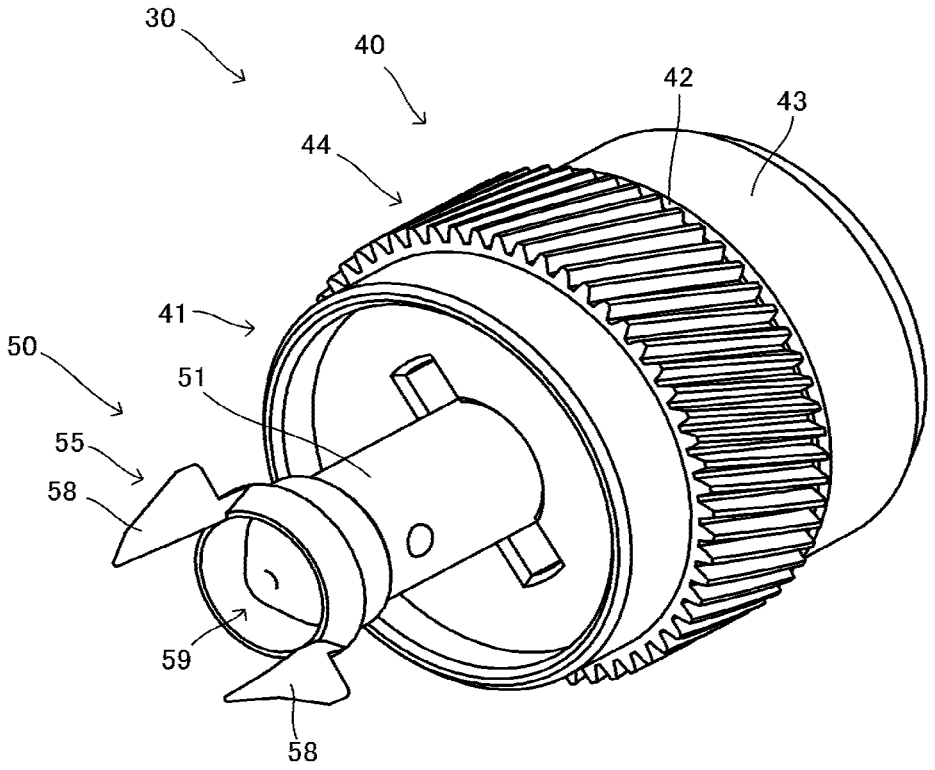
FIG. 6 is a perspective view of an end member 30.

The end member 30 is a member which is attached to an end on the side opposite to the lid member 20, between the ends of the photosensitive drum 11 and includes a bearing member 40 and the shaft member 50. FIG. 6 illustrates a perspective view of the end member 30, and FIG. 5 illustrates an exploded perspective view of the end member 30.

Figure 8A:
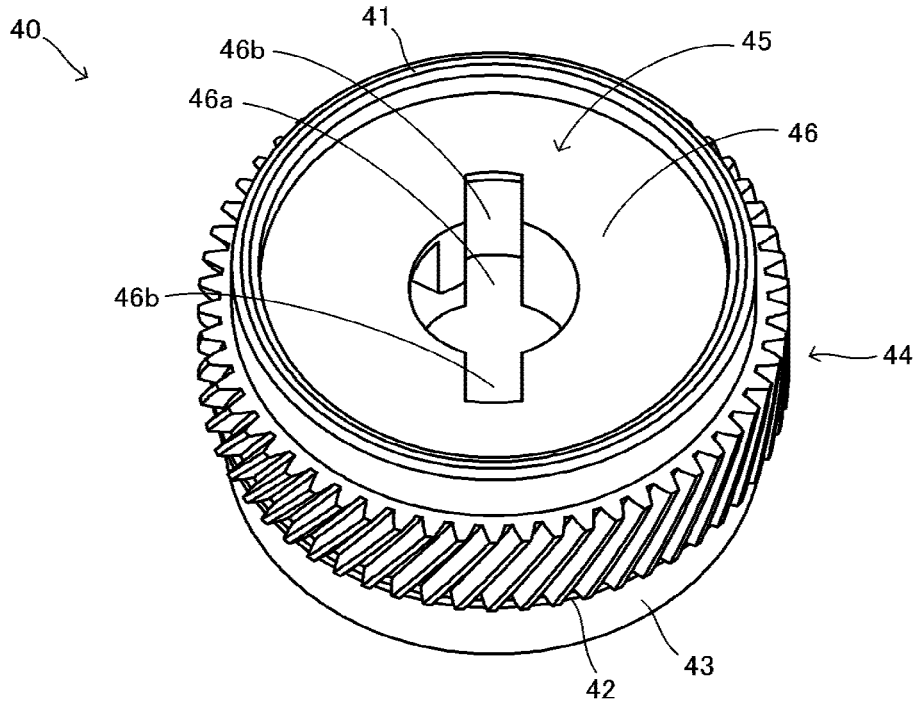
FIG. 8A is a perspective view of a bearing member 40.
Figure 8B:
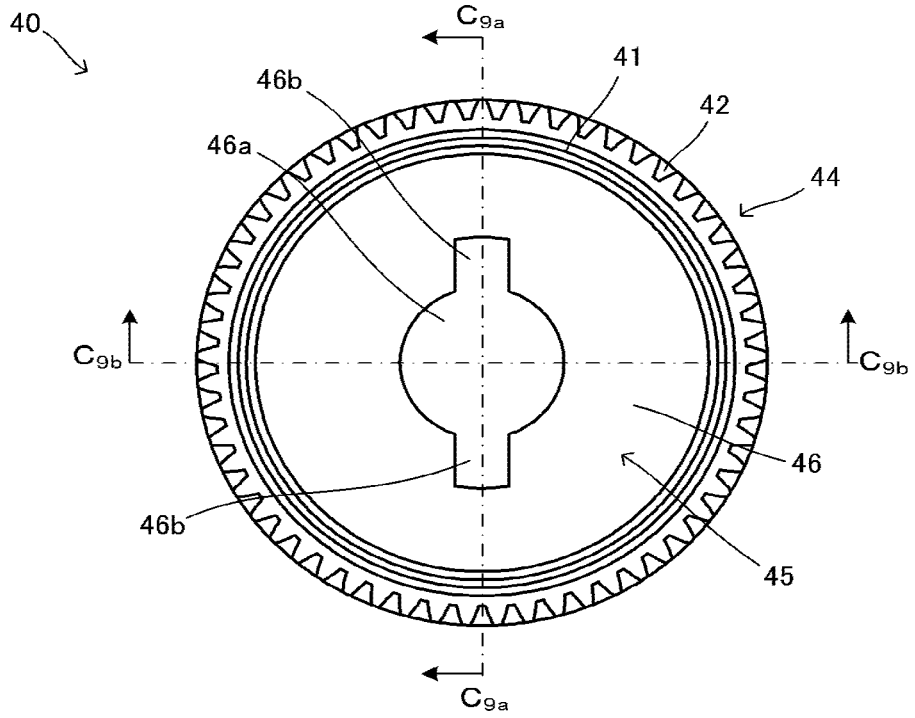
FIG. 8B is a plan view of the bearing member 40.
Figure 9A:
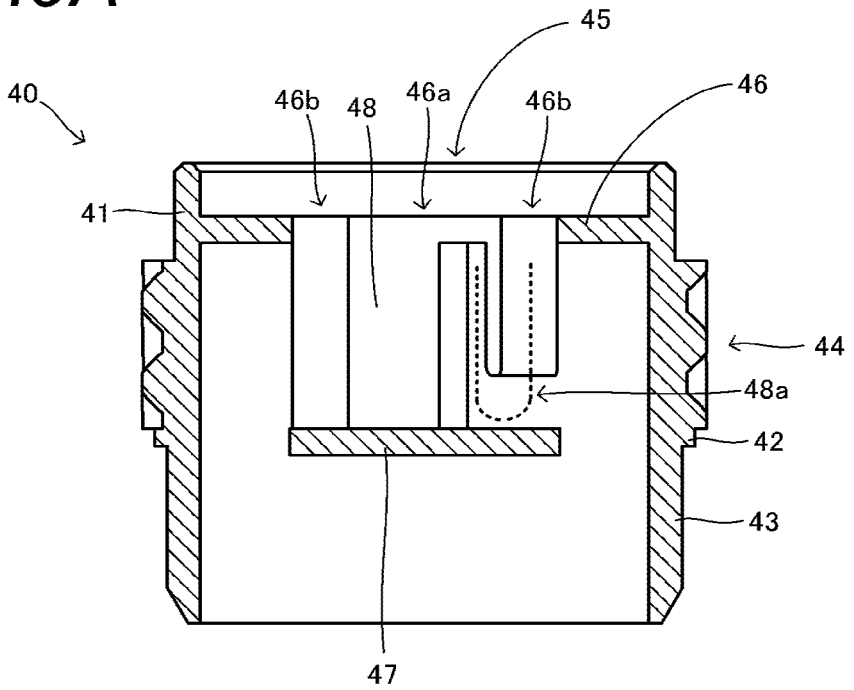
FIG. 9A is a cross-sectional view of the bearing member 40.
Figure 9B:
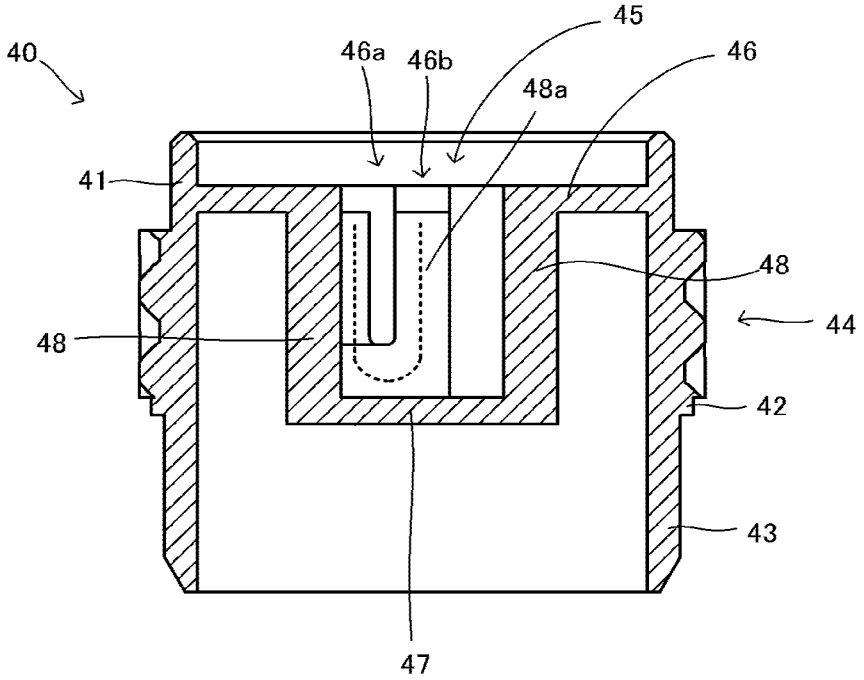
FIG. 9B is another cross-sectional view of the bearing member 40.

The bearing member 40 is a member which is bonded to the end of the photosensitive drum 11, in the end member 30. FIG. 8A shows a perspective view of the bearing member 40, and FIG. 8B shows a plan view seen from a side on which the shaft member 50 is inserted, into the bearing member 40. Moreover, FIG. 9A is a cross-sectional view taken along line $C_{9a}$-$C_{9a}$ indicated in FIG. 8B, and FIG. 9B is a cross-sectional view taken along line $C_{9b}$-$C_{9b}$ indicated in FIG. 8B. In each of the drawings shown below, the end surface (the cutting plane) in the cross-sectional view may be shown in a state where hatching is performed.

As seen in FIGS. 6 to 9B, the bearing member 40 is configured to include a tubular body 41, a contact wall 42, a fitting portion 43, a gear potion 44, and a shaft member holding portion 45.

The tubular body 41 is a cylindrical member in its entirety. The contact wall 42 and the gear potion 44 are arranged outside thereof, and the shaft member holding portion 45 is formed inside thereof.

The contact wall 42 which comes into contact and engages with the end surface of the photosensitive drum 11 stands upright from a portion of the outer circumferential surface of the tubular body 41. Accordingly, while the end member 30 is in a posture of being mounted in the photosensitive drum 11, the insertion depth of the end member with respect to the photosensitive drum 11 is regulated.

In addition, one side of the tubular body 41 having the contact wall 42 in the middle becomes the fitting portion 43 which is inserted into the photosensitive drum 11. The fitting portion 43 is inserted into the photosensitive drum 11 and is fixed onto the inner surface of the photosensitive drum 11 by using an adhesive. Accordingly, the end member 30 is fixed to the end of the photosensitive drum 11. Therefore, the outer diameter of the fitting portion 43 is substantially the same as the inner diameter of the photosensitive drum 11 within a range that allows insertion into the cylinder of the photosensitive drum 11. A groove may be formed on the outer circumferential surface in the fitting portion 43. Accordingly, the groove is filled with an adhesive, thereby improving the adhesive properties between the tubular body 41 (the end member 30) and the photosensitive drum 11 on account of an anchoring effect and the like.

The gear potion 44 is formed on the outer circumferential surface of the tubular body 41 on the side opposite to the fitting portion 43 having the contact wall 42 in the middle. The gear potion 44 is a gear which transmits rotary power to other members such as a developing roller unit. In the present embodiment, a helical gear is arranged. However, the type of the gear is not particularly limited so that a spur gear may be arranged, or both may be arranged side by side along the axial line direction of a tubular body. The gear is not necessarily provided.

The shaft member holding portion 45 is a portion which is formed inside the tubular body 41 and functions to cause the shaft member 50 to be held by the bearing member 40. As seen in FIGS. 8A to 9B, the shaft member holding portion 45 includes a turning shaft holding member 46, a support member 47, and a guide wall 48.

The turning shaft holding member 46 is a plate-like member which is formed so as to block the inside of the tubular body 41, and a hole 46*a* is formed coaxially with the axial line of the tubular body 41. A turning shaft 51 (refer to FIGS. 10A and 10B) penetrates the hole 46*a* as described below. Therefore, the hole 46*a* has the size and the shape allowing the turning shaft 51 to penetrate. However, in order to prevent the turning shaft 51 from slipping out, the hole 46*a* is formed so as to allow only a body 52 of the turning shaft 51 to penetrate but to not allow a portion in which a projection 53 is arranged to penetrate. From a viewpoint of stable movement of the turning shaft 51, it is preferable that the hole 46*a* has substantially the same shape and the size as those of the outer circumference of the body 52 of the turning shaft 51 within a range in which movement of the turning shaft 51 in the axial line direction is not significantly hindered.

In addition, in the turning shaft holding member 46, two slits 46*b* extend from the hole 46*a*. The two slits 46*b* are provided at positions symmetrical to each other interposing the axial line of the hole 46*a*. In addition, the size and the shape of each of the slits 46*b* are formed so as to allow the projection 53 of the turning shaft 51 (refer to FIGS. 10A and 10B) to penetrate the slit 46*b*.

The support member 47 is a plate-like member which is provided on the fitting portion 43 side from the turning shaft holding member 46 and is formed so as to block at least a portion of the inside of the tubular body 41. The support member 47 is formed to have a size so as to be able to support at least a below-described elastic member 63 for a turning shaft.

The guide wall 48 is a tubular member which extends from the edge of the hole 46*a* of the turning shaft holding member 46 so as to be parallel to the axial line direction of the tubular body 41, and the end thereof is connected to the support member 47. In the present embodiment, the cross-sectional shape of the inside of the guide wall 48 is the same as that of the hole 46*a*. However, as described below, since the body 52 of the turning shaft 51 is inserted into the guide wall 48, and the turning shaft 51 moves in the axial line direction, the inside thereof is formed to have the shape and the size so as to allow the movement.

In addition, a slit 48*a* is formed in the guide wall 48. In FIGS. 9A and 9B, the extending direction of the slit 48*a* is indicated by a dotted line in order to facilitate the understanding. One end side of the slit 48*a* in the longitudinal direction passes through the slit 46*b* of the turning shaft holding member 46 and extends so as to be parallel to the axial line of the tubular body 41, thereby reaching the support member 47. Thereafter, the one end side of the slit 48*a* makes a U-turn so as to extend to be parallel to the axial line direction. Then, the end (the other end side) reaches the turning shaft holding member 46. Therefore, the other end side is blocked by the turning shaft holding member 46. The slit width of the slit 48*a* is formed so as to allow the projection 53 of the turning shaft 51 (refer to FIGS. 8A and 8B) to move in the slit 48*a*.

The material configuring the bearing member 40 is not particularly limited so that a resin such as polyacetal, polycarbonate, and PPS, or a metal can be used. Here, when using a resin, in order to improve rigidity of the member, glass fibers, carbon fibers, and the like may be compounded in the resin in accordance with the load torque. In addition, in order to make attachment and movement of the shaft member smooth, the resin may contain at least one type of material among fluorine, polyethylene, and silicon rubber so as to improve slidability. Moreover, the resin may be subjected to fluorine coating or be coated with a lubricant.

When the bearing member 40 is fabricated by using a metal, it is possible to adopt carving performed by cutting, aluminum die-casting, zinc die-casting, a metal powder injection molding method (a so-called MIM method), a metal powder sintering lamination method (a so-called 3D printer), and the like. In addition, regardless of the material of a metal, iron, stainless steel, aluminum, brass, copper, and zinc, or an alloy thereof and the like may be used. Moreover, various types of plating are performed so that functionality of the surface (lubricity or corrosion resistance) can be improved.

Figure 7:
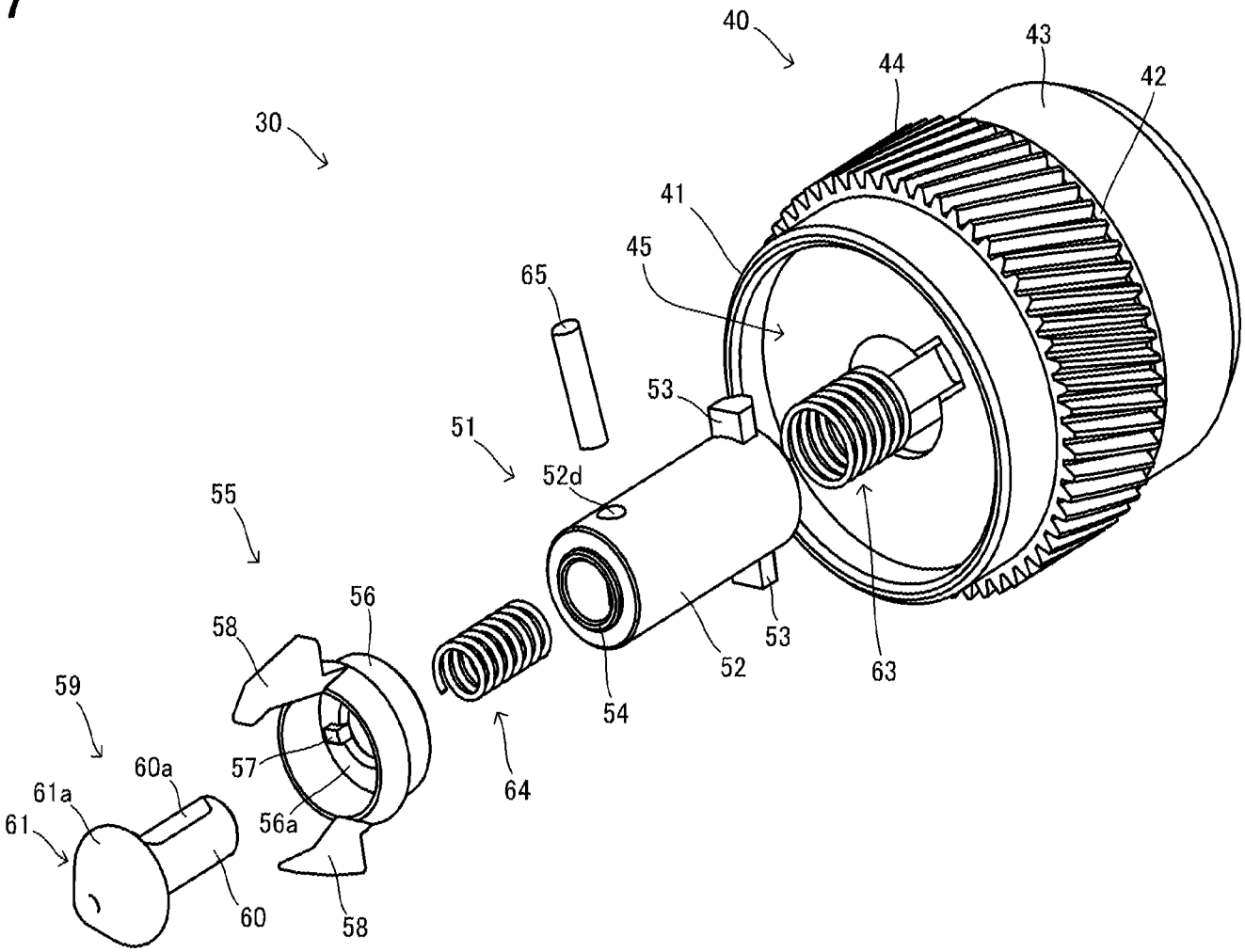
FIG. 7 is an exploded perspective view of the end member 30.

Returning to FIGS. 6 and 7, the shaft member 50 in the end member 30 will be described. As seen in FIG. 7, the shaft member 50 includes the turning shaft 51, a rotary power reception member 55, and a regulation member 59. Moreover, the shaft member 50 includes the elastic member 63 for a turning shaft, an elastic member 64 for a regulation member, and a pin 65. In the present embodiment, both the elastic member 63 for a turning shaft and the elastic member 64 for a regulation member are helical springs.

Each of the aforementioned elements will be individually described below.

The turning shaft 51 is an axial member functioning as a rotary power transmission portion which transmits rotary power received by the rotary power reception member 55 to the bearing member 40. Respectively, FIG. 10A illustrates a perspective view of the turning shaft 51, and FIG. 10B illustrates a cross-sectional view in the axial line direction including line $C_{10b}$-$C_{10b}$ indicated in FIG. 10A.

Figure 10A:
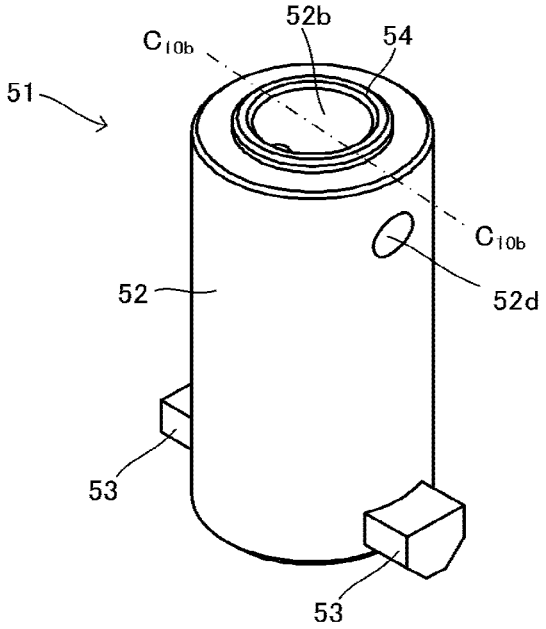
FIG. 10A is a perspective view of a turning shaft 51.
Figure 10B:
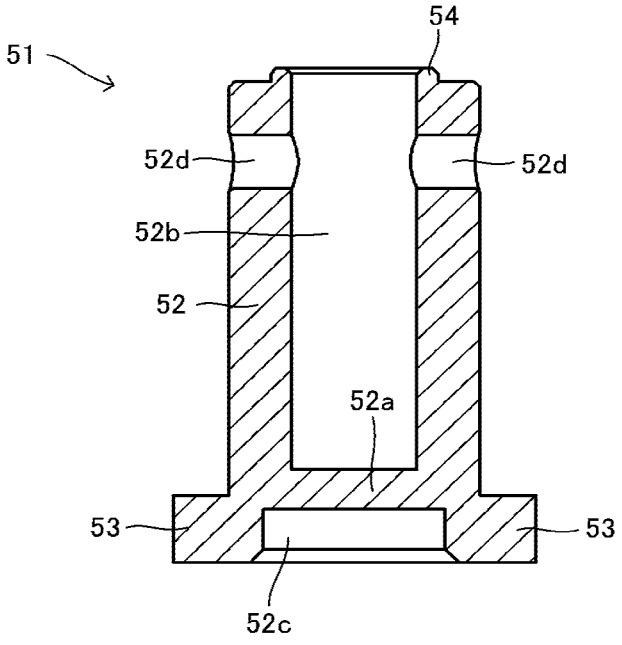
FIG. 10B is a cross-sectional view of the turning shaft 51.

As seen in FIGS. 10A and 10B, the turning shaft 51 includes the cylindrical body 52, and a partition portion 52*a* is provided inside the cylinder so as to shut the inside thereof. Therefore, recessed portions 52*b* and 52*c* are formed inside the body 52 in one side and the other side interposing the partition portion 52*a* therebetween.

Two projections 53 are arranged outside one end of the body 52. The two projections 53 are provided on the same straight line in one diameter direction of the cylinder of the body 52 so as to be positioned on the sides opposite to each other interposing the axial line therebetween. As described below, the two projections 53 function to cause the turning shaft 51 to be held by the bearing member 40 and to regulate movement of the body 52.

In addition, two holes 52*d* are formed in the turning shaft 51. The two holes 52*d* are orthogonal to the axial line of the cylinder and penetrate the inside and the outside arranged in one diameter direction of the cylinder. As described below, the pin 65 (refer to FIG. 7) passes through the hole 52*d*, which holds the regulation member 59 and regulates movement of the regulation member 59.

Moreover, on the end surface (the end surface formed on the side opposite to the projection 53 side) on a recessed portion 52*b* side between the end surfaces of the body 52, there is provided a ring-like rail projection 54 which protrudes into the extending direction of the cylinder (a direction parallel to the axial line) so as to border the opening portion of the recessed portion 52*b*. As described below, the rail projection 54 functions as a rail which guides turning of the rotary power reception member 55.

Here, one example of the turning shaft 51 is described. However, the shape is not limited to that of the turning shaft 51 as long as the turning shaft can operate and exhibits the intended functions. For example, if the elastic member 63 for a turning shaft and the elastic member 64 for a regulation member are formed with a two-stage spring, the partition portion 52*a* of the turning shaft 51 is no longer necessary. In addition, as described below, in the rotary power reception member 55, since rotations around the axial line are basically ensured by the regulation member 59, the rail projection 54 is not necessarily provided.

Figure 11A:
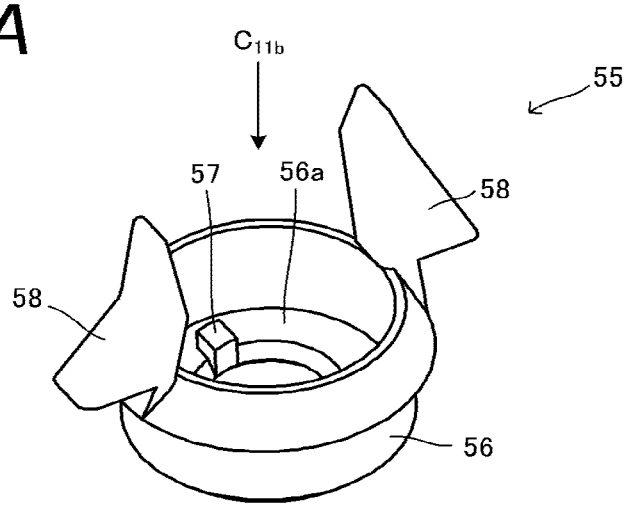
FIG. 11A is a perspective view of a rotary power reception member 55.
Figure 11B:
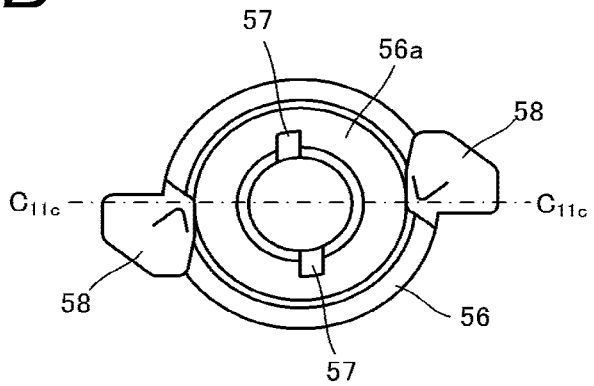
FIG. 11B is a plan view of the rotary power reception member 55.
Figure 11C:
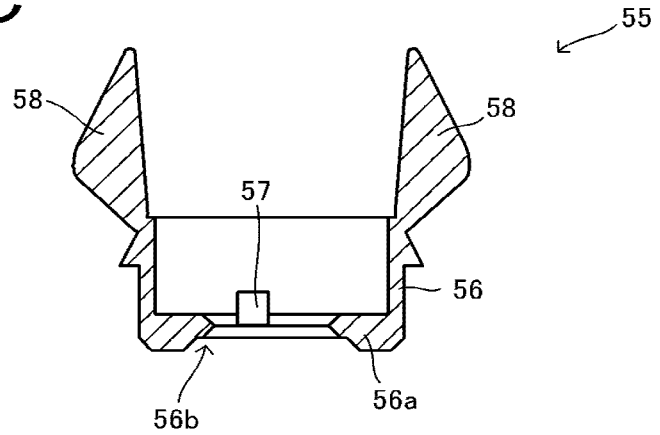
FIG. 11C is a cross-sectional view of the rotary power reception member 55.

The rotary power reception member 55 is a member which receives a rotary drive force from the apparatus body 2 (refer to FIGS. 1 and 2) and transmits the drive force to the turning shaft 51 when the end member 30 is in a predetermined posture. Respectively, FIG. 11A shows a perspective view of the rotary power reception member 55, FIG. 11B shows a plan view of the rotary power reception member 55 seen in the direction indicated by Arrow $C_{11b}$ in FIG. 11A, and FIG. 11C shows a cross-sectional view taken along line $C_{11c}$-$C_{11c}$ indicated in FIG. 11B.

As seen in FIGS. 6, 7, and 11A to 11C, the rotary power reception member 55 is configured to include two engagement members 58 which stand upright in a cylindrical base portion 56 and one end of the base portion 56.

The base portion 56 has a cylindrical shape, and a ring-like piece 56*a* is provided in the opening portion on the one end side thereof so as to narrow the opening portion. A guide 56*b* which is a ring-like recession is formed on a surface on the side opposite to the base portion 56, in the piece 56*a*. The guide 56*b* is placed on the rail projection 54 (refer to FIG. 10B) of the turning shaft 51 and guides turning of the base portion 56.

In addition, two projections 57 are provided on the inner surface of the base portion 56 in the piece 56*a* so as to face each other. Here, there are provided two projections 57 in the illustrated example. Furthermore, it is acceptable when there are provided at least two projections, and three or more projections may be provided. It is preferable that the projections are provided at equal intervals while being centered around the axial line.

As described through the rail projection 54, the guide 56*b* is not necessarily provided.

The two engagement members 58 are arranged at an end on the side opposite to the side where the piece 56*a* of the base portion 56 is provided, and are disposed away from the axial line of the base portion 56 by the same distance. Both the two engagement members 58 are arranged at positions symmetrical to each other interposing the axial line therebetween. The gap between the two engagement members 58 is formed to be substantially the same as or slightly greater than the diameter of a shaft portion 71 of the drive shaft 70 (refer to FIG. 18A) described below. As seen with reference to FIG. 19, the gap between the two engagement members 58 is configured to cause the distal ends of a a rotary power transmission projection 72 to be caught in the engagement members 58 while the shaft portion 71 of the drive shaft 70 is in a posture of being arranged between the two engagement members 58.

Descriptions will be given later regarding how rotary power can be received from the drive shaft 70.

The regulation member 59 is a member for switching between a state where the engagement members 58 of the rotary power reception member 55 can transmit a drive force from the drive shaft 70 to the bearing member 40 and a state where the engagement members 58 cannot transmit a drive force and rotate freely. In other words, the regulation member 59 switches between a posture in which the engagement members 58 engage with the drive shaft 70 so as to be able to transmit rotary power and a posture in which engagement therebetween is regulated (not engaged) so as not to be able to transmit rotary power.

Figure 12A:
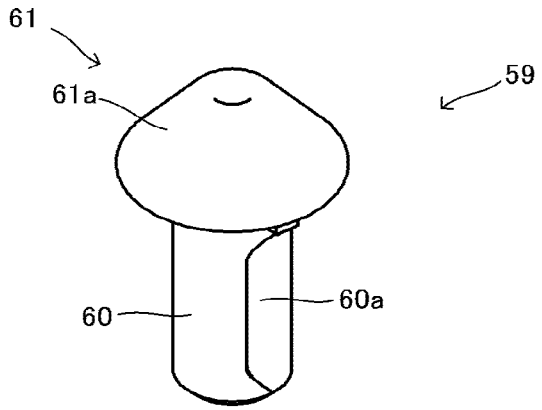
FIG. 12A is a perspective view of a regulation member 59.
Figure 12B:
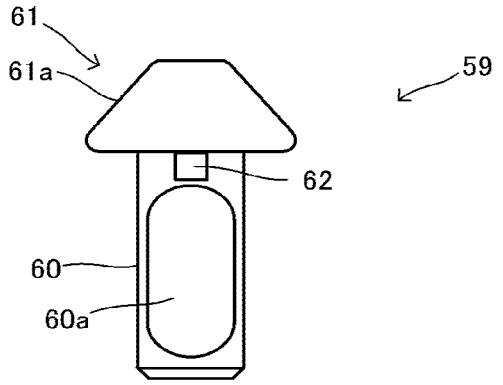
FIG. 12B is a front view of the regulation member 59.
Figure 12C:
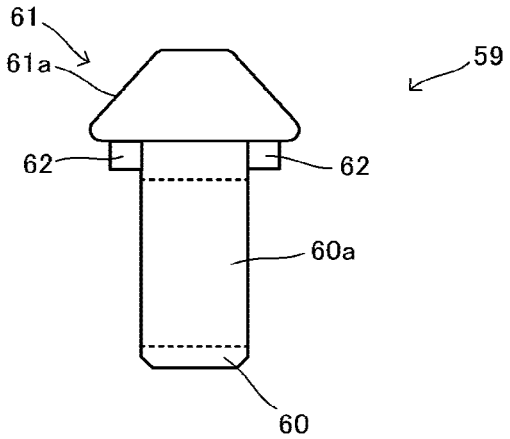
FIG. 12C is a side view of the regulation member 59.

Respectively, FIG. 12A shows a perspective view of the regulation member 59, FIG. 12B shows a front view of the regulation member 59, and FIG. 12C shows a side view of the regulation member 59.

As seen in FIGS. 12A to 12C, the regulation member 59 has a columnar regulation shaft 60, which penetrates in a direction orthogonal to the axial line of the regulation shaft 60 and is provided with a long hole 60*a* elongated in the axial line direction.

In addition, a contact portion 61 which is formed to be thicker than the regulation shaft 60 is provided on one end side of the regulation shaft 60. As seen clearly in FIGS. 12B and 12C, the contact portion 61 includes an inclination surface 61*a* which is thickest on the regulation shaft 60 side and becomes thinner as the distance from the regulation shaft 60 increases.

Moreover, between the ends of the regulation shaft 60, two projections 62 are arranged in the outer circumferential portion on a side where the contact portion 61 is arranged. The two projections 62 are arranged on the sides opposite to each other interposing the axial line of the column of the regulation shaft 60 and are provided on the same straight line in one diameter direction. As described below, the two projections 62 regulate the rotary power reception member 55. In the present embodiment, the two projections 62 are exemplified. However, it is acceptable when at least two projections are arranged, and three or more projections may be provided.

Returning to FIG. 7, another configuration included in the shaft member 50 will be described. The elastic member 63 for a turning shaft and the elastic member 64 for a regulation member are the so-called elastic members and are formed with the helical springs, in the present embodiment. In addition, the pin 65 is a rod-like member. An arrangement and an operation of each member will be described later.

The material configuring each member of the shaft member 50 is not particularly limited so that a resin such as polyacetal, polycarbonate, and PPS can be used. However, in order to improve rigidity of the member, glass fibers, carbon fibers, and the like may be compounded in the resin in accordance with the load torque. In addition, a metal may be inserted into the resin in order to enhance rigidity further, or the entirety may be manufactured by using a metal. When the shaft member 50 is fabricated by using a metal, it is possible to adopt carving performed by cutting, aluminum die-casting, zinc die-casting, a metal powder injection molding method (a so-called MIM method), a metal powder sintering lamination method (a so-called 3D printer), and the like. In addition, regardless of the material of a metal, iron, stainless steel, aluminum, brass, copper, and zinc, or an alloy thereof and the like may be used. Moreover, various types of plating are performed so that functionality of the surface (lubricity or corrosion resistance) can be improved.

In addition, from a viewpoint of a configuration in which the shaft member 50 and any one of the members included in the shaft member 50 is caused to be elastic, fabrication may be performed by bending a metal plate, or fabrication may be performed by causing a resin to be impregnated with a metal, glass, carbon fibers, and the like.

The bearing member 40 and the shaft member 50 configure the end member 30 by being assembled as follows. Through the descriptions regarding the assembly, it is possible to understand the size of each of the members and the portions, the structure, and the relationship between the sizes of the members and portions.

First, an assembly of the bearing member 40 and the turning shaft 51 will be described. FIG. 13A is a perspective view of the turning shaft 51 which is assembled in the bearing member 40, FIG. 13B is a plan view thereof, and FIG. 13C is a cross-sectional view taken along arrow line $C_{13c}$-$C_{13c}$ indicated in FIG. 13B.

Figure 13C:
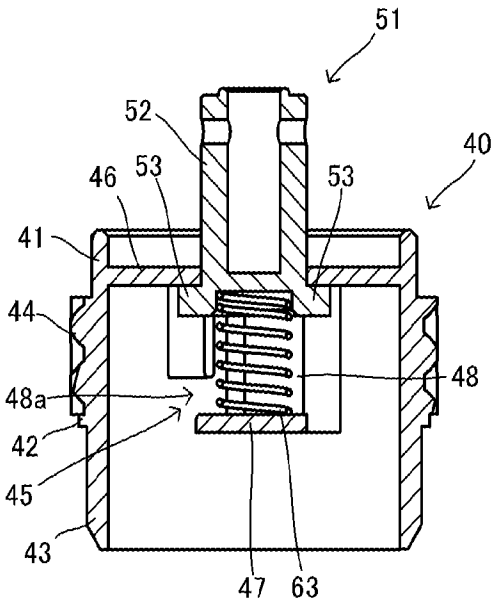
FIG. 13C is a cross-sectional view of the assembly of the bearing member 40 and the turning shaft 51.
Figure 13B:
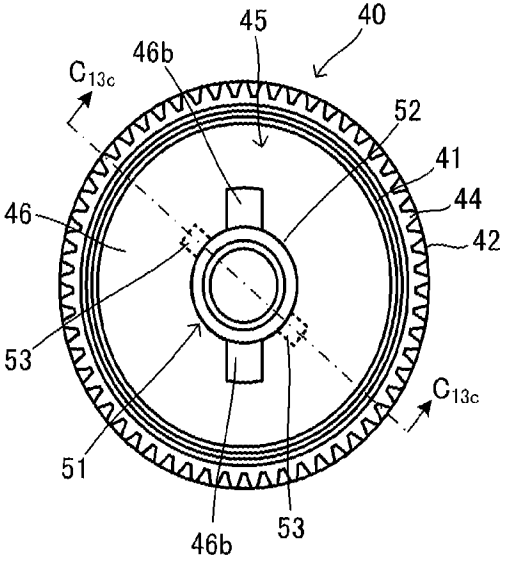
FIG. 13B is a plan view of the assembly of the bearing member 40 and the turning shaft 51.
Figure 13A:
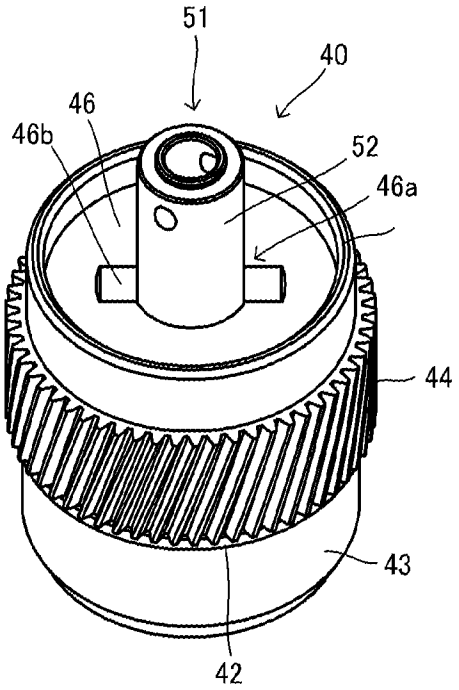
FIG. 13A is a perspective view of an assembly of the bearing member 40 and the turning shaft 51.

As seen in FIGS. 13A to 13C, the turning shaft 51 passes through the hole 46*a* of the turning shaft holding member 46 of the bearing member 40. The turning shaft 51 is arranged so as to cause the end on a side where the projection 53 is arranged to be the inside of the shaft member holding portion 45 and to cause the end on the other side to protrude from the bearing member 40. In this case, the projection 53 is arranged in the end on a side which is blocked by the turning shaft holding member 46, between the ends of the slit 48*a* provided in the guide wall 48. The projection 53 is configured to be caught in the turning shaft holding member 46 so as to prevent the turning shaft 51 from slipping out from the bearing member 40.

In addition, as seen in FIG. 13C, the elastic member 63 for a turning shaft is arranged between the turning shaft 51 and the support member 47, and the turning shaft 51 is urged in a direction in which the projection 53 is pressed against the turning shaft holding member 46.

The turning shaft 51 can be attached to the bearing member 40 by inserting the projection 53 of the turning shaft 51 from the slit 46*b* into the slit 48*a* so as to move in the slit 48*a* along the dotted lines indicated in FIGS. 9A and 9B.

Figure 14A:
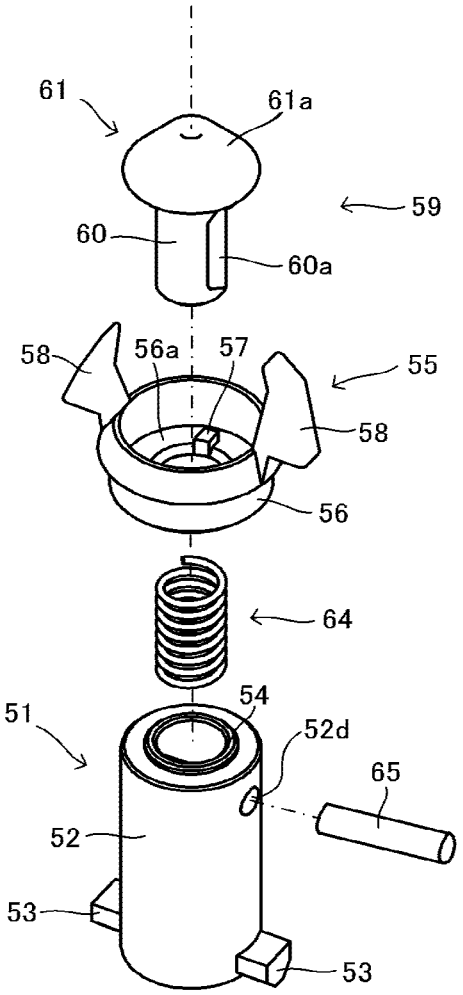
FIG. 14A is an exploded perspective view of a shaft member 50.

Subsequently, an assembly of another member with respect to the turning shaft 51 in the shaft member 50 will be described. FIG. 14 is an explanatory diagram. FIG. 14A is an exploded perspective view, and FIG. 14B is a cross-sectional view of the shaft member 50 in a direction along the axial line.

Figure 14B:
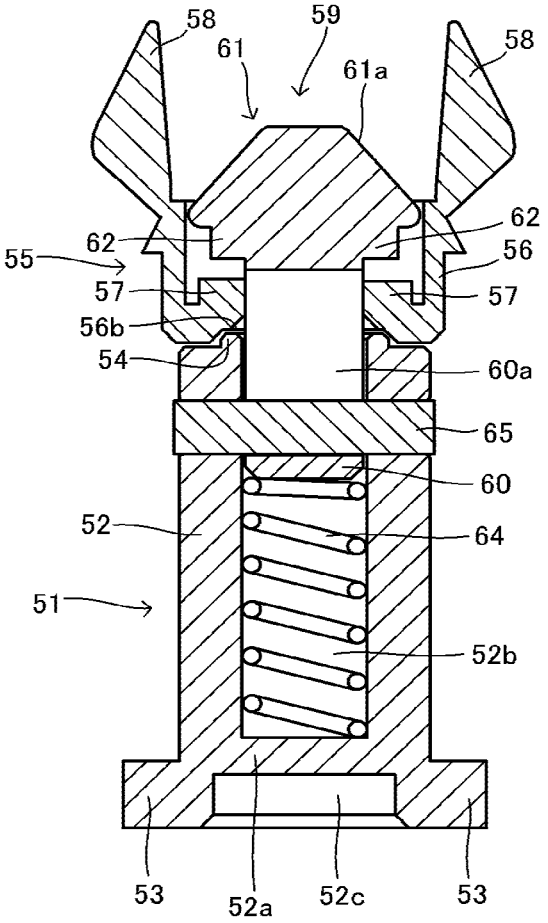
FIG. 14B is a cross-sectional view of the shaft member 50.

As seen in FIG. 14B, the elastic member 64 for a regulation member is arranged inside the recessed portion 52*b* of the body 52 of the turning shaft 51. Therefore, one end of the elastic member 64 for a regulation member is supported by the partition portion 52*a* of the body 52.

Meanwhile, the end of the regulation member 59 in the regulation shaft 60 on a side where the contact portion 61 is not arranged passes through the base portion 56 of the rotary power reception member 55, and then, the end is inserted into the recessed portion 52*b* of the body 52 of the turning shaft 51. Accordingly, the rotary power reception member 55 is arranged on the end surface on the side opposite to the projection 53, in the body 52 of the turning shaft 51. In this case, the engagement members 58 of the rotary power reception member 55 are arranged so as to protrude toward the side opposite to the turning shaft 51, and the guide 56*b* of the rotary power reception member 55 is arranged so as to overlap the rail projection 54 which is arranged on the end surface of the body 52 of the turning shaft 51.

In addition, one end of the regulation member 59 is inserted into the recessed portion 52*b* which is formed in the body 52 of the turning shaft 51, and the end surface comes into contact with the other end of the elastic member 64 for a regulation member. Accordingly, the regulation member 59 is urged in a direction protruding from the body 52. Then, the other end (that is, the end on a side where the contact portion 61 is arranged) and the contact portion 61 of the regulation member 59 are arranged inside the base portion 56 of the rotary power reception member 55 and between the two engagement members 58.

Moreover, the pin 65 passes through the long hole 60*a* provided in the regulation shaft 60 of the regulation member 59, and both ends of the pin 65 are arranged so as to cross the two holes 52*d* of the turning shaft 51. Accordingly, the regulation member 59 is regulated from slipping out from the body 52 of the turning shaft 51, against an urging force of the elastic member 64 for a regulation member.

By being assembled as described above, the axial line of each portion of the bearing member 40 and the shaft member 50 is arranged so as to coincide with each other.

Figure 15:
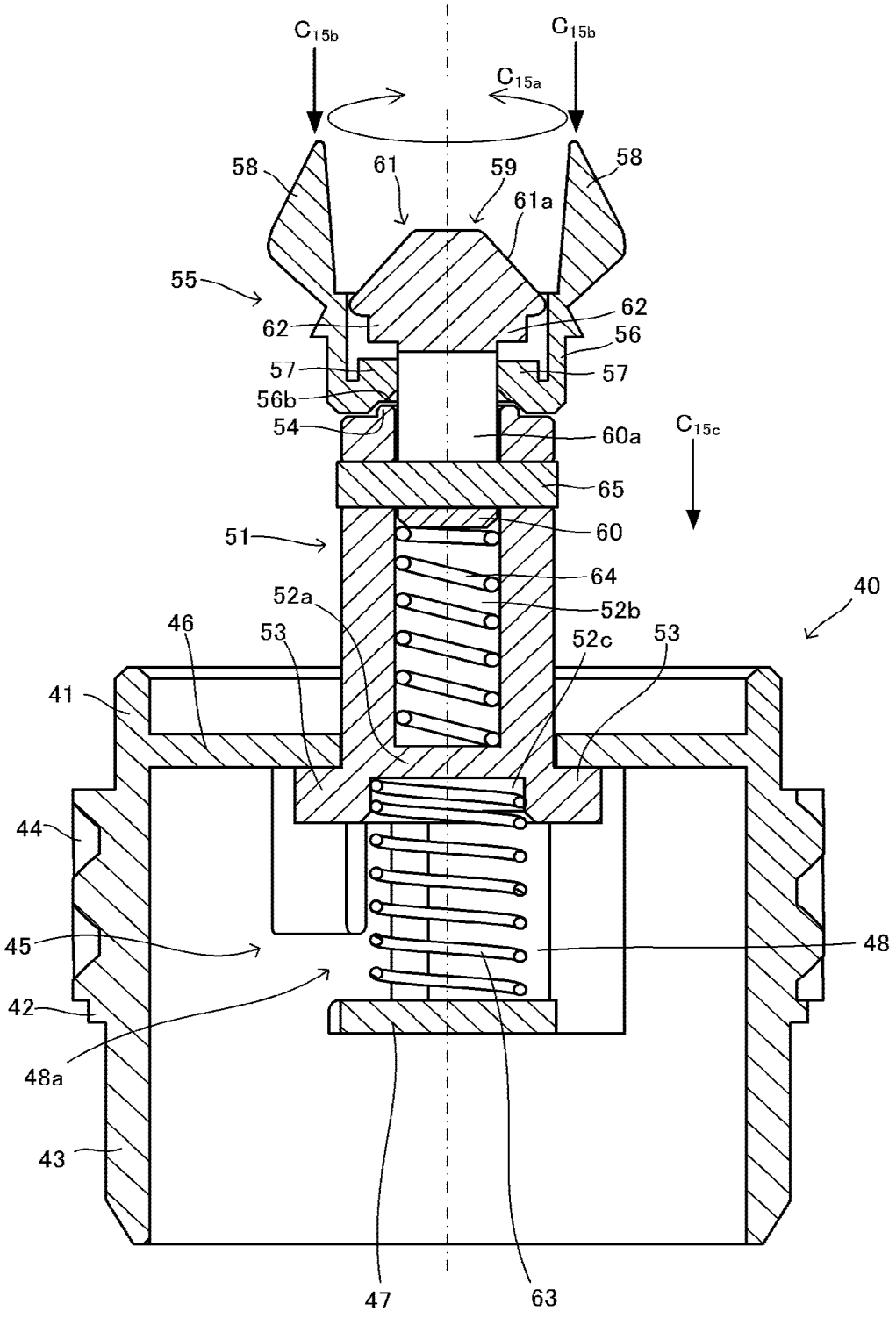
FIG. 15 is a cross-sectional view of the end member 30.

Subsequently, descriptions will be given regarding how the end member 30 which is assembled as described above can be deformed, moved, and turned. FIG. 15 shows a cross-sectional view of the end member 30 in one posture seen in the direction along the axial line.

In the posture illustrated in FIG. 15, the entirety of the shaft member 50 is in a posture protruding at the most from the bearing member 40 within the possible range on account of the elastic member 63 for a turning shaft, and the regulation member 59 is in a posture protruding at the most from the body 52 on account of the elastic member 64 for a regulation member. When there is no external force applied to the shaft member 50, the end member 30 is in the aforementioned posture.

As seen in FIG. 15, in the posture, the projection 57 of the rotary power reception member 55 and the projection 62 of the regulation member 59 are at positions different from each other being disposed away in the axial line direction when seen in a cross-sectional direction (seen from the front) in FIG. 15. Therefore, in the posture, the engagement members 58 of the rotary power reception member 55 rotate freely as indicated by $C_{15a}$ in FIG. 15. In other words, in the above-described posture, the engagement members 58 are not regulated from turning relatively to the bearing member 40 and the regulation member 59, thereby being unrestricted.

The aforementioned turning is performed while the rail projection 54 of the turning shaft 51 is guided by the guide 56*b* of the rotary power reception member 55. Therefore, even though rotary power is applied to the rotary power reception member 55 in the posture, only the rotary power reception member 55 rotates, and rotary power is not transmitted to other members. Meanwhile, the engagement members 58 are in non-engagement postures.

In addition, in the posture, as indicated by Arrow $C_{15b}$ in FIG. 15, when the engagement members 58 of the rotary power reception member 55 are pressed toward the bearing member 40 side in the axial line direction, a force is transmitted to the shaft member 50, and thus, the shaft member 50 can move in a direction of being thrust in the bearing member 40 as indicated by $C_{15c}$ in FIG. 15, against an urging force of the elastic member 63 for a turning shaft.

Figure 16:
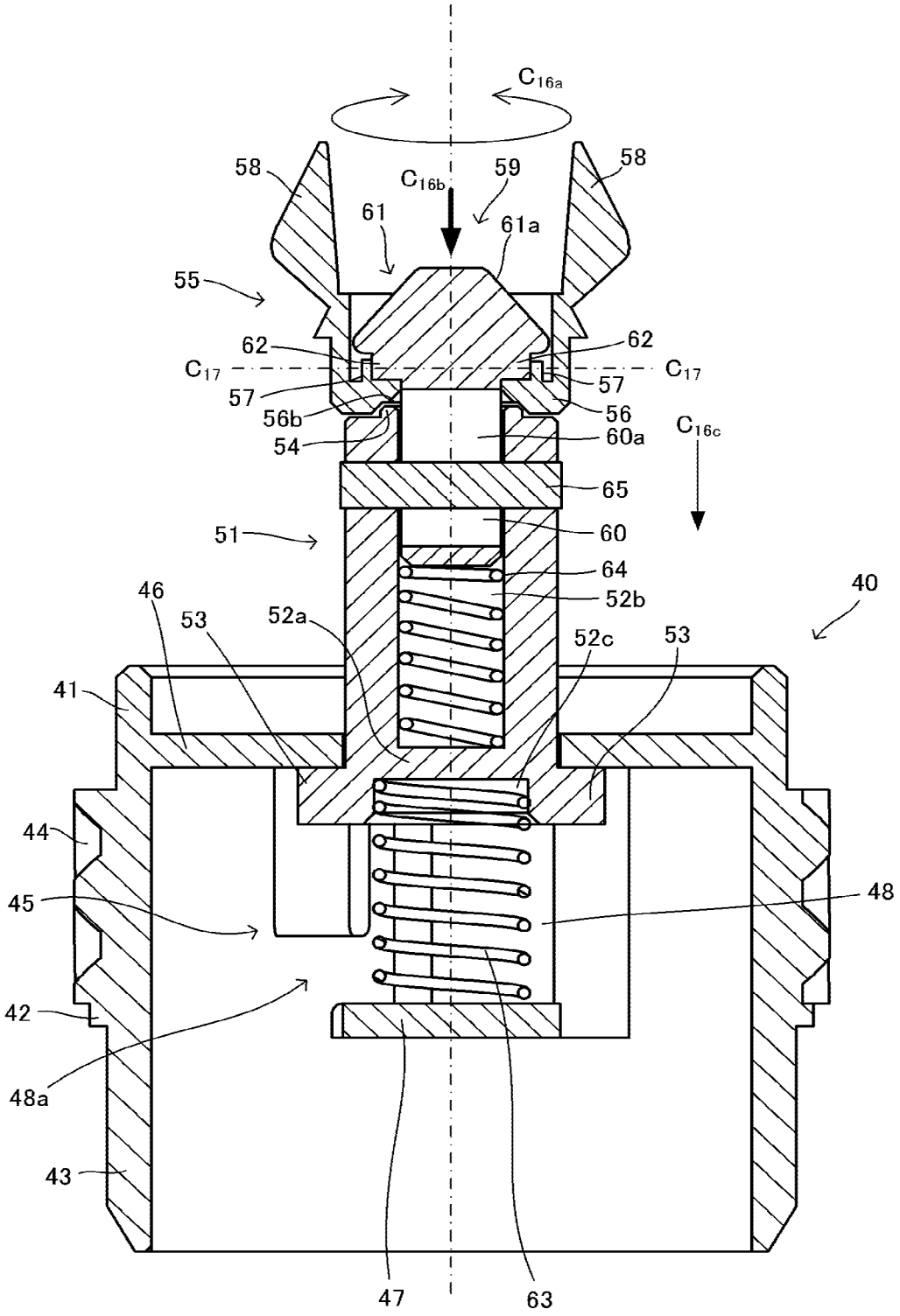
FIG. 16 is another cross-sectional view of the end member 30.
Figure 17:
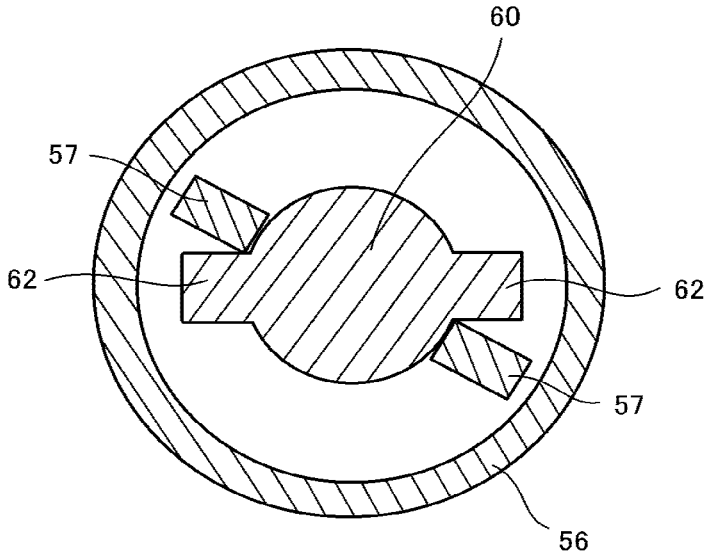
FIG. 17 is another cross-sectional view of the end member 30.

Subsequently, descriptions will be given regarding the regulation member 59 which is shifted from the posture illustrated in FIG. 15 to a posture of being thrust toward the body 52 side of the turning shaft 51. FIG. 16 is a diagram seen from the same view point as that in FIG. 15 in the posture, and FIG. 17 is the end surface of the portion taken along line $C_{17}$-$C_{17}$ indicated in FIG. 16.

In the posture, as indicated by $C_{16b}$ in FIG. 16, the regulation member 59 moves so as to be thrust in the body 52 of the turning shaft 51, against an urging force of the elastic member 64 for a regulation member. Then, the projection 62 of the regulation member 59 is in a posture of being set in the track of turning of the projection 57 of the rotary power reception member 55. Accordingly, in the posture, the engagement members 58 of the rotary power reception member 55 are regulated from turning relatively to the bearing member 40 and the regulation member 59, and thus, it is not possible for the engagement members 58 to rotate freely. For example, as illustrated in FIG. 17, when the rotary power reception member 55 rotates, and the projection 57 rotates following thereafter, any portion of the projection 57 engages with the projection 62 of the regulation member 59. Therefore, in the posture under such engagement, when a rotary drive force is applied to the regulation member 59 as indicated by $C_{16a}$ in FIG. 16, the engaged regulation member 59, the turning shaft 51 which engages with the regulation member 59 by using the pin 65, and the bearing member 40 which engages with the projection 53 of the turning shaft 51 turn in the same manner. In other words, a rotary drive force applied to the rotary power reception member 55 is transmitted to the entirety of the end member 30.

In addition, when the regulation member 59 is pressed further from the posture in a direction indicated by Arrow $C_{16b}$ in FIG. 16, a force is transmitted to the turning shaft 51, and thus, the shaft member 50 can move so as to be thrust in the bearing member 40 in the axial line direction as indicated by $C_{16c}$ in FIG. 16, against an urging force of the elastic member 63 for a turning shaft.

As the end member 30 illustrated in FIG. 5 (also refer to FIG. 19), the fitting portion 43 of the end member 30 is inserted into one end of the photosensitive drum 11 and is glued thereto. In addition, the photosensitive drum unit 10 can be formed by arranging the lid member 20 in the other end of the photosensitive drum 11.

Subsequently, the apparatus body 2 will be described. In the present embodiment, the apparatus body 2 is a body of a laser printer. The laser printer operates in a posture mounted with the process cartridge 3 as described above. When forming an image, the photosensitive drum 11 rotates for electrification performed by the electrification roller unit. In this state, the photosensitive drum 11 is irradiated with a laser beam corresponding to image information by using various types of optical members included therein, thereby acquiring an electrostatic latent image based on the image information. The latent image is developed by the developing roller unit 5.

Meanwhile, a recording medium such as paper is set in the apparatus body 2 and is transported to a transfer position by a feeding roller, a transportation roller, and the like which are provided in the apparatus body 2. A transfer roller 1*a* (refer to FIG. 4) is arranged in the transfer position. As the recording medium passes through, a voltage is applied to the transfer roller 1*a*, and an image is transferred from the photosensitive drum 11 to the recording medium. Thereafter, heat and pressure are applied to the recording medium so that the image is fixed to the recording medium. Then, the recording medium having the image formed thereon is discharged from the apparatus body 2 by a discharge roller and the like.

In this manner, in the posture mounted with the process cartridge 3, the apparatus body 2 applies a rotary drive force to the photosensitive drum unit 10. Here, descriptions will be given regarding how a rotary drive force is applied from the apparatus body 2 to the photosensitive drum unit 10 in the posture mounted with the process cartridge 3.

Figure 18A:
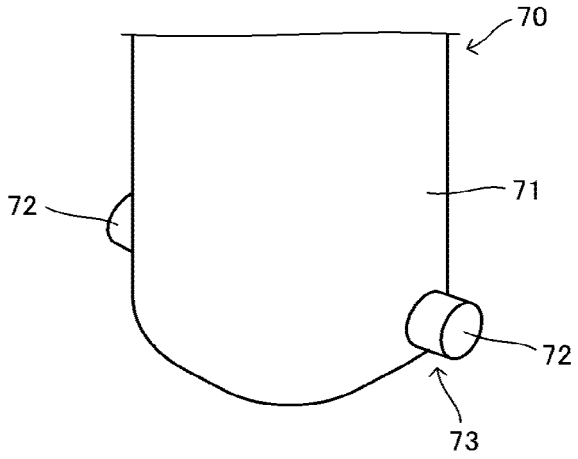
FIG. 18A is a perspective view of a drive shaft 70.
Figure 18B:
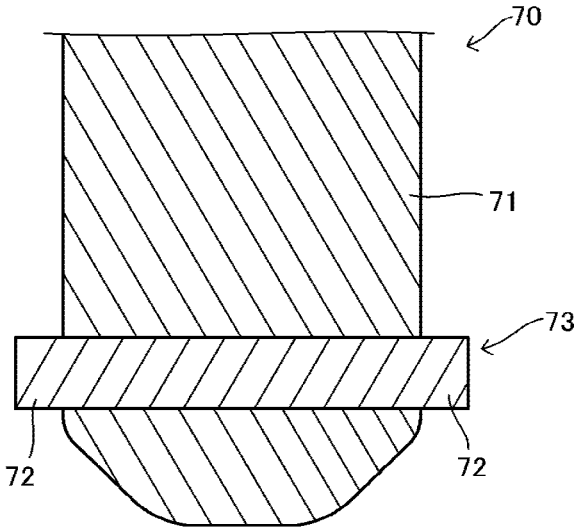
FIG. 18B is a cross-sectional view of the drive shaft 70.

A rotary drive force is applied to the process cartridge 3 by the drive shaft 70 which is a rotary power applying portion of the apparatus body 2. As seen in FIGS. 1 and 2, the drive shaft 70 is arranged so as to protrude from the bottom of the inner end of the guide 2*a*. FIG. 18A illustrates a perspective view of the shape of the distal end of the drive shaft 70. In addition, FIG. 18B shows a cross-sectional view along the axial line direction of the drive shaft 70. As seen in the drawings, the drive shaft 70 is configured to include the shaft portion 71 and rotary power transmission projections 72.

The shaft portion 71 is a shaft member which rotates while being centered around the axial line thereof. Then, the distal end of the shaft portion 71 has a sufficient size so as to be able to be arranged between the two engagement members 58 (for example, refer to FIG. 6) of the rotary power reception member 55 of the shaft member 50 described above.

In addition, it is preferable that corner portions of the distal end surface of the shaft portion 71 are eliminated and the distal end surface is subjected to so-called chamfering. In this manner, the drive shaft 70 and the shaft member 50 engage with each other more smoothly.

On the side opposite to the distal end side of the shaft portion 71 illustrated in FIG. 18A, a train of gears is formed so as to allow the shaft portion 71 to rotate while being centered around the axial line, and the shaft portion 71 is connected to a motor which is a drive source, through the train of gears.

The rotary power transmission projections 72 are two columnar members which are provided near the distal end of the shaft portion 71 so as to protrude from the shaft portion 71 in the direction orthogonal to the axial line of the shaft portion 71. In the present embodiment, one pin 73 is formed so as to be longer than the diameter of the shaft portion 71 in the longitudinal direction. The pin 73 is formed so as to cross the axial line of the shaft portion 71 and to cause both the ends thereof to protrude from the side surfaces of the shaft portion 71.

Here, with respect to a movement direction in which the process cartridge 3 is attached to and detached from the apparatus body 2 (a direction in which the guide 2*a* extends) indicated by $C_1$ in FIG. 1, the shaft portion 71 of the drive shaft 70 is arranged so as to protrude in a substantially perpendicular manner from the bottom of the guide 2*a*. In addition thereto, the shaft portion 71 rotates only without moving in the axial line direction. Therefore, when performing attachment and detachment of the process cartridge 3, the shaft member 50 needs to be mounted in and be detached from such a drive shaft 70. Then, according to the end member 30 described above, mounting and detachment between the shaft member 50 and the drive shaft 70 are easily performed. A specific form of attachment and detachment will be described later.

Figure 19:
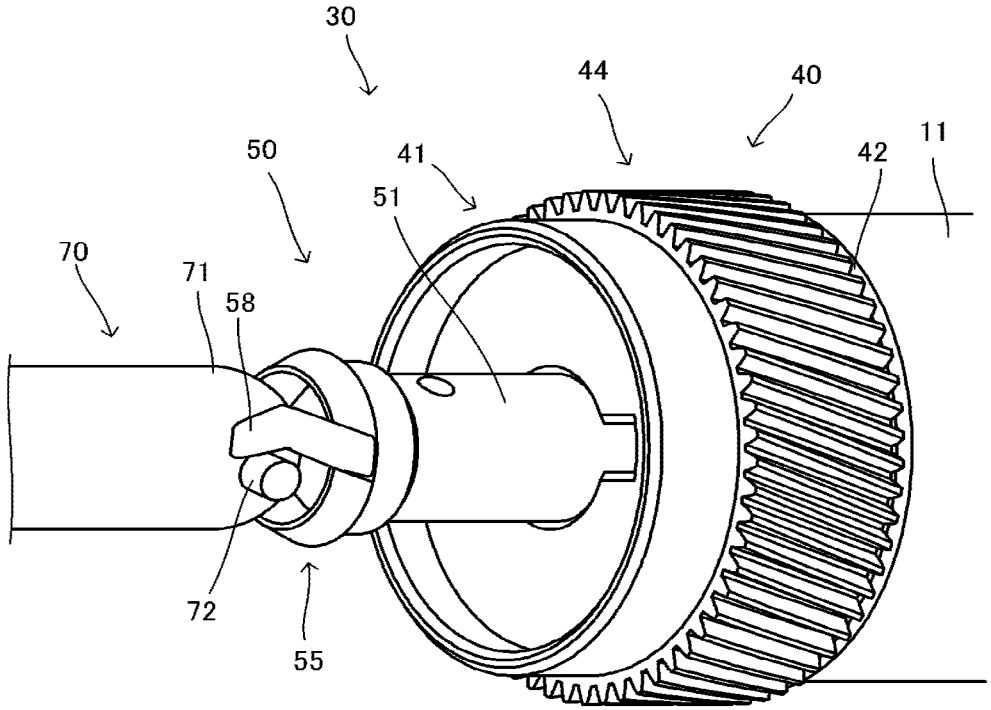
FIG. 19 is a perspective view of an instance in which the drive shaft 70 and the end member 30 engage with each other.

In a posture in which the process cartridge 3 is mounted in the apparatus body 2, the drive shaft 70 engages with the rotary power reception member 55 which is furnished in the shaft member 50 of the end member 30, thereby transmitting rotary power. FIG. 19 illustrates an instance in which the rotary power reception member 55 of the end member 30 engages with the drive shaft 70.

As seen in FIG. 19, in the posture in which the drive shaft 70 and the rotary power reception member 55 engage with each other, the axial line of the drive shaft 70 and the axial line of the shaft member 50 are arranged so as to coincide with each other. In this case, the distal end of the shaft portion 71 of the drive shaft 70 enters between the two engagement members 58 of the rotary power reception member 55, and the rotary power transmission projection 72 of the drive shaft 70 engages with the engagement members 58 from the side surfaces so as to be caught therein. Then, in this case, the distal end of the shaft portion 71 of the drive shaft 70 presses the contact portion 61 of the regulation member 59, and thus, the end member 30 is in the posture illustrated in FIG. 16. Accordingly, when the drive shaft 70 rotates, the rotary power reception member 55 rotates following thereafter. Then, the end member 30 and the photosensitive drum 11, that is, the photosensitive drum unit 10 rotates.

Figure 20A:
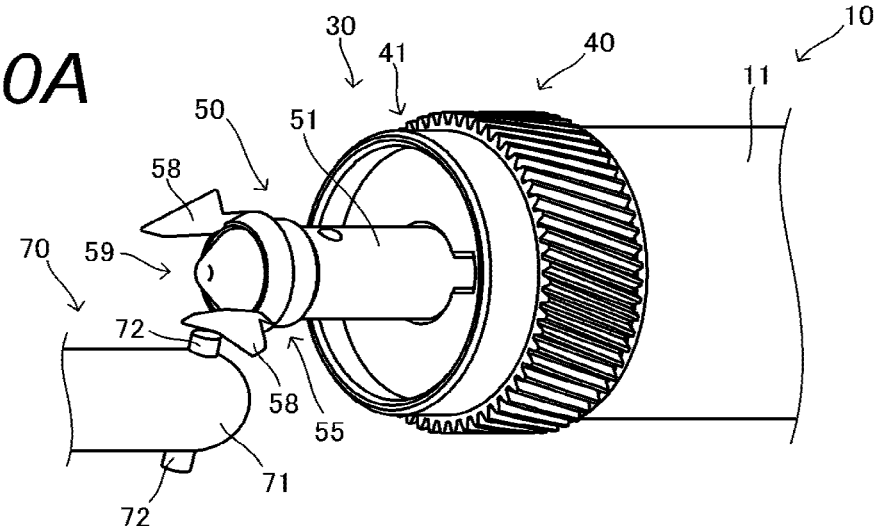
FIG. 20A is a perspective view illustrating an instance in which the drive shaft 70 and the photosensitive drum unit 10 engage with each other.
Figure 20B:
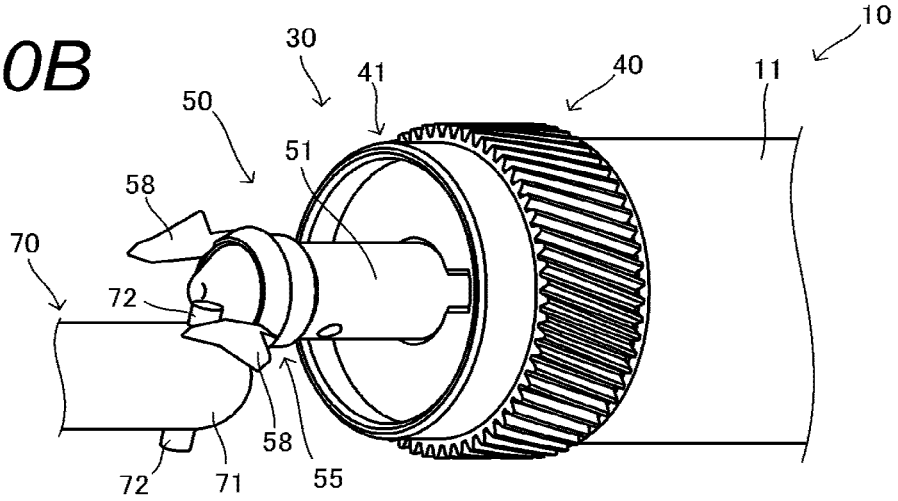
FIG. 20B is a perspective view illustrating another instance in which the drive shaft 70 and the photosensitive drum unit 10 engage with each other.
Figure 20C:
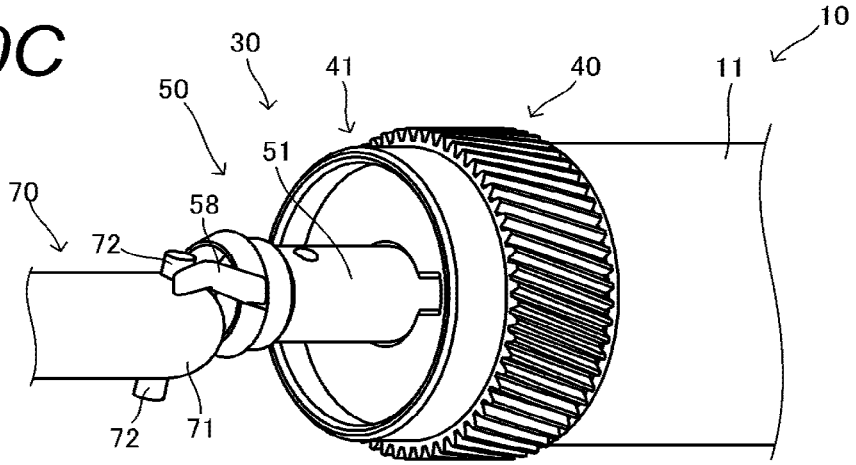
FIG. 20C is a perspective view illustrating another instance in which the drive shaft 70 and the photosensitive drum unit engage with each other.
Figure 21:
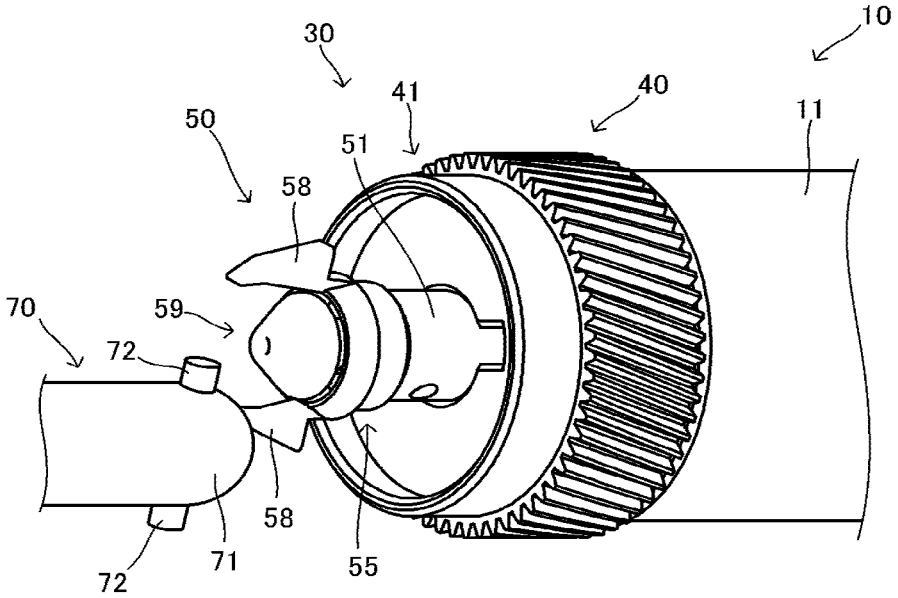
FIG. 21 is a perspective view illustrating an instance in which the drive shaft 70 and a photosensitive drum unit 10 engage with each other.

Subsequently, descriptions will be given regarding an example of the operation of the drive shaft 70 when being in the posture of FIG. 19 by mounting the process cartridge 3 in the apparatus body 2, and the photosensitive drum unit 10. FIGS. 20 and 21 are explanatory diagrams. FIG. 20 is a perspective view showing a process in which the drive shaft 70 engages with the rotary power reception member 55, in the order of those in FIGS. 20A to 20C. FIG. 21 shows a perspective view of an instance of engagement according to an example different from that in FIG. 20.

First, from the state illustrated in FIG. 20A, the photosensitive drum unit 10 approaches in the direction orthogonal to the axial line direction of the drive shaft 70 as illustrated in FIG. 20B. In this case, the end member 30 of the photosensitive drum unit 10 is oriented toward the drive shaft 70 side so as to cause the axial line thereof to be oriented parallel to the axial line of the drive shaft 70, thereby approaching the drive shaft 70 while moving in the direction orthogonal to the axial line. In this case, the shaft member 50 is in the posture illustrated in FIG. 15.

In the instance illustrated in FIG. 20B, the drive shaft 70 comes into contact with the engagement members 58 of the rotary power reception member 55. However, in this case, since the shaft member 50 is in the posture illustrated in FIG. 15, the rotary power reception member 55 rotates freely. Therefore, the drive shaft 70 presses and rotates the rotary power reception member 55. Accordingly, the drive shaft 70 can enter between the two engagement members 58 as illustrated in FIG. 20C, without being hindered by the engagement members 58 of the rotary power reception member 55.

As illustrated in FIG. 20C, when the drive shaft 70 enters between the two engagement members 58, the distal end of the drive shaft 70 presses the contact portion 61 of the regulation member 59. Here, since the contact portion 61 is configured to include the inclination surface 61*a*, the entering is smoothly performed. In this manner, eventually, being in the posture illustrated in FIG. 19 (the posture illustrated in FIG. 16), a rotary drive force from the drive shaft 70 can be transmitted to the photosensitive drum 11.

Meanwhile, uncommonly in a positional relationship between the drive shaft 70 and the engagement members 58 of the rotary power reception member 55, even though the rotary power reception member 55 is in the posture illustrated in FIG. 15, it is assumed that the rotary power reception member 55 does not appropriately rotate. However, in such a case, as illustrated in FIG. 21, the drive shaft 70 applies a force indicated by $C_{15b}$ illustrated in FIG. 15 to the shaft member 50. Therefore, the entirety of the shaft member 50 is thrust toward the bearing member 40 side, and the drive shaft 70 passes over the engagement members 58 so as to enter the position between the two engagement members 58, thereby being in a posture in which rotary power can be transmitted as illustrated in FIG. 19.

As described above, the process cartridge 3 can be mounted in the apparatus body 2 so as to be thrust in a direction different from the axial line direction of the drive shaft 70 of the apparatus body 2. Even though detachment is differently operated, the detachment is also smoothly performed on account of movement and turning of the shaft member 50 in a similar manner.

In addition, by using the end member 30, without requiring oscillating (tilting) of the shaft member 50, it is possible to more smoothly perform attachment and detachment of the drive shaft 70 with respect to the shaft member 50 on account of turning in the axial line direction and movement in the direction orthogonal to the axial line direction. Then, since the common difference in measurement can be sufficiently set with respect to a shaft member which requires oscillating (tilting), productivity is considered to be high from the viewpoint thereof.

In addition, since the engagement members 58 can switch between the non-engagement state with respect to the drive shaft 70 and the engagement state with respect to the drive shaft 70 as necessary by using the regulation member 59, hindrance to attachment and detachment caused by a member is unlikely to occur during attachment and detachment of a process cartridge, and thus, attachment and detachment is performed more smoothly.

Figure 22:
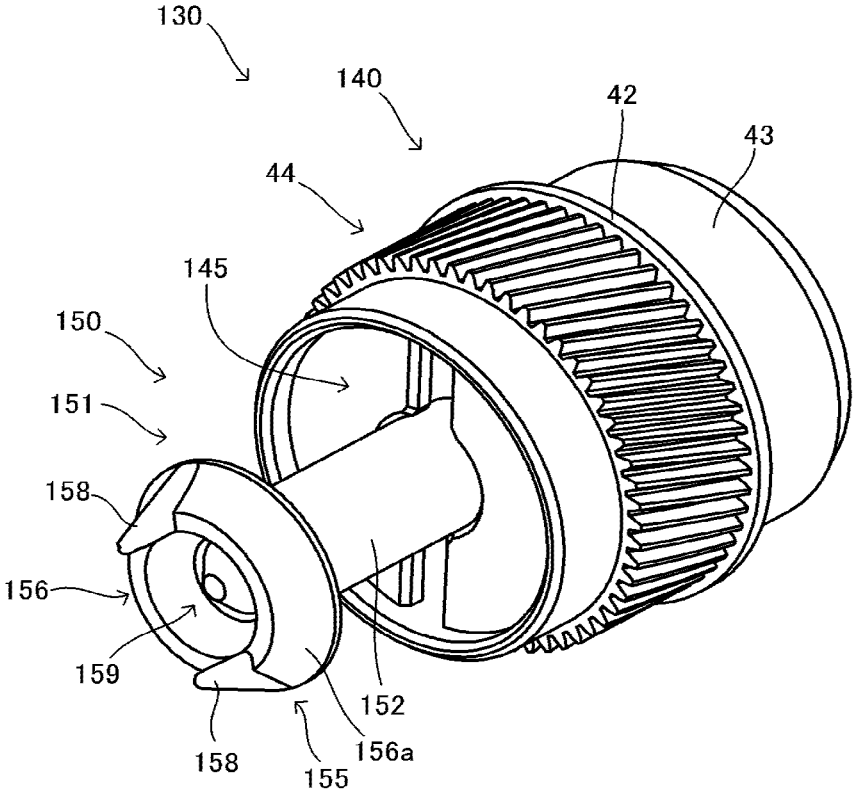
FIG. 22 is a perspective view of an end member 130.
Figure 23:
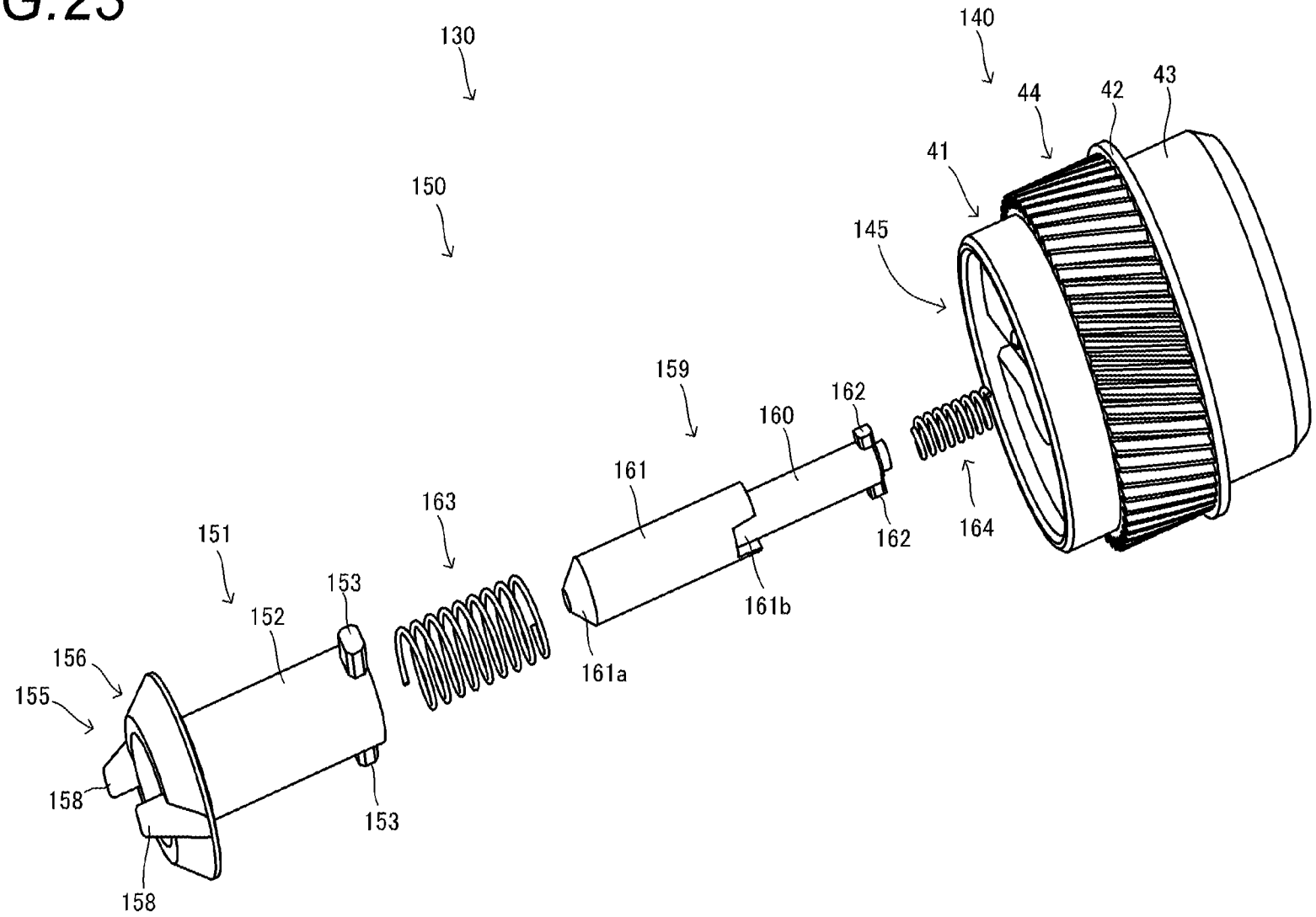
FIG. 23 is an exploded perspective view of the end member 130.

Subsequently, a second embodiment will be described. FIG. 22 is a perspective view of an end member 130 in the second embodiment, and FIG. 23 is an exploded perspective view of the end member 130. In the second embodiment, the elements other than the end member 130 are the same as those in the first embodiment. Therefore, the descriptions thereof will be omitted. In addition, regarding the end member 130 as well, the same reference numerals and signs are applied to the same portions in the end member 30, thereby omitting the descriptions.

The end member 130 is a member which is attached to an end on the side opposite to the lid member 20, between the ends of the photosensitive drum 11 and includes a bearing member 140 and a shaft member 150.

Figure 24A:
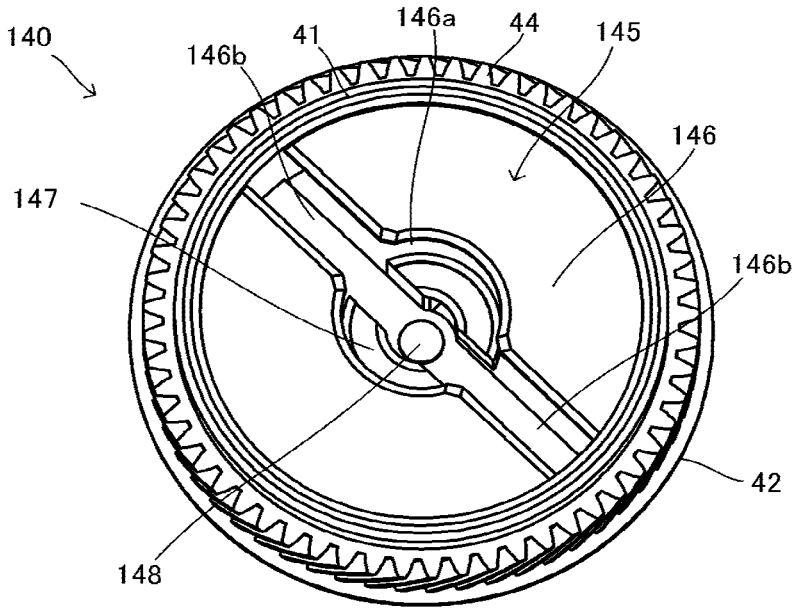
FIG. 24A is a perspective view of a bearing member 140.
Figure 24B:
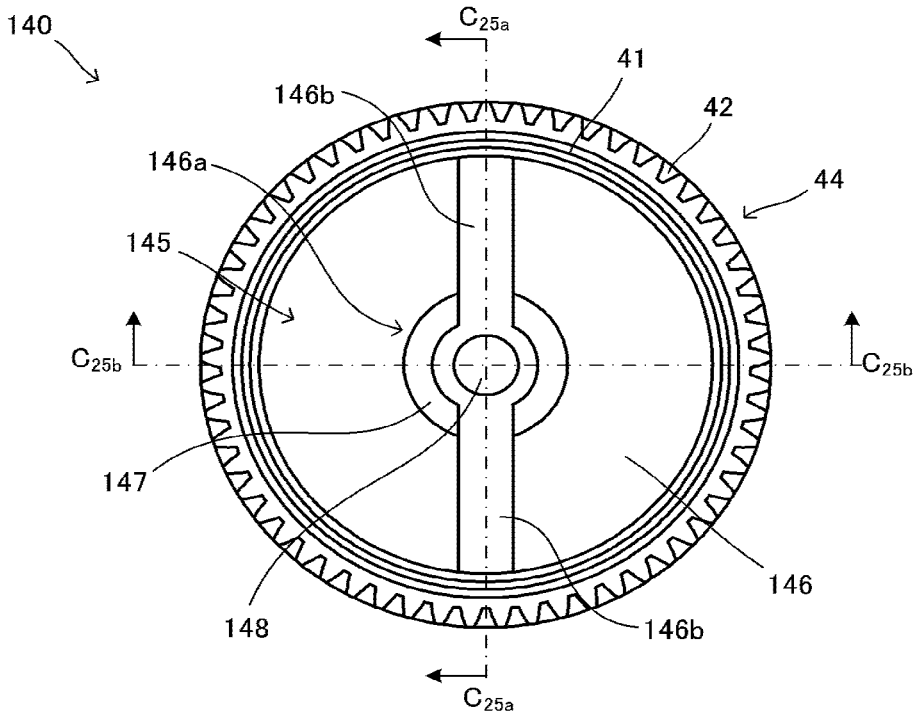
FIG. 24B is a plan view of the bearing member 140.
Figure 25A:
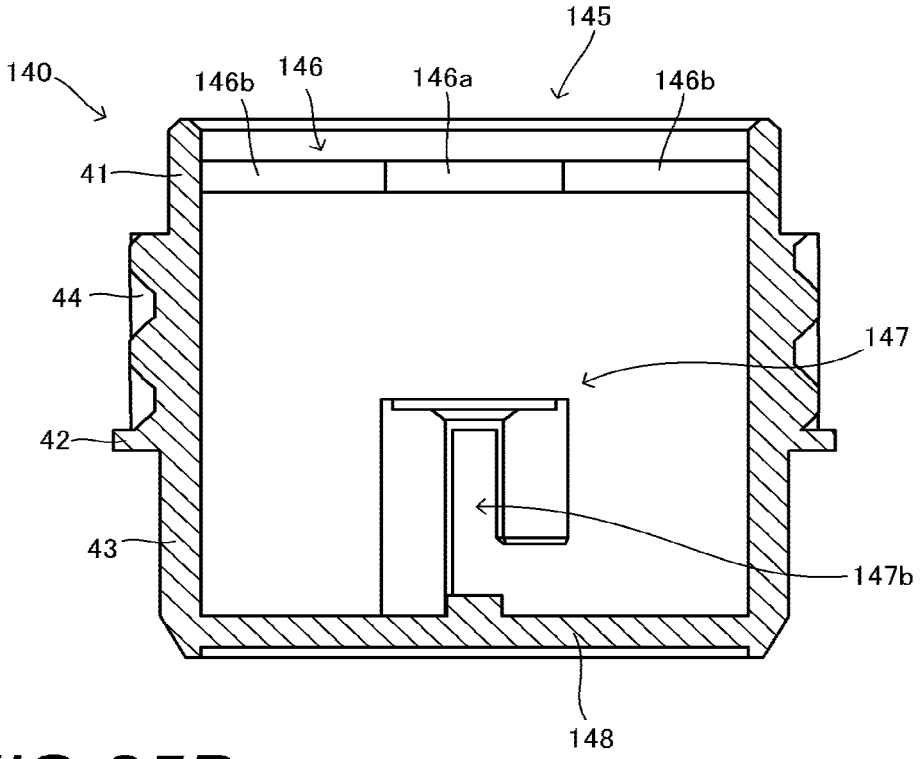
FIG. 25A is a cross-sectional view of the bearing member 140.
Figure 25B:
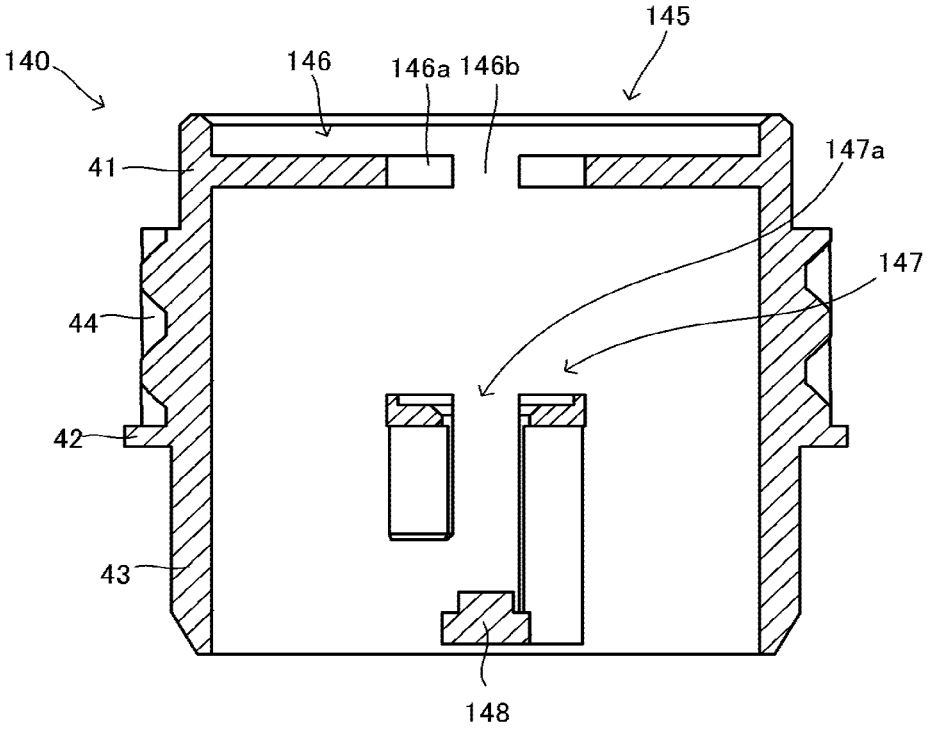
FIG. 25B is another cross-sectional view of the bearing member 140.

The bearing member 140 is a member which is bonded to the end of the photosensitive drum 11, in the end member 130. FIG. 24A shows a perspective view of the bearing member 140, and FIG. 24B shows a plan view seen from a side on which the shaft member 150 is inserted, in the bearing member 140. Moreover, FIG. 25A is a cross-sectional view taken along line $C_{25a}C_{25a}$ indicated in FIG. 24B, and FIG. 25B is a cross-sectional view taken along line $C_{25b}$-$C_{25b}$ indicated in FIG. 24B.

As seen in FIGS. 22 to 25B, the bearing member 140 is configured to include the tubular body 41, the contact wall 42, the fitting portion 43, the gear potion 44, and a shaft member holding portion 145.

The shaft member holding portion 145 is a portion which is formed inside the tubular body 41 and functions to cause the shaft member 150 to be held by the bearing member 140. As seen in FIGS. 24A to 25B, the shaft member holding portion 145 includes a turning shaft holding member 146, a turning shaft support member 147, and a regulation member holding member 148.

The turning shaft holding member 146 is a plate-like member which is formed so as to block the inside of the tubular body 41, and a hole 146*a* is formed coaxially with the axial line of the tubular body 41. A turning shaft 151 penetrates the hole 146*a* as described below. Therefore, the hole 146*a* has the size and the shape allowing the turning shaft 151 (refer to FIGS. 26A-26C) to penetrate. However, in order to prevent the turning shaft 151 from slipping out, the hole 146*a* is formed so as to allow only a body 152 of the turning shaft 151 to penetrate but not to allow portions in which outer projections 153 are arranged to penetrate. From a viewpoint of stable movement of the turning shaft 151, it is preferable that the hole 146*a* has substantially the same shape and size as those of the outer circumference of the body 152 of the turning shaft 151 within a range in which movement of the turning shaft 151 in the axial line direction is not significantly hindered.

In addition, in the turning shaft holding member 146, two slits 146*b* extend from the hole 146*a*. The two slits 146*b* are provided at positions symmetrical to each other interposing the axial line of the hole 146*a*. In addition, the size and the shape of the slit 146*b* is formed so as to allow the outer projections 153 of the turning shaft 151 (refer to FIGS. 26A and 26B) to penetrate the slit 146*b*.

The turning shaft support member 147 is a member which is provided on the fitting portion 43 side from the turning shaft holding member 146 and is formed so as to block at least a portion of the inside of the tubular body 41. The turning shaft support member 147 is provided with a hole 147*a* or an aperture through which a first regulation shaft 160 of a regulation member 159 (refer to FIGS. 27A and 27B) penetrates while being centered around the axial line of the tubular body 41 as shown in FIG. 25B. Moreover, the turning shaft support member 147 is formed so as to be able to hold at least the below-described elastic member 163 for a turning shaft.

In addition, as seen in FIG. 25A, the turning shaft support member 147 is provided with a groove 147*b* which extends parallel to the tubular body 41 in the axial line direction. In the groove 147*b*, an end on the turning shaft holding member 146 side is blocked, and the opposite side which is the regulation member holding member 148 side is open in a circumferential direction of the tubular body 41. The groove 147*b* is arranged so as to allow a projection 162 of the regulation member 159 (refer to FIGS. 27A and 27B) to move therein.

The regulation member holding member 148 is a member which is provided on the fitting portion 43 side farther than the turning shaft support member 147 and is formed so as to block at least a portion of the inside of the tubular body 41. The regulation member holding member 148 is formed to have a size in which at least a below-described elastic member 164 for a regulation member can be held.

Returning to FIGS. 22 and 23, the shaft member 150 in the end member 130 will be described. As seen in FIG. 23, the shaft member 150 includes the turning shaft 151, a rotary power reception member 155, the regulation member 159, the elastic member 163 for a turning shaft, and the elastic member 164 for a regulation member. In the present embodiment, both the elastic member 163 for a turning shaft and the elastic member 164 for a regulation member are helical springs.

Each of the aforementioned elements will be individually described below.

Figure 26A:
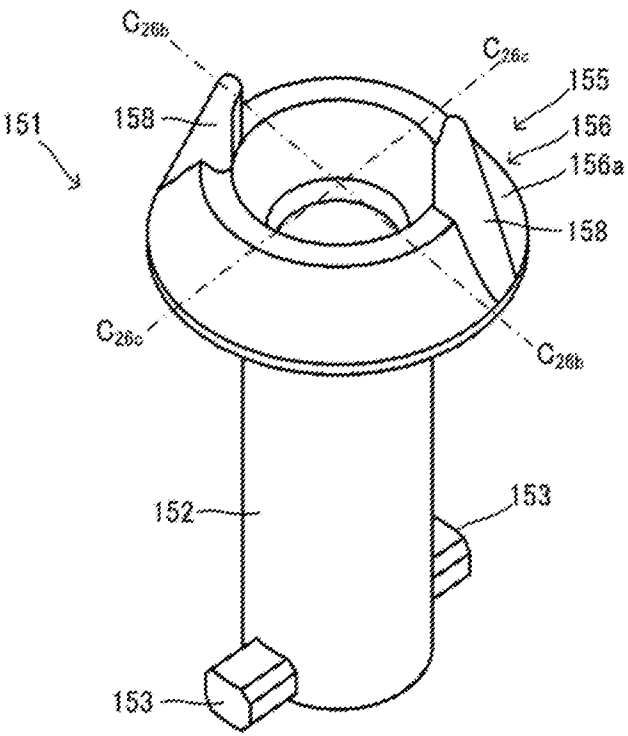
FIG. 26A is a perspective view of a turning shaft 151 and a rotary power reception member 155.
Figure 26B:
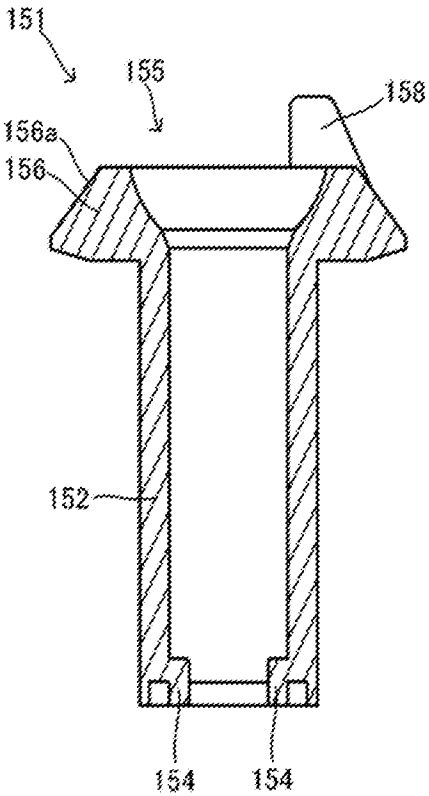
FIG. 26B is a cross-sectional view of the turning shaft 151 and the rotary power reception member 155.
Figure 26C:
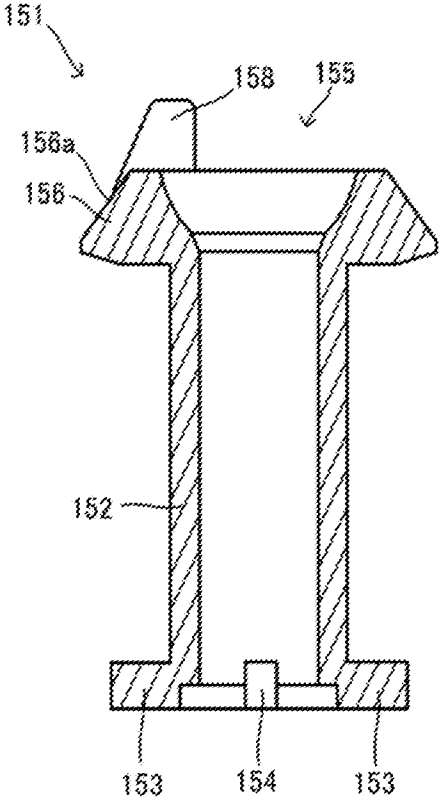
FIG. 26C is another cross-sectional view of the turning shaft 151 and the rotary power reception member 155.

Respectively, FIG. 26A illustrates a perspective view of the turning shaft 151, FIG. 26B illustrates a cross-sectional view in the axial line direction including line $C_{26b}$-$C_{26b}$ indicated in FIG. 26A, and FIG. 26C illustrates a cross-sectional view in the axial line direction including line $C_{26c}$-$C_{26c}$ indicated in FIG. 26A.

As seen in FIGS. 26A to 26C, the turning shaft 151 includes the cylindrical body 152.

Two outer projections 153 are arranged outside one end of the body 152. The two outer projections 153 are provided on the same straight line in one diameter direction of the cylinder of the body 152. As described below, the two outer projections 153 function to cause the body 152 to be held by the bearing member 140 and to regulate movement of the body 152.

In addition, the body 152 is provided with two inner projections 154 on the inner surface of the cylinder in the same end as the end in which the outer projections 153 are provided.

The rotary power reception member 155 is a member which receives a rotary drive force from the apparatus body 2 (refer to FIGS. 1 and 2) and transmits the drive force to the body 152 when the end member 30 is in a predetermined posture. As seen in FIGS. 26A to 26C, in the present embodiment, the rotary power reception member 155 is arranged at an end on the side opposite to the side where the outer projections 153 are arranged, in the body 152. The rotary power reception member 155 is configured to include two engagement members 158 which stand upright in a cylindrical base portion 156 and one end of the base portion 156.

The base portion 156 has a cylindrical shape, and both the outer diameter and the inner diameter thereof are formed to be greater than those of the body 152. The outer circumferential portion of the base portion 156 includes an inclination surface 156*a* which gradually decreases in diameter from the body 152 in the axial line direction. Accordingly, the drive shaft 70 can smoothly slide on the outer circumferential portion. Meanwhile, in contrast, the inner circumferential portion of the base portion 156 inclines so as to gradually increase in diameter from the body 152 in the axial line direction. Accordingly, the distal end of the drive shaft 70 can be stably stored.

The two engagement members 158 are provided at an end on the side opposite to the side where the turning shaft 151 of the base portion 156 is arranged, and are disposed away from the axial line of the base portion 156 by the same distance. Both the two engagement members 158 are arranged at positions symmetrical to each other interposing the axial line therebetween. The gap between the two engagement members 158 is formed to be substantially the same as or slightly greater than the diameter of the shaft portion 71 of the drive shaft 70 (refer to FIG. 18). The gap between the two engagement members 158 is configured to cause the rotary power transmission projection 72 to be caught in the engagement members 158 while the shaft portion 71 of the drive shaft 70 is in a posture of being arranged between the two engagement members 158.

Descriptions will be given later regarding how rotary power can be received from the drive shaft 70.

The regulation member 159 switches between a state where the engagement members 158 of the rotary power reception member 155 engage with the drive shaft 70 so as to be able to transmit a drive force to the bearing member 40 and a state where the engagement members 158 do not engage therewith so as not to be able to transmit a drive force and so as to be able to rotate freely. Respectively, FIG. 27A shows a perspective view of the regulation member 159, and FIG. 27B shows a perspective view of the regulation member 159 seen from another angle.

Figure 27A:
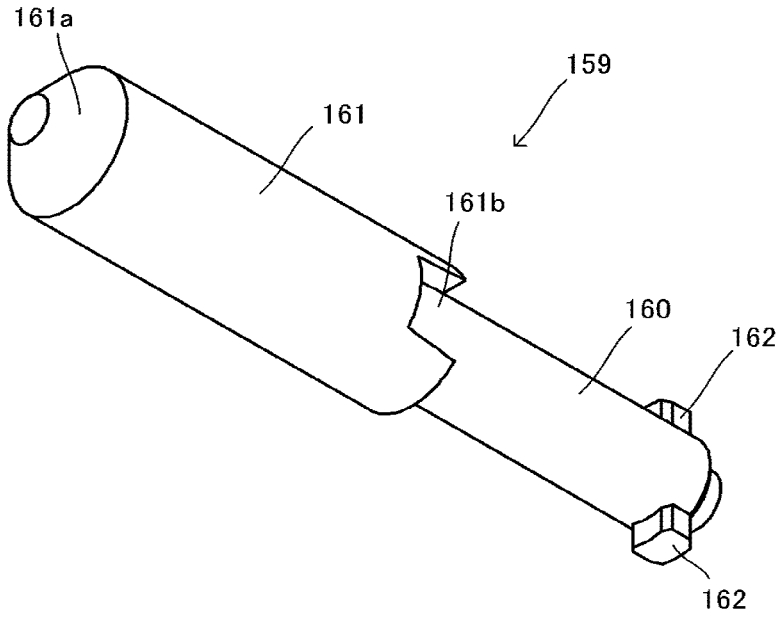
FIG. 27A is a perspective view of a regulation member 159.
Figure 27B:
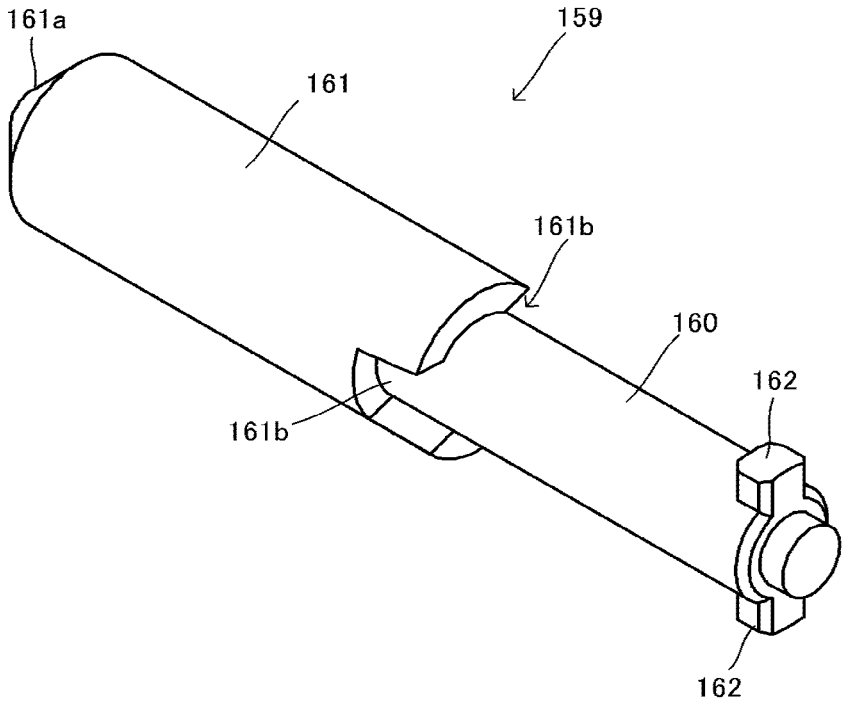
FIG. 27B is another perspective view of the regulation member 159.

As seen in FIGS. 27A and 27B, the regulation member 159 includes the columnar first regulation shaft 160 and a columnar second regulation shaft 161 which has the outer diameter greater than that of the first regulation shaft 160. The regulation member 159 has a structure in which the two regulation shafts 160 and 161 are coaxially arranged and are connected to each other at the ends.

In the first regulation shaft 160, two projections 162 are arranged at an end on the side opposite to the side where the second regulation shaft 161 is arranged. The two projections 162 are provided on the same straight line in one diameter direction of the column of the first regulation shaft 160. As described below, the two projections 162 function to cause the regulation member 159 to be held by the bearing member 140 and to regulate movement of the regulation member 159.

In the second regulation shaft 161, an end on the side opposite to the side where the first regulation shaft 160 is arranged becomes a contact portion 161*a*, and an inclination surface is formed. In addition, in the second regulation shaft 161, two grooves which are regulation grooves 161*b* open on the first regulation shaft 160 side are provided in the end where the first regulation shaft 160 is arranged. The two regulation grooves 161*b* are formed on sides opposite to each other interposing the axial line of the second regulation shaft 161 therebetween.

Figure 28:
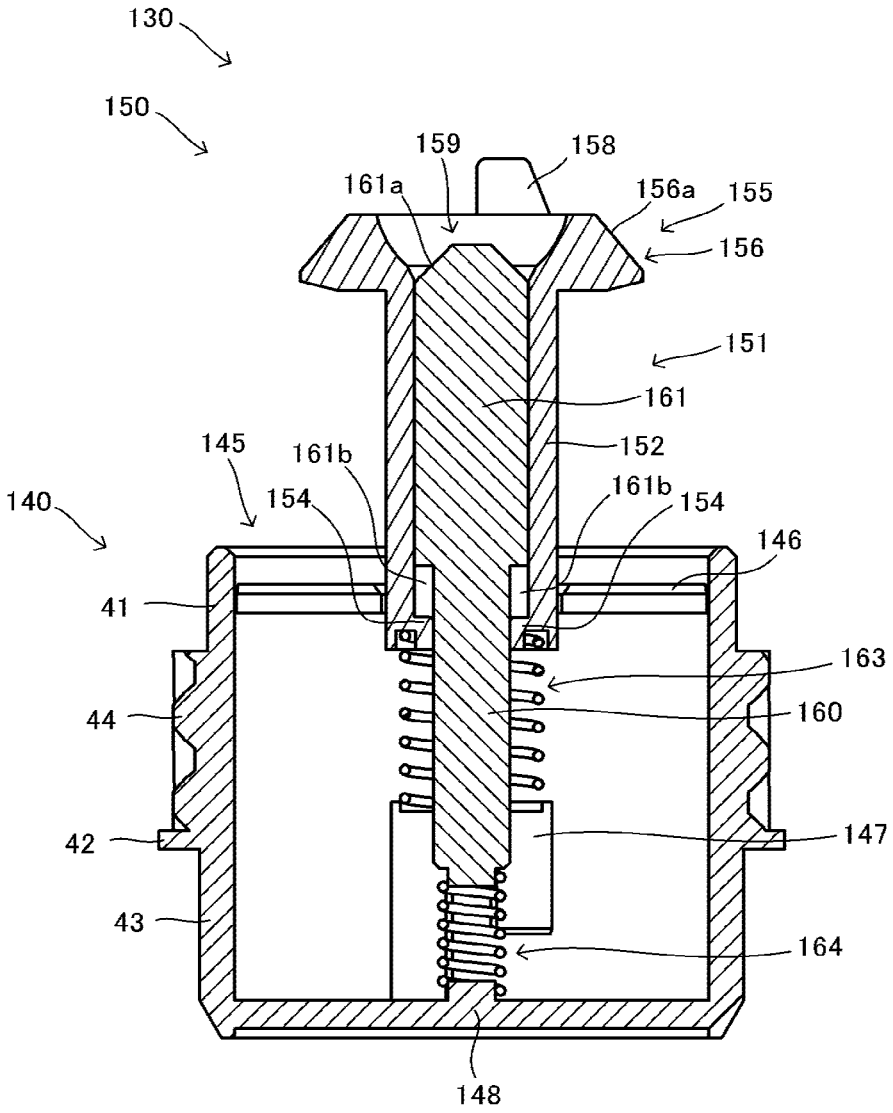
FIG. 28 is a cross-sectional view of the end member 130.

The bearing member 140 and the shaft member 150 configure the end member 130 by being assembled as follows. FIG. 28 shows a cross-sectional view along the axial line direction of the end member 130 in one posture. Through the descriptions regarding the assembly, it is possible to understand the size of each of the members and the portions, the structure, and the relationship between the sizes of the members and portions.

As seen in FIGS. 23 and 28, in the shaft member 150, the regulation member 159 is inserted into the body 152 of the turning shaft 151. In this case, the second regulation shaft 161 is stored inside the body 152, and the first regulation shaft 160 is arranged so as to cause the end on the projection 162 side to protrude from the side opposite to the rotary power reception member 155 (that is, the side of the outer projections 153 and the inner projection 154). Then, in the posture in FIG. 26, the inner projection 154 of the turning shaft 151 is arranged inside the regulation groove 161*b* of the regulation member 159.

The turning shaft 151 and the regulation member 159 assembled in such a manner are held by the bearing member 140 as follows. In other words, the turning shaft 151 passes through the hole 146*a* of the turning shaft holding member 146 of the bearing member 140. The turning shaft 151 is arranged so as to cause an end on the side where the outer projections 153 are arranged to be the inside of the shaft member holding portion 145 and to cause an end on the side opposite thereto to protrude from the bearing member 140. In this case, the outer projections 153 are configured to be caught in the turning shaft holding member 146 so as to prevent the turning shaft 151 from slipping out from the bearing member 140.

In addition, as seen in FIG. 28, the elastic member 163 for a turning shaft is arranged between the turning shaft 151 and the turning shaft support member 147, and the turning shaft 151 is urged in a direction of slipping out from the bearing member 140. In this case, the first regulation shaft 160 of the regulation member 159 passes through the inside of the elastic member 163 for a turning shaft.

When attaching the turning shaft 151 to the bearing member 140, the outer projections 153 of the turning shaft 151 may be inserted into the bearing member 140 from the slit 146*b* of the turning shaft holding member 146, and the turning shaft 151 may be caused to turn about the axial line.

Meanwhile, the first regulation shaft 160 of the regulation member 159 passes through the hole 147*a* (refer to FIG. 25B) of the turning shaft support member 147. Then, the projection 162 is stored inside the groove 147*b* (refer to FIG. 25A). Accordingly, the regulation member 159 is prevented from slipping out from the bearing member 140 while being able to move in the axial line direction.

In addition, as seen in FIG. 28, the elastic member 164 for a regulation member is arranged between the regulation member 159 and the regulation member holding member 148, and the regulation member 159 is urged in a direction of slipping out from the bearing member 140.

When attaching the regulation member 159 to the bearing member 140, the projection 162 of the regulation member 159 may be inserted into the slit 147*b* from an opening portion of a slit 147*b* of the turning shaft support member 147.

When the end member 130 is in a posture of being assembled in such a manner, the turning shaft 151 and the rotary power reception member 155 arranged in the turning shaft 151 are urged by the elastic member 163 for a turning shaft in a direction of slipping out from the bearing member 140, and the outer projections 153 engage with the shaft member holding portion 145 of the bearing member 140, thereby being held without slipping out therefrom. In addition, the turning shaft 151 and the rotary power reception member 155 can move in the axial line direction against an urging force of the elastic member 163 for a turning shaft and by an urging force.

Meanwhile, the regulation member 159 is urged in a direction of slipping out from the bearing member 140 by the elastic member 164 for a regulation member, and the projection 162 engages with the shaft member holding portion 145 of the bearing member 140, thereby being held without slipping out therefrom.

In the posture illustrated in FIG. 28, since the inner projection 154 of the turning shaft 151 is in the regulation groove 161*b* of the regulation member 159, the turning shaft 151 and the rotary power reception member 155 which is arranged in the turning shaft 151 are regulated from turning which is centered around the axial line.

By being assembled as described above, the axial line of each portion of the bearing member 140 and the shaft member 150 is arranged so as to coincide with each other.

Figure 29:
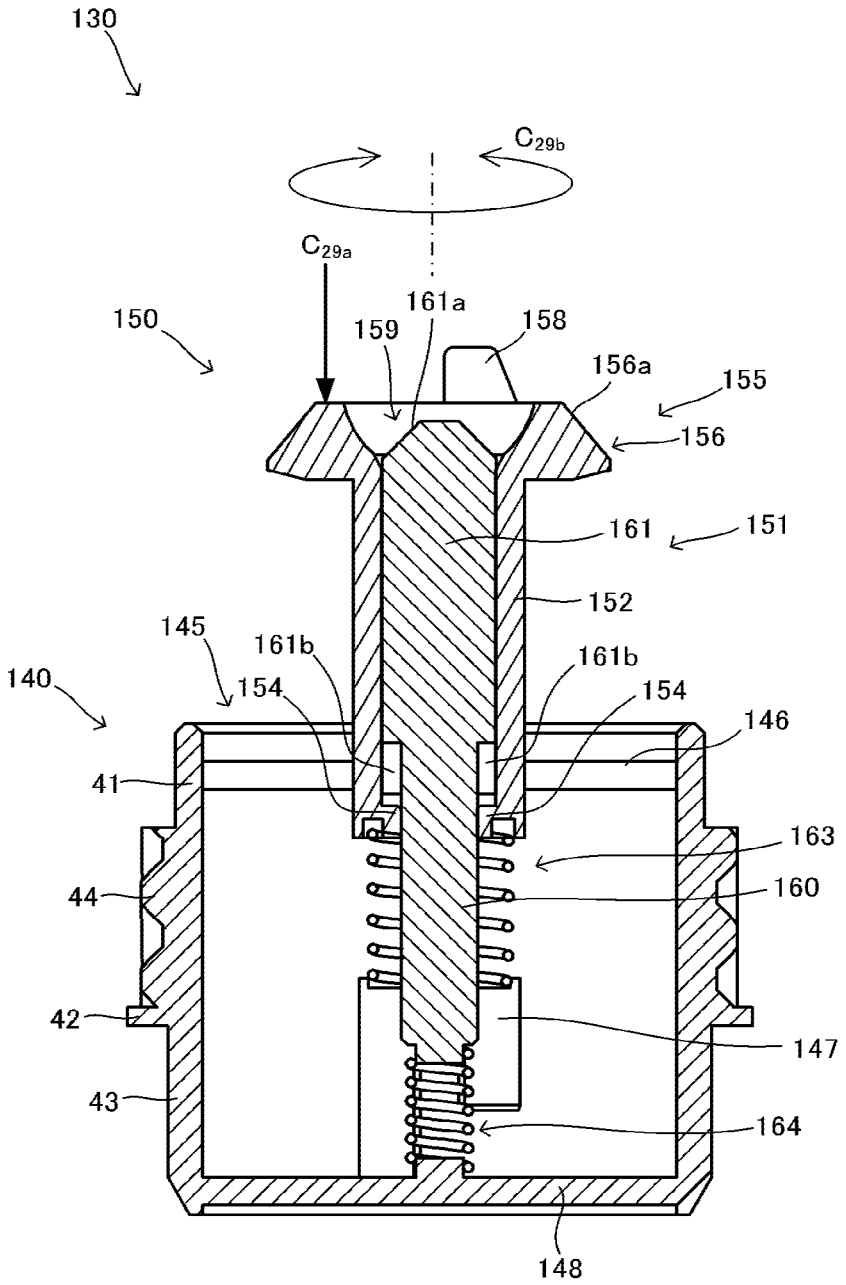
FIG. 29 is another cross-sectional view of the end member 130.
Figure 30:
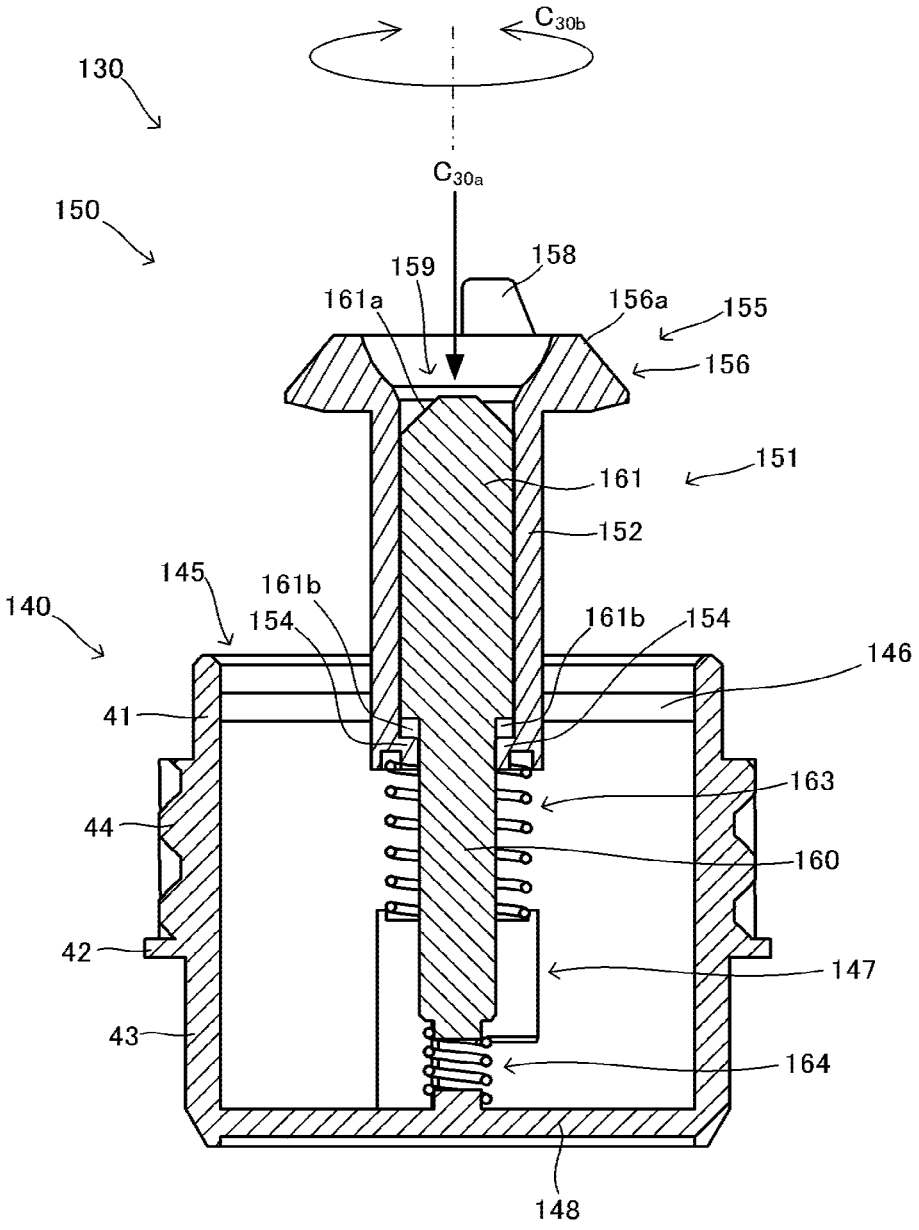
FIG. 30 is another cross-sectional view of the end member 130.

Subsequently, descriptions will be given regarding how the end member 130 which is assembled as described above can be deformed, moved, and turned. FIGS. 29 and 30 show cross-sectional views of the end member 130 in two different postures seen in the direction along the axial line.

FIG. 29 shows the turning shaft 151 (the rotary power reception member 155) which is shifted from the posture illustrated in FIG. 28 to a posture of being thrust toward the bearing member 140 side against an urging force of the elastic member 163 for a turning shaft, as indicated by Arrow $C_{29a}$ in FIG. 29. Accordingly, as seen in FIG. 29, since the turning shaft 151 moves in the axial line direction, the inner projection 154 of the turning shaft 151 is detached from the regulation groove 161*b* of the regulation member 159, and thus, both are disengaged from each other. Therefore, as indicated by Arrow $C_{29b}$ in FIG. 29, the turning shaft 151 and the rotary power reception member 155 (the engagement members 158) which is arranged in the turning shaft 151 rotate freely. In other words, in the posture, the engagement members 158 are not regulated from turning relatively to the bearing member 140 and the regulation member 159, thereby being unrestricted.

FIG. 30 shows the regulation member 159 which is shifted from the posture illustrated in FIG. 29 to a posture of being thrust toward the bearing member 140 side against an urging force of the elastic member 164 for a regulation member, as indicated by Arrow $C_{30a}$ in FIG. 30. Accordingly, as seen in FIG. 30, since the regulation member 159 moves in the axial line direction, the inner projection 154 of the turning shaft 151 reenters the inside of the regulation groove 161*b* of the regulation member 159, and thus, both engage with each other. Therefore, in the posture, the engagement members 158 are regulated from turning relatively to the bearing member 140 and the regulation member 159. For example, when rotary power is applied to the rotary power reception member 155 as indicated by Arrow $C_{30b}$, the rotary power is transmitted to the turning shaft 151, the regulation member 159, and the bearing member 140. Then, eventually, the end member 130 (the photosensitive drum unit) turns while being centered around the axial line.

Figure 31:
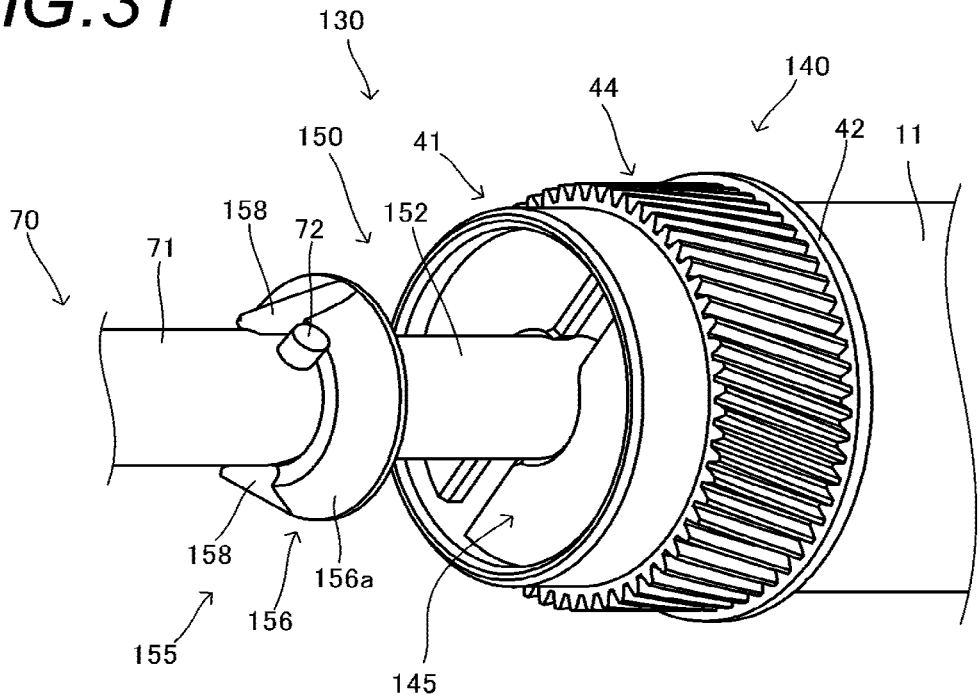
FIG. 31 is a perspective view of an instance in which the drive shaft 70 and the end member 130 engage with each other.

In a posture in which the process cartridge 3 furnished with the above-described end member 130 is mounted in the apparatus body 2, the drive shaft 70 engages with the rotary power reception member 155 which is furnished in the shaft member 150 of the end member 130, thereby transmitting rotary power. FIG. 31 illustrates an instance in which the rotary power reception member 155 of the end member 130 engages with the drive shaft 70.

As seen in FIG. 31, in the posture in which the drive shaft 70 and the rotary power reception member 155 engage with each other, the axial line of the drive shaft 70 and the axial line of the shaft member 150 are arranged so as to coincide with and abut against each other. In this case, the distal end of the shaft portion 71 of the drive shaft 70 enters between the two engagement members 158 of the rotary power reception member 155, and the rotary power transmission projections 72 of the drive shaft 70 respectively engage with the engagement members 158 from the side surfaces so as to be caught therein. Then, in this case, the distal end of the shaft portion 71 of the shaft member 70 presses the rotary power reception member 155 and the regulation member 159, and thus, the end member 130 is in the posture illustrated in FIG. 30. Accordingly, when the drive shaft 70 rotates, the rotary power reception member 155 rotates following thereafter. Then, the end member 130 and the photosensitive drum 11, that is, the photosensitive drum unit 10 rotates.

Figure 32A:
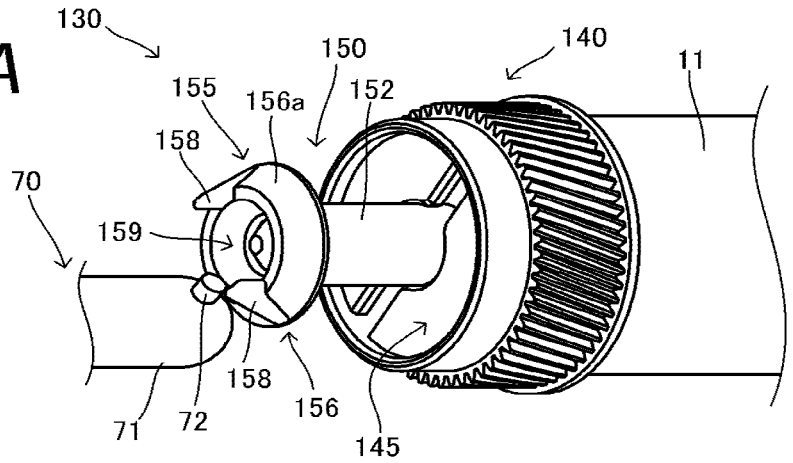
FIG. 32A is a perspective view illustrating an instance in which the drive shaft 70 and the photosensitive drum unit engage with each other.
Figure 32B:
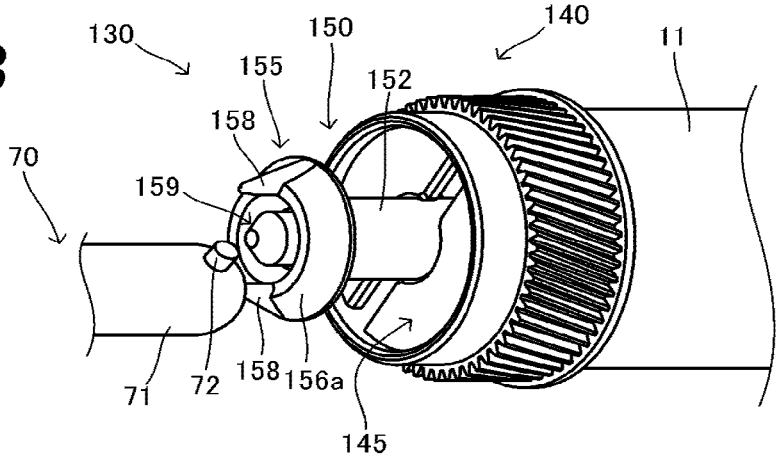
FIG. 32B is a perspective view illustrating another instance in which the drive shaft 70 and the photosensitive drum unit engage with each other.
Figure 32C:
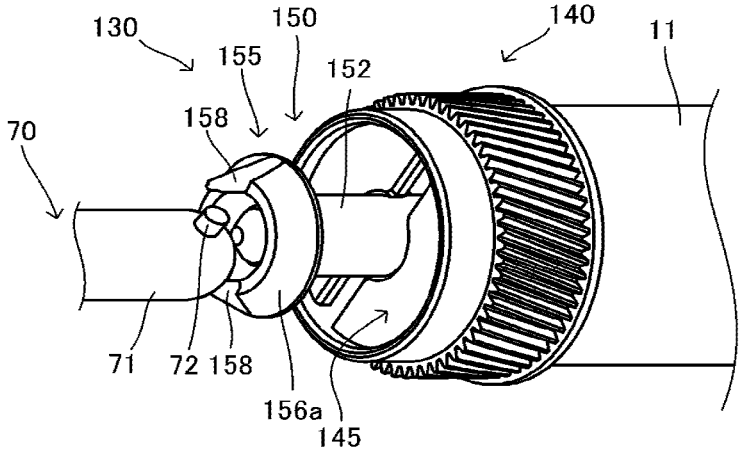
FIG. 32C is a perspective view illustrating another instance in which the drive shaft 70 and the photosensitive drum unit engage with each other.

Subsequently, descriptions will be given regarding another example of the operation of the drive shaft 70 when in the posture of FIG. 31 by mounting the process cartridge 3 in the apparatus body 2, and the photosensitive drum unit 10. FIGS. 32A-32C are explanatory diagrams. FIGS. 32A-

32C are perspective views showing a process in which the drive shaft 70 engages with the rotary power reception member 155, in the order of those in FIGS. 32A to 32C.

First, from the state illustrated in FIG. 32A, the photosensitive drum unit 10 approaches in the direction orthogonal to the axial line direction of the drive shaft 70 as illustrated in FIG. 32B. In this case, the end member 130 of the photosensitive drum unit is oriented toward the drive shaft 70 side so as to cause the axial line thereof to be oriented parallel to the axial line of the drive shaft 70, thereby approaching the drive shaft 70 while moving in the direction orthogonal to the axial line. In this case, the shaft member 150 is in the posture illustrated in FIG. 28.

In the instance illustrated in FIG. 32B, the distal end of the drive shaft 70 comes into contact with the inclination surface 156*a* in the base portion 156 of the rotary power reception member 155. Then, the drive shaft 70 presses the rotary power reception member 155 and the shaft member 150 toward the bearing member 140 side. Accordingly, the rotary power reception member 155 and the shaft member 150 move in the axial line direction, and thus, the end member 130 is in the posture illustrated in FIG. 29. In the posture, the rotary power reception member 155 and the shaft member 150 turn freely. Therefore, even though the drive shaft 70 comes into contact with the engagement members 158 of the rotary power reception member 155, the rotary power reception member 155 rotates freely. Therefore, the drive shaft 70 presses and rotates the rotary power reception member 155. Accordingly, the drive shaft 70 can enter between the two engagement members 158 as illustrated in FIG. 32C, without being hindered by the engagement members 158 of the rotary power reception member 155.

As illustrated in FIG. 32C, when the drive shaft 70 enters between the two engagement members 158, the distal end of the drive shaft 70 presses the regulation member 159. Here, since the distal end of the regulation member 159 is configured to include an inclination surface at the contact portion 161*a*, the entering is smoothly performed. In this manner, eventually, being in the posture illustrated in FIG. 31 (the posture illustrated in FIG. 30), a rotary drive force from the drive shaft 70 can be transmitted to the photosensitive drum 11.

As described above, by using the end member 130 as well, without requiring oscillation of the shaft member 150, it is possible to more smoothly perform attachment and detachment of the drive shaft 70 with respect to the shaft member 150 on account of turning in the axial line direction and movement in the direction orthogonal to the axial line direction. Then, since a common difference in measurement can be sufficiently set with respect to a shaft member 150 which requires oscillation, productivity is considered to be high from the viewpoint thereof.

In addition, since the engagement members 158 can switch between the non-engagement state with respect to the drive shaft 70 and the engagement state with respect to the drive shaft 70 as necessary by using the regulation member 159, hindrance to attachment and detachment caused by a member is unlikely to occur during attachment and detachment of a process cartridge 3, and thus, attachment and detachment is performed more smoothly.

Figure 33A:
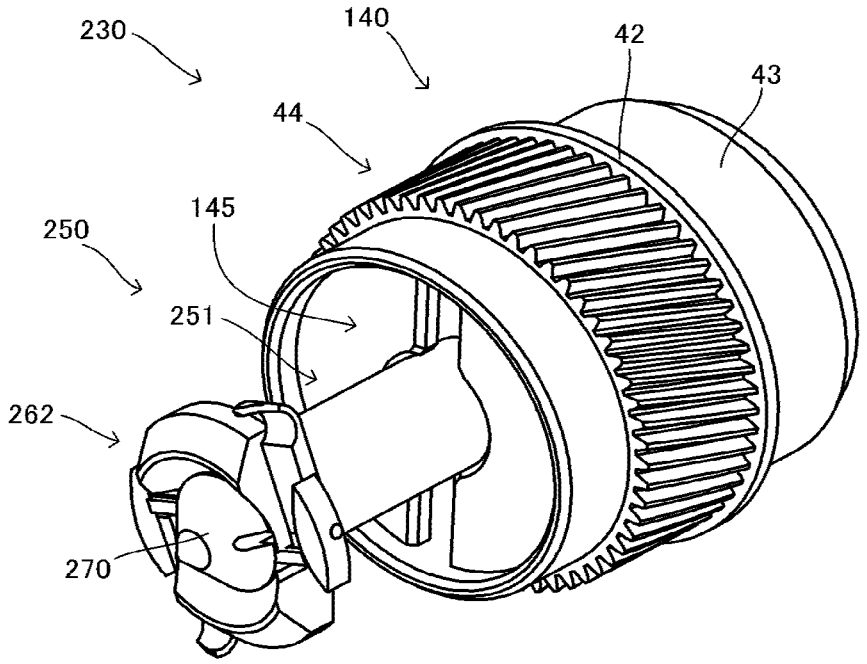
FIG. 33A is a perspective view of an end member 230.
Figure 33B:
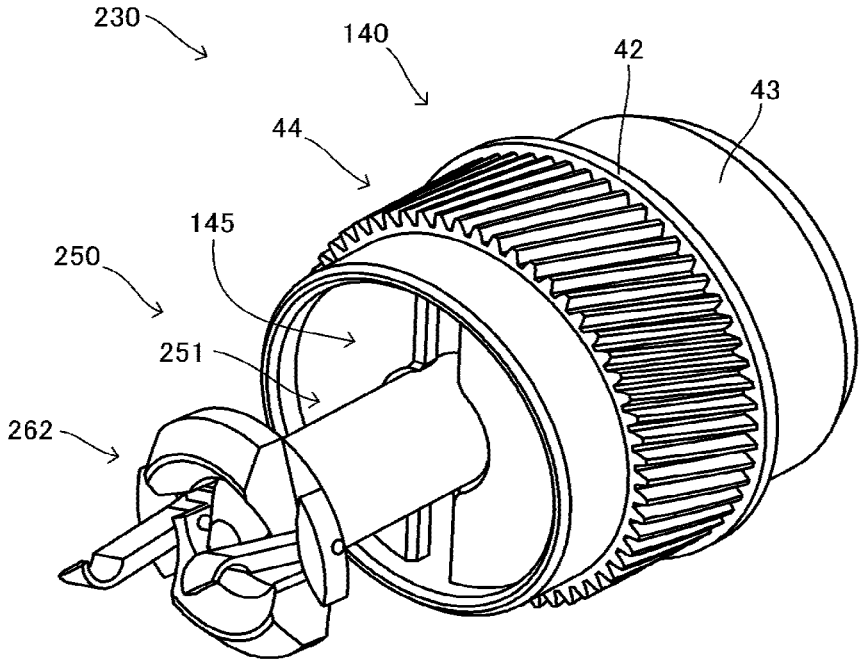
FIG. 33B is another perspective view of the end member 230.
Figure 34:
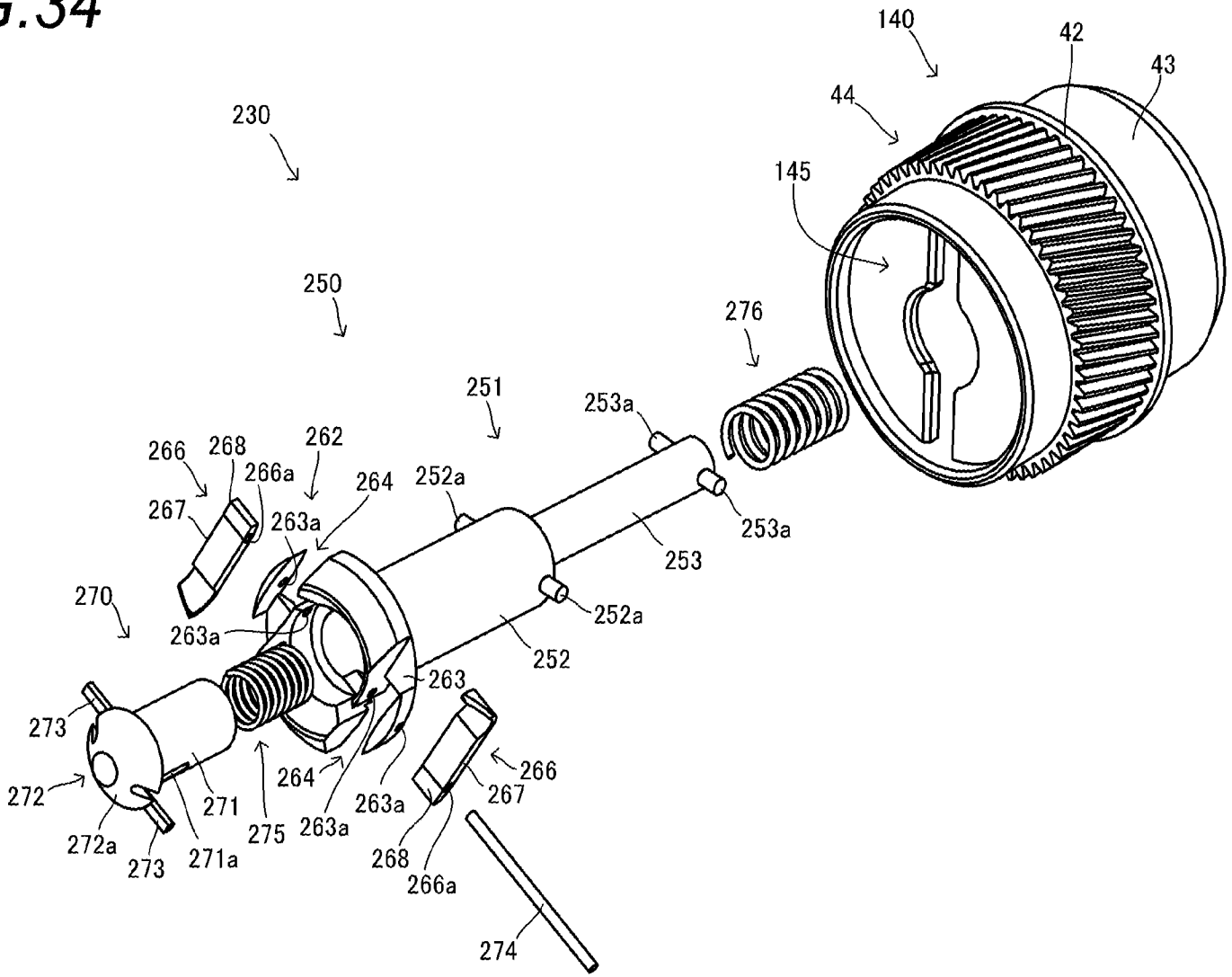
FIG. 34 is an exploded perspective view of the end member 230.

Subsequently, a third embodiment will be described. FIG. 33A is a perspective view of one posture of an end member 230 in the third embodiment, and FIG. 33B is a perspective view of another posture of the end member 230. In addition, FIG. 34 shows an exploded perspective view of the end member 230. In the third embodiment, the elements other than the end member 230 are the same as those in the first embodiment. Therefore, the descriptions thereof will be omitted. In addition, regarding the end member 230 as well, the same reference numerals and signs are applied to the same portions in the end member 30, thereby omitting the descriptions.

The end member 230 is a member which is attached to an end on the side opposite to the lid member 20, between the ends of the photosensitive drum 11 and includes the bearing member 140 and a shaft member 250. Here, since a bearing member 140 having the same configuration as the above-described bearing member 140 can be applied, the same reference numeral is applied thereto, and the descriptions thereof will be omitted.

Figure 35:
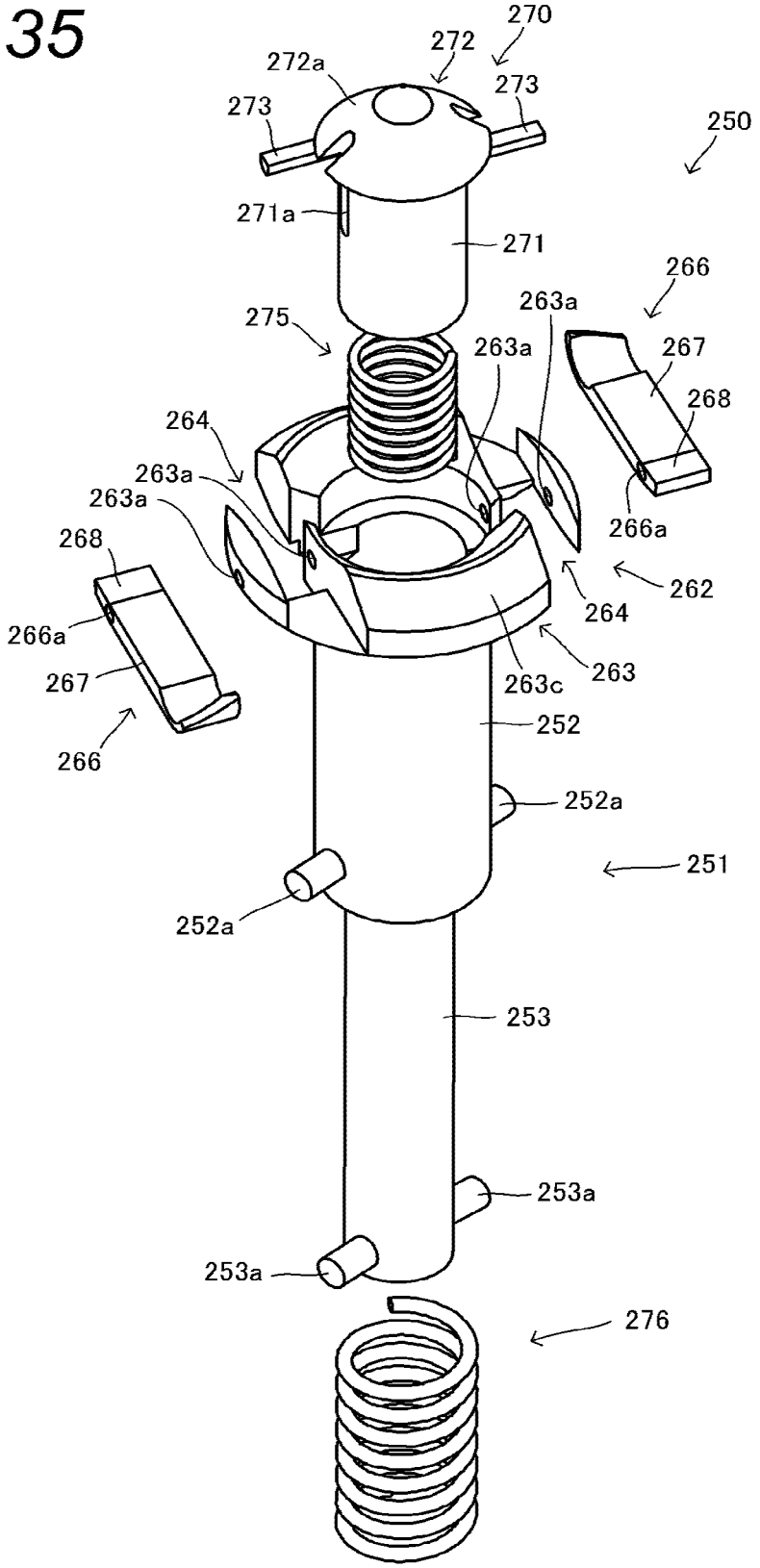
FIG. 35 is an exploded perspective view of a shaft member 250.

As seen in FIG. 35, the shaft member 250 is configured to include a turning shaft 251, a rotary power reception member 262, a regulation member 270, pins 274, an elastic member 275 for a regulation member, and an elastic member 276 for a turning shaft. Here, the pins 274 are rod-like members. In addition, in the present embodiment, the elastic member 275 for a regulation member and the elastic member 276 for a turning shaft are helical springs.

FIG. 35 shows an exploded perspective view in which the members other than the pins 274 are enlarged. Each of the members will be described with reference to FIGS. 34 and 35.

The turning shaft 251 is a member which transmits rotary power from the rotary power reception member 262 to the bearing member 140. As seen in FIGS. 34 and 35, the turning shaft 251 includes a cylindrical first turning shaft 252 and a columnar second turning shaft 253 which has the outer diameter smaller than that of the first turning shaft 252. The turning shaft 251 has a structure in which the two turning shafts 252 and 253 are coaxially arranged and are connected to each other at the ends. In the first turning shaft 252, two projections 252*a* are arranged on a side surface at an end on the side connected to the second turning shaft 253. The two projections 252*a* are provided on the same straight line in one diameter direction of the cylinder of the first turning shaft 252. The two projections 252*a* function similarly to the above-described outer projections 153 (for example, refer to FIG. 26A).

In addition, in the second turning shaft 253, two projections 253*a* are arranged on a side surface at an end on the side opposite to the side connected to the first turning shaft 252. The two projections 253*a* are provided on the same straight line in one diameter direction of the column of the second turning shaft 253. The two projections 253*a* function similarly to the above-described projections 162 of the regulation member 159 (for example, refer to FIG. 27A).

The rotary power reception member 262 is a member which receives a rotary drive force from the apparatus body 2 (refer to FIG. 1) and transmits the drive force to the turning shaft 251 when the end member 230 is in a predetermined posture. In the present embodiment, the rotary power reception member 262 is configured to be arranged at an end on the side opposite to the second turning shaft 253 in the first turning shaft 252 of the turning shaft 251 and to include a cylindrical base portion 263 and plate-like engagement members 266.

The base portion 263 is a cylindrical member and is arranged coaxially with an end on one side in the first turning shaft 252 of the turning shaft 251. Both the outer circumference and the inner circumference of the base portion 263 are formed to be greater than the outer circumference and the inner circumference of the first turning shaft 252 of the turning shaft 251. In addition, the outer circumferential portion of the base portion 263 includes the inclination surface 263*c* which gradually decreases in diameter as the distance from the first turning shaft 252 increases.

The base portion 263 is provided with two engagement member storage grooves 264 which are grooves formed to be substantially parallel to each other interposing the axial line therebetween. In the present embodiment, the two engagement member storage grooves 264 are provided to be parallel at positions in the same distance from the axial line interposing the axial line therebetween and extend so as to be in torsional positions with respect to the axial line.

In addition, the base portion 263 is provided with holes 263*a* which are provided along the diameter of the base portion 263 so as to penetrate in a direction orthogonal to the extending direction of the two engagement member storage grooves 264. In the present embodiment, four holes 263*a* are formed.

The engagement member 266 has a plate shape in its entirety and is formed to have a size which allows for storage in the groove, that is, the above-described engagement member 266 storage groove 264. The engagement member is provided with a penetration hole 266*a*. Interposing the penetration hole 266*a*, one side becomes an engagement portion 267, and the other side becomes an operated portion 268. Without being particularly limited, it is preferable that the engagement portion 267 is longer than the operated portion 268. In addition, the distal end of the engagement portion 267 may be curved. Accordingly, the engagement portion 267 can stably engage with the rotary power transmission projection 72 of the drive shaft 70.

The regulation member 270 is configured to include a regulation shaft 271, a contact portion 272, and operation portions 273.

The regulation shaft 271 is a columnar member, and the outer shape has a size which can be inserted into the cylinder of the first turning shaft 252. In addition, a slit 271*a* is formed in the regulation shaft 271 so as to penetrate in the diameter direction and to extend in a predetermined size in the axial line direction.

The contact portion 272 is a member which is a portion of a cone (a truncated cone) provided coaxially with a side that is not inserted into the first turning shaft 252, in the end surface of the regulation shaft 271. The bottom has a diameter greater than that of the regulation shaft 271. Therefore, the side surface of the contact portion 272 forms an inclination surface 272*a*.

The operation portions 273 are rod-like members which extend in directions of being disposed away from the axial line. Similar to the engagement members 266, two operation portions 273 are arranged. As described below, the operation portions 273 are formed in positions and sizes so as to be able to respectively press the operated portions 268 of the engagement members 266 in a direction parallel to the axial line direction.

Each of the above-described members is assembled as follows, thereby configuring the end member 230. Through the descriptions regarding the assembly, it is possible to understand the size of each of the members and the portions, the structure, and the relationship between the sizes of the members and portions.

Figure 36:
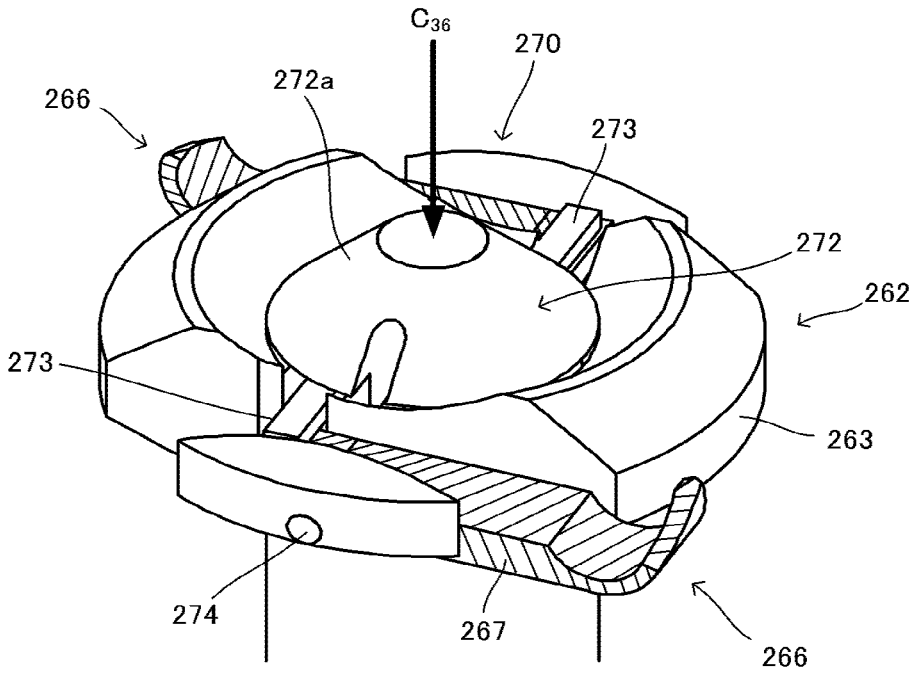
FIG. 36 is a partially enlarged perspective view of the shaft member 250.
Figure 37:
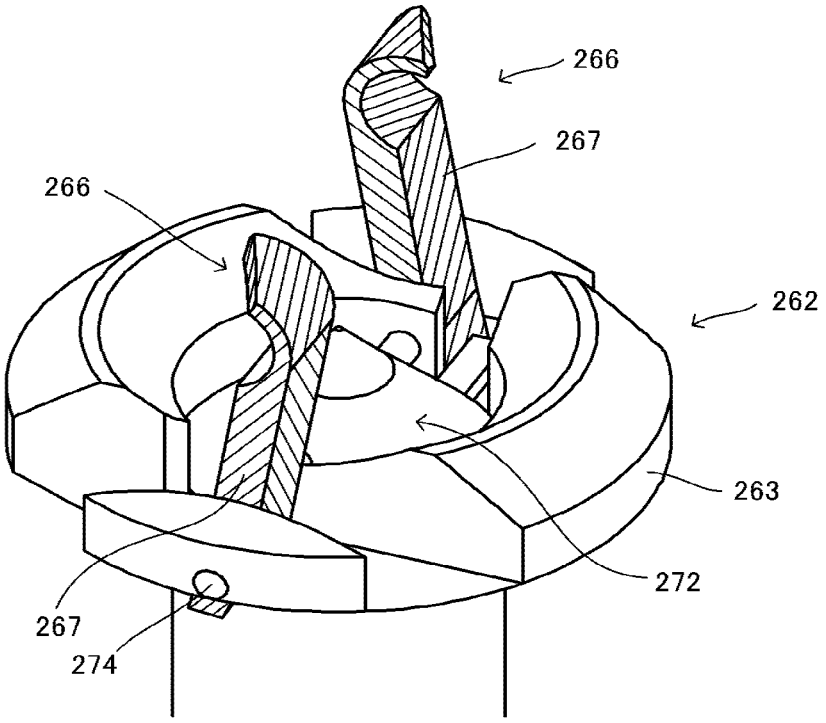
FIG. 37 is a partially enlarged perspective view of the shaft member 250.

First, the shaft member 250 will be described. FIG. 36 is a perspective view of the appearance illustrating an enlarged portion of the rotary power reception member 262 and the regulation member 270 in one posture in an instance in which each of the members is assembled. In FIG. 36, and FIG. 37 which is referenced later, hatching is performed in only the engagement members 266 so as to be easily recognized.

As seen in FIGS. 33A to 36, the elastic member 275 for a regulation member is inserted into the cylinder of the first turning shaft 252 of the turning shaft 251. Moreover, the end on the side where the contact portion 272 is not arranged, in the regulation shaft 271 of the regulation member 270 is also inserted into the cylinder. Accordingly, the regulation member 270 is urged in a direction of slipping out from the turning shaft 251, by an urging force of the elastic member 275 for a regulation member.

Meanwhile, the engagement members 266 are arranged inside the engagement member storage groove 264 which is provided in the base portion 263 of the rotary power reception member 262. In this case, the holes 263*a* provided in the base portion 263 and the holes 266*a* provided in the engagement members 266 are aligned in a straight line. In addition, the straight line is arranged to include the slit 271*a* which is furnished in the regulation shaft 271 of the regulation member 270. Then, the pins 274 are respectively inserted so as to pass through the holes 263*a*, the holes 266*a*, and the slit 271*a* which are aligned in a straight line in this manner. Accordingly, the posture illustrated in FIG. 36 can be realized.

In this case, the operation portions 273 of the regulation member 270 are arranged so as to overlap the operated portions 268 which are formed in the engagement members 266 of the rotary power reception member 262.

In addition, attachment of the shaft member 250 with respect to the bearing member 140 can be performed in accordance with the above-described example of the end member 130 (for example, also refer to FIG. 28). In this case, the two projections 252*a* of the first turning shaft 252 are arranged similarly to the above-described outer projections 153 (for example, refer to FIG. 26A), the two projections 253*a* of the second turning shaft 253 are arranged similarly to the above-described projections 162 of the regulation member 159 (for example, refer to FIG. 27A), and the elastic member 276 for a turning shaft is arranged similarly to the elastic member 164 for a regulation member.

In the end member 230 which is assembled in such a manner, the turning shaft 251 and a rotary power reception member 255 arranged in the turning shaft 251 are urged by the elastic member 276 for a turning shaft in a direction of slipping out from the bearing member 140, and the projections 252*a* engage with the shaft member holding portion 145 of the bearing member 140, thereby being held without slipping out therefrom. In addition, the turning shaft 251 and the rotary power reception member 262 can move in the axial line direction against an urging force of the elastic member 276 for a turning shaft and by an urging force.

By being assembled as described above, the axial line of each portion of the bearing member 140 and the shaft member 250 is arranged so as to coincide with each other.

The end member 230 assembled in the above-described manner can be realized in a posture in the embodiment illustrated in FIG. 36. In other words, in the posture, the engagement members 266 are arranged so as to be laid along the inside of the engagement member storage groove 264.

In contrast, as indicated by $C_{36}$ in FIG. 36, when the regulation member 270 is pressed toward the bearing member 140 side (downward of the sheet surface of FIG. 36), the operation portions 273 also move downward, thereby moving the operated portions 268 of the engagement members 266 downward. Then, the engagement members 266 respectively turn while being centered around the pins 274. Accordingly, as illustrated in FIG. 37, the engagement members 266 rise up so as to approach in the axial line direction in a parallel manner.

In other words, the end member 230 can switch between a posture in which the engagement members 266 stand upright (a protruding posture) and a posture in which the engagement members 266 lay down (a laid posture).

Figure 38:
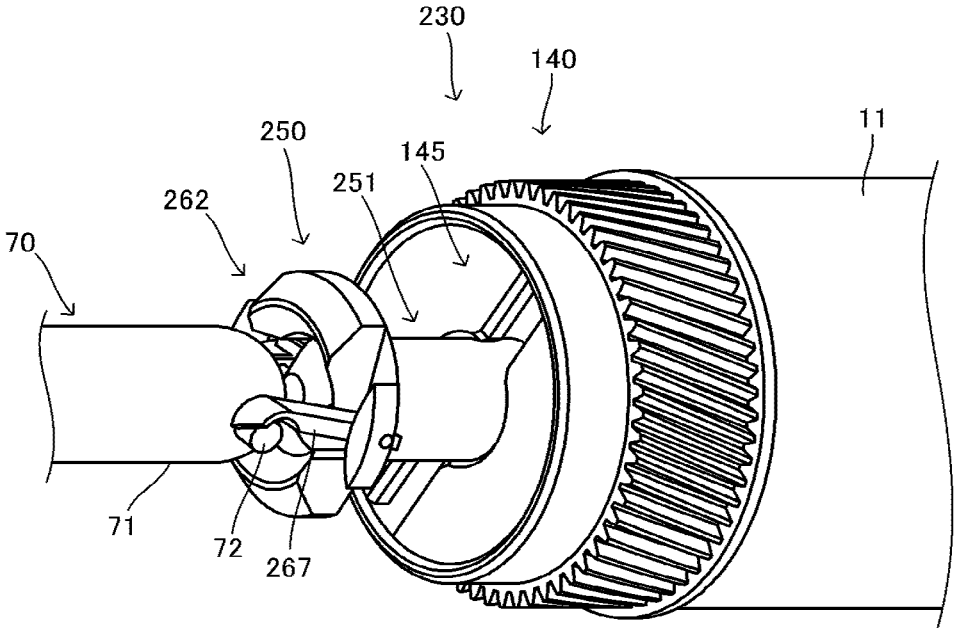
FIG. 38 is a perspective view of an instance in which the drive shaft 70 and the end member 230 engage with each other.

In a posture in which the process cartridge 3 furnished with the above-described end member 230 is mounted in the apparatus body 2, the drive shaft 70 engages with the rotary power reception member 262 which is furnished in the shaft member 250 of the end member 230, thereby transmitting rotary power. FIG. 38 illustrates an instance in which the rotary power reception member 262 of the end member 230 engages with the drive shaft 70.

As seen in FIG. 38, in the posture in which the drive shaft 70 and the rotary power reception member 262 engage with each other, the axial line of the drive shaft 70 and the axial line of the shaft member 250 are arranged so as to coincide with and abut against each other. In this case, the distal end of the shaft portion 71 of the drive shaft 70 enters between the two engagement members 266 of the rotary power reception member 262, and the rotary power transmission projections 72 of the drive shaft 70 respectively engage with the engagement members 266 from the side surfaces so as to be caught therein.

In other words, in this case, the distal end of the shaft portion 71 of the drive shaft 70 presses the contact portion 272 of the regulation member 270, and thus, the end member 230 is in the posture in which the engagement members 266 stand upright as illustrated in FIG. 37. Accordingly, when the drive shaft 70 rotates, the rotary power reception member 262 rotates following thereafter. Then, the end member 230 and the photosensitive drum 11, that is, the photosensitive drum unit 10 rotates.

Figure 39A:
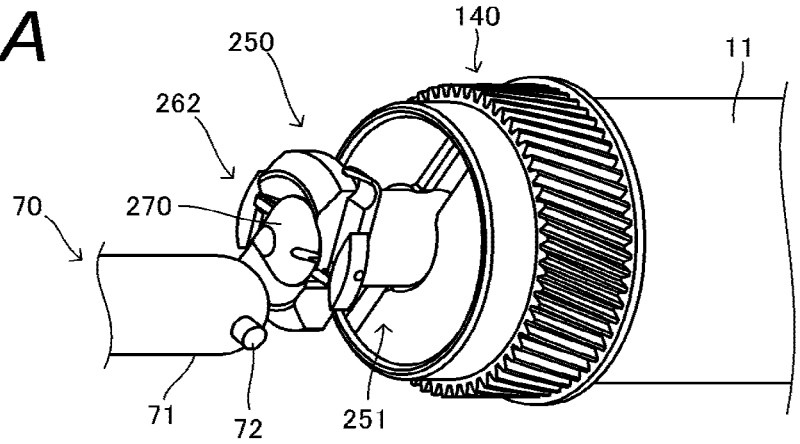
FIG. 39A is a perspective view of an instance in which the drive shaft 70 and the photosensitive drum unit engage with each other.
Figure 39B:
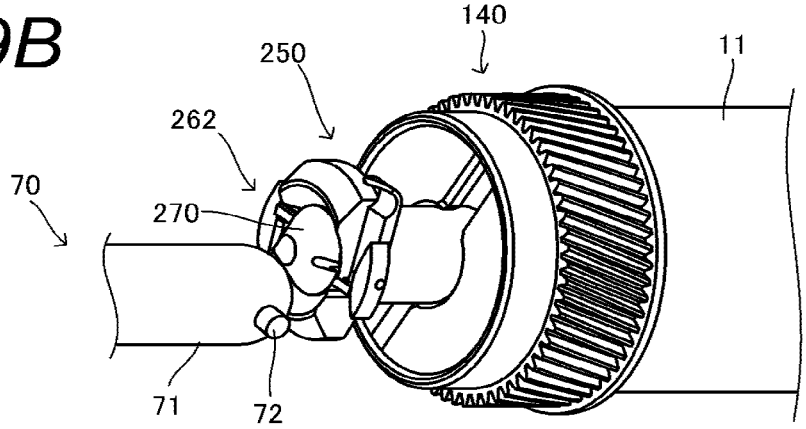
FIG. 39B is a perspective view of another instance in which the drive shaft 70 and the photosensitive drum unit engage with each other.
Figure 39C:
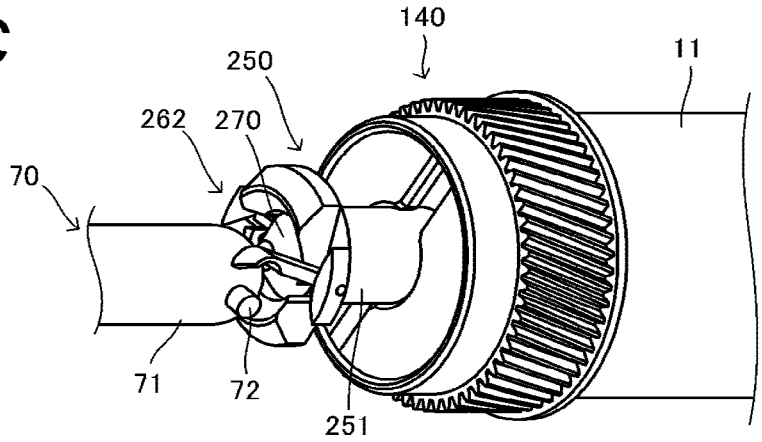
FIG. 39C is a perspective view of another instance in which the drive shaft 70 and the photosensitive drum unit engage with each other.

Subsequently, descriptions will be given regarding another example of the operation of the drive shaft 70 when being in the posture of FIG. 38 by mounting the process cartridge 3 in the apparatus body 2, and the photosensitive drum unit 10. FIGS. 39A-39C are explanatory diagrams. FIGS. 39A-39C are perspective views showing a process in which the drive shaft 70 engages with the rotary power reception member 262, in the order of those in FIGS. 39A to 39C.

First, from the state illustrated in FIG. 39A, the photosensitive drum unit 10 approaches in the direction orthogonal to the axial line direction of the drive shaft 70 as illustrated in FIG. 39B. In this case, the end member 230 of the photosensitive drum unit 10 is oriented toward the drive shaft 70 side so as to cause the axial line thereof to be oriented parallel to the axial line of the drive shaft 70, thereby approaching the drive shaft 70 while moving in the direction orthogonal to the axial line. In this case, the shaft member 250 is in the posture illustrated in FIG. 36.

In the instance illustrated in FIG. 39B, the distal end of the drive shaft 70 comes into contact with the base portion 263 of the rotary power reception member 262. However, in this state, the engagement members 266 of the shaft member 250 are in the postures illustrated in FIG. 36, being laid down. Therefore, the drive shaft 70 can enter between the two engagement members 266 as illustrated in FIG. 39C without being hindered by the engagement members 266 of the rotary power reception member 262. In this case, the drive shaft 70 moves so as to slide on an inclination surface 263*c* of the base portion 263. Therefore, the turning shaft 251 is pressed in the axial line direction, and the turning shaft 251 and the rotary power reception member 262 move in the axial line direction against an urging force of the elastic member 276 for a turning shaft. Accordingly, the operation is performed more smoothly.

As illustrated in FIG. 39C, when the drive shaft 70 enters a position pressing the regulation member 270, the engagement members 266 rise up as described above, thereby being deformed in the posture illustrated in FIG. 37. In this manner, eventually, being in the posture illustrated in FIG. 38, a rotary drive force from the drive shaft 70 can be transmitted to the photosensitive drum 11.

As described above, by using the end member 230 as well, without requiring oscillating of the shaft member 250, it is possible to more smoothly perform attachment and detachment of the drive shaft 70 with respect to the shaft member 250 on account of turning in the axial line direction and movement in the direction orthogonal to the axial line direction. In addition, since the common difference in measurement can be sufficiently set with respect to a shaft member 250 which requires oscillating, productivity is considered to be high from the viewpoint thereof.

In addition, since the engagement members 266 can switch between the non-engagement state with respect to the drive shaft 70 and the engagement state with respect to the drive shaft 70 as necessary by using the regulation member 270, hindrance to attachment and detachment caused by a member is unlikely to occur during attachment and detachment of a process cartridge, and thus, attachment and detachment is performed more smoothly.

Figure 40:
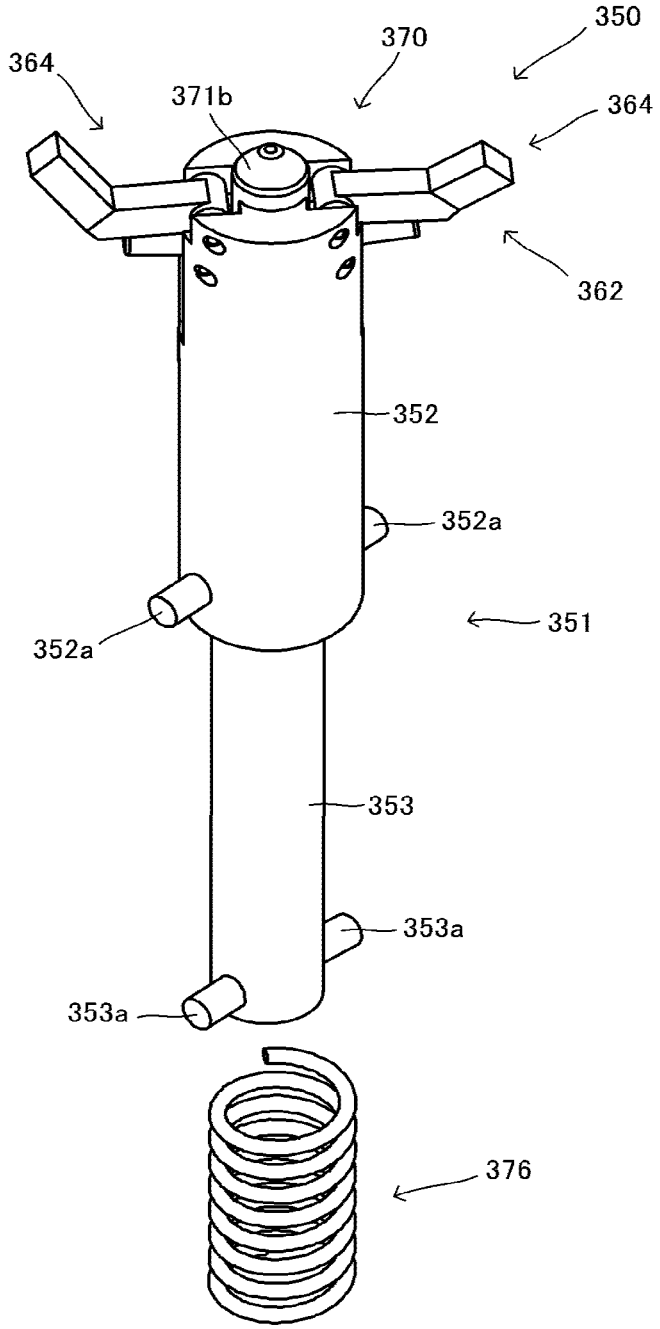
FIG. 40 is an exploded perspective view of a shaft member 350.
Figure 41:
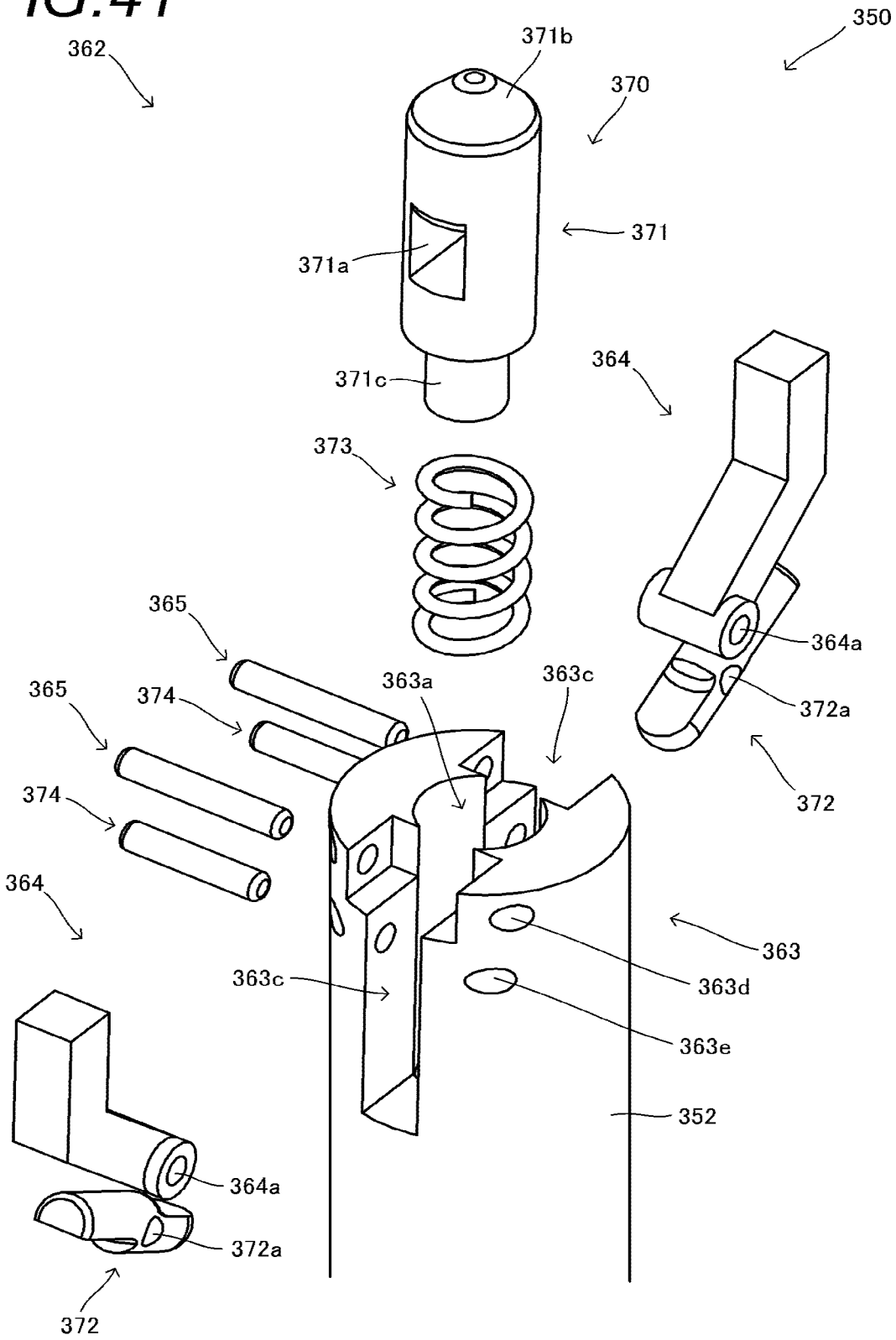
FIG. 41 is a partially enlarged exploded perspective view of the shaft member 350.
Figure 42A:
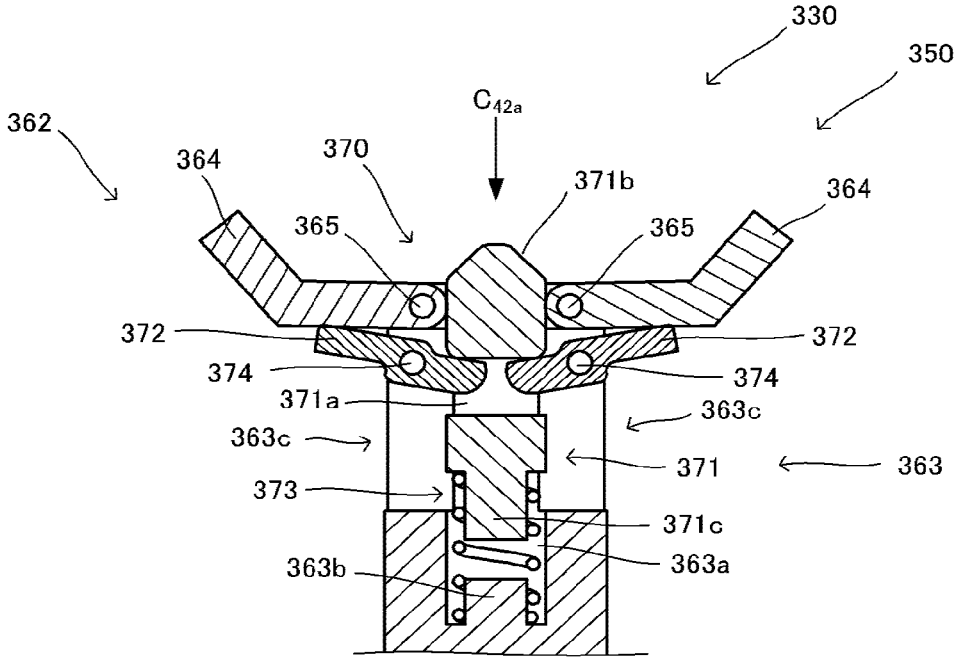
FIG. 42A is a cross-sectional view of an end member 330.
Figure 42B:
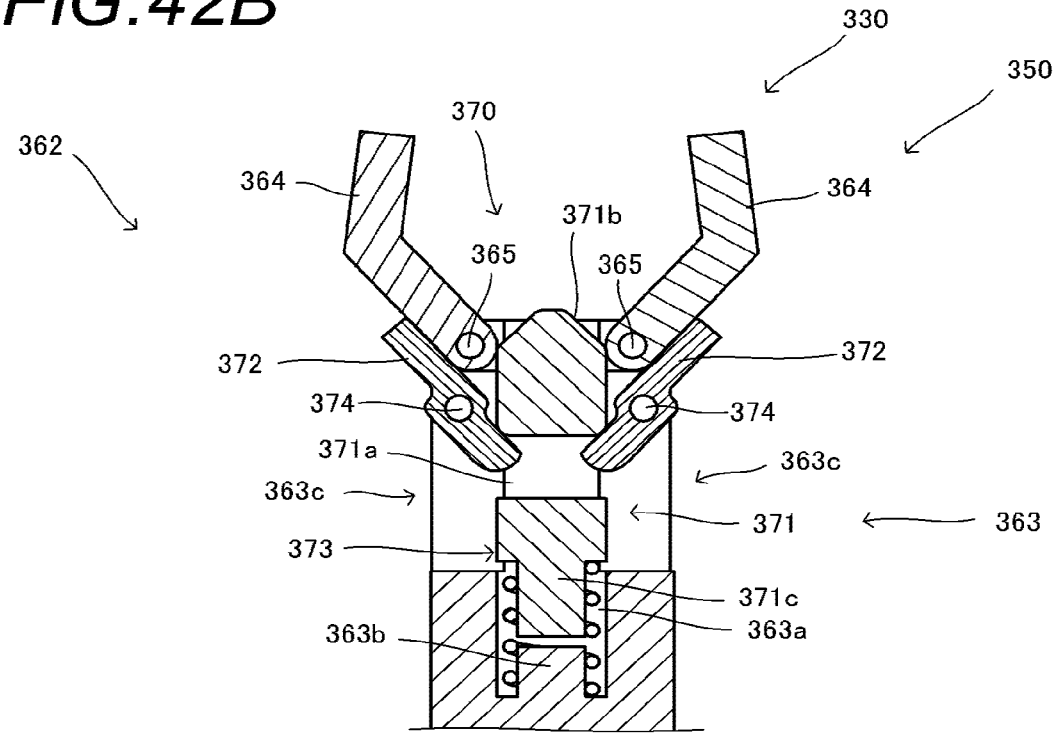
FIG. 42B is a cross-sectional view of the end member 330 in a deformed posture.

Subsequently, a fourth embodiment will be described. FIG. 40 is a perspective view of a shaft member 350 in the end member of the present embodiment, and FIG. 41 shows an exploded perspective view of the distal end portion in which a regulation member 370 is arranged, in the shaft member 350. FIGS. 42A and 42B show the distal end portion in which the regulation member 370 is arranged, in the cross section along the axial line of the shaft member 350. FIG. 42A is one posture of the regulation member 370, and FIG. 42B is another posture of the regulation member 370. The end member of the present embodiment includes a bearing member 140 in the same embodiment as that of the end member 230, and the shaft member 350 is held by the bearing member 140. Therefore, the shaft member 350 will be described herein.

As seen in FIG. 40, the shaft member 350 is configured to include a turning shaft 351, a rotary power reception member 362, the regulation member 370, and an elastic member 376 for a turning shaft. Here, in the present embodiment, the elastic member 376 for a turning shaft is a helical spring.

The turning shaft 351 is a member which transmits rotary power from the rotary power reception member 362 to the bearing member 140. As seen in FIG. 40, the turning shaft 351 includes a cylindrical first turning shaft 352 and a columnar second turning shaft 353 which has the outer diameter smaller than that of the first turning shaft 352. The turning shaft 351 has a structure in which the two turning shafts 352 and 353 are coaxially arranged and are connected to each other at the ends.

In the first turning shaft 352, two projections 352*a* are arranged on a side surface at an end on the side connected to the second turning shaft 353. The two projections 352*a* are provided on the same straight line in one diameter direction of the cylinder of the first turning shaft 352. The two projections 352*a* function similarly to the above-described outer projections 153 (for example, refer to FIG. 26A).

In addition, in the second turning shaft 353, two projections 353*a* are arranged on a side surface at an end on the side opposite to the side connected to the first turning shaft 352. The two projections 353*a* are provided on the same straight line in one diameter direction of the column of the second turning shaft 353. The two projections 353*a* function similarly to the above-described projections 162 of the regulation member 159 (for example, refer to FIG. 27A).

The rotary power reception member 362 is a member which receives a rotary drive force from the apparatus body 2 (refer to FIG. 1) and transmits the drive force to the turning shaft 351 when the end member of the present embodiment is in a predetermined posture. In the present embodiment, the rotary power reception member 362 is arranged in the end on one side of the first turning shaft 352 of the turning shaft 351 (the side opposite to the side onto which the second turning shaft 353 is connected). The rotary power reception member 362 is configured to include a base portion 363, engagement members 364, and pins 365.

The base portion 363 is a portion in which the engagement members 364 are connected to the first turning shaft 352 of the turning shaft 351 through the pins 365. In the present embodiment, the base portion 363 is formed on an end on one side of the first turning shaft 352, and a portion (the distal end) of the first turning shaft 352 also serves as the base portion 363.

A recessed portion 363*a* is formed in the base portion 363 along the axial line from the end surface on one side of the first turning shaft 352, and a projection 363*b* is provided at the bottom thereof, as seen in FIGS. 42A and 42B. In addition, two slits 363*c* are formed in the base portion 363 having the direction along the axial line direction from the end surface on one side of the first turning shaft 352 as the elongated direction. Two slits 363*c* are furnished with depths allowing the side surfaces of the first turning shaft 352 and the recessed portion 363*a* to communicate with each other. In the present embodiment, the two slits 363*c* are arranged at positions 180° apart from each other about the axial line on one diameter of the first turning shaft 352.

Moreover, holes 363*d* and 363*e* are formed in the base portion 363. The holes 363*d* and 363*e* extend in a width direction of the slits 363*c* and penetrate the base portion 363. The holes 363*d* and the holes 363*e* are arranged side by side in the elongated direction of the slits 363*c*, and the holes 363*d* are on a side near the end on one side of the first turning shaft 352.

The engagement members 364 are rod-like members. In the present embodiment, each of the engagement members 364 has a bend therein. A penetration hole 364*a* orthogonal to the extending directions of the engagement members 364 is provided in one end thereof.

The pins 365 are cylindrical rod-like members.

The regulation member 370 is configured to include a regulation shaft 371, operation portions 372, an elastic member 373, and pins 374.

The regulation shaft 371 is a columnar member, and the outer shape has a size which can be inserted into the recessed portion 363*a* which is provided in the base portion 363. In addition, a slit 371*a* is formed in the regulation shaft 371 so as to penetrate the regulation shaft 371 in the diameter direction and to extend in a predetermined size in the axial line direction. Between the ends of the regulation shaft 371, the end on the side which is not inserted into the base portion 363 is a portion of a cone (a truncated cone), and an inclination surface 371*b* is formed therein. In addition, between the ends of the regulation shaft 371, a projection 371*c* is provided on the side opposite to the inclination surface 371*b*.

The operation portions 372 are rod-like members. Similar to the engagement members 364, two operation portions 372 are arranged. Each of the operation portions 372 includes a penetration hole 372*a* orthogonal to the elongated direction, in the vicinity of the center in the elongated direction.

In the present embodiment, the elastic member 373 is formed with a helical spring. In addition, the pins 374 are cylindrical rod-like members.

Each of the above-described members is assembled as follows, thereby configuring the end member of the present embodiment. Through the descriptions regarding the assembly, it is possible to understand the size of each of the members and the portions, the structure, and the relationship between the sizes of the members and portions.

The elastic member 373 for a regulation member is inserted into the recessed portion 363*a* which is formed in the base portion 363. Moreover, the end on the side where the projection 371*c* is provided, in the regulation shaft 371 of the regulation member 370 is also inserted into the cylinder. One end of the elastic member 373 for a regulation member is inserted into the recessed portion and is fixed to the projection 363*b*. The other end of the elastic member 373 for a regulation member is inserted into the regulation shaft 371 and is fixed to the projection 371*c*. Accordingly, the regulation shaft 371 is urged in a direction of slipping out from the turning shaft 351, by an urging force of the elastic member 373 for a regulation member.

As seen in FIG. 42A, one end side of the operation portion 372 is inserted into the slit 371*a* of the regulation shaft 371 from the slit 363*c*. Then, the pin 374 is arranged so as to pass through the hole 363*e* and the hole 372*a*. Accordingly, the operation portion 372 can turn pivoting around the pin 374. In this case, in a posture where no external force is applied, the operation portion 372 is arranged in a direction orthogonal to the axial line of the regulation shaft 371.

Meanwhile, one end side of the engagement member 364 is arranged in the slit 371*a*, and the pin 365 is arranged so as to pass through the hole 363*d* and the hole 364*a*. Accordingly, the engagement member 364 can turn pivoting around the pin 365. In this case, in a posture where no external force is applied, the engagement member 364 extends in a direction orthogonal to the axial line of the regulation shaft 371 and is positioned so as to overlap the farther distal end side of the regulation shaft 371 compared to the operation portion 372. Then, the engagement member 364 is arranged so as to come into contact with the distal end on the side which is not inserted into the slit 371*a*, in the operation portion 372.

In addition, attachment of the shaft member 350 with respect to the bearing member 140 can be performed similarly to the end member 330. Accordingly, the shaft member 350 can move in the axial line direction of the bearing member 140.

The end member 330 assembled in the above-described manner can be realized in a posture in the embodiment illustrated in FIG. 42A. In other words, in the posture, the engagement members 364 are arranged so as to be laid along a radial direction of the turning shaft 351.

In contrast, as indicated by Arrow $C_{42a}$ in FIG. 42A, when the regulation shaft 371 of the regulation member 370 is pressed toward the bearing member 140 side (downward of the sheet surface of FIG. 40), the regulation shaft 371 moves toward the bearing member 140 side, and thus, the end of the operation portion 372 which is inserted into the slit 371*a* of the regulation shaft 371 is also pressed in the same direction. Then, the operation portion 372 turns while being centered around the pin 374, and the end on the opposite side moves toward the opposite side of the bearing member 140. Accordingly, the end on the opposite side presses the engagement member 364, and the engagement member 364 turns while being centered around a pin 365. Therefore, as illustrated in FIG. 42B, the engagement member 364 rises up so as to approach in the axial line direction in a parallel manner.

In other words, the end member 330 can also switch between a posture in which the engagement members 364 stand upright (a protruding posture) and a posture in which the engagement members 364 lay down (a laid posture). Accordingly, the end member 330 can also operate similarly in accordance with the example of the end member 230.

The present embodiment illustrates an example in which one type of the operation portion 372 directly presses the engagement member 364. However, without being limited thereto, multiple types of the operation portions 372 in association with each other may be used. Eventually, the operation portion 372 which approaches closest to the engagement member 364 may press the engagement member 364 in the embodiment. In addition, the operation portion 372 and the engagement member 364 may be integrally formed without being differentiated.

Figure 43:
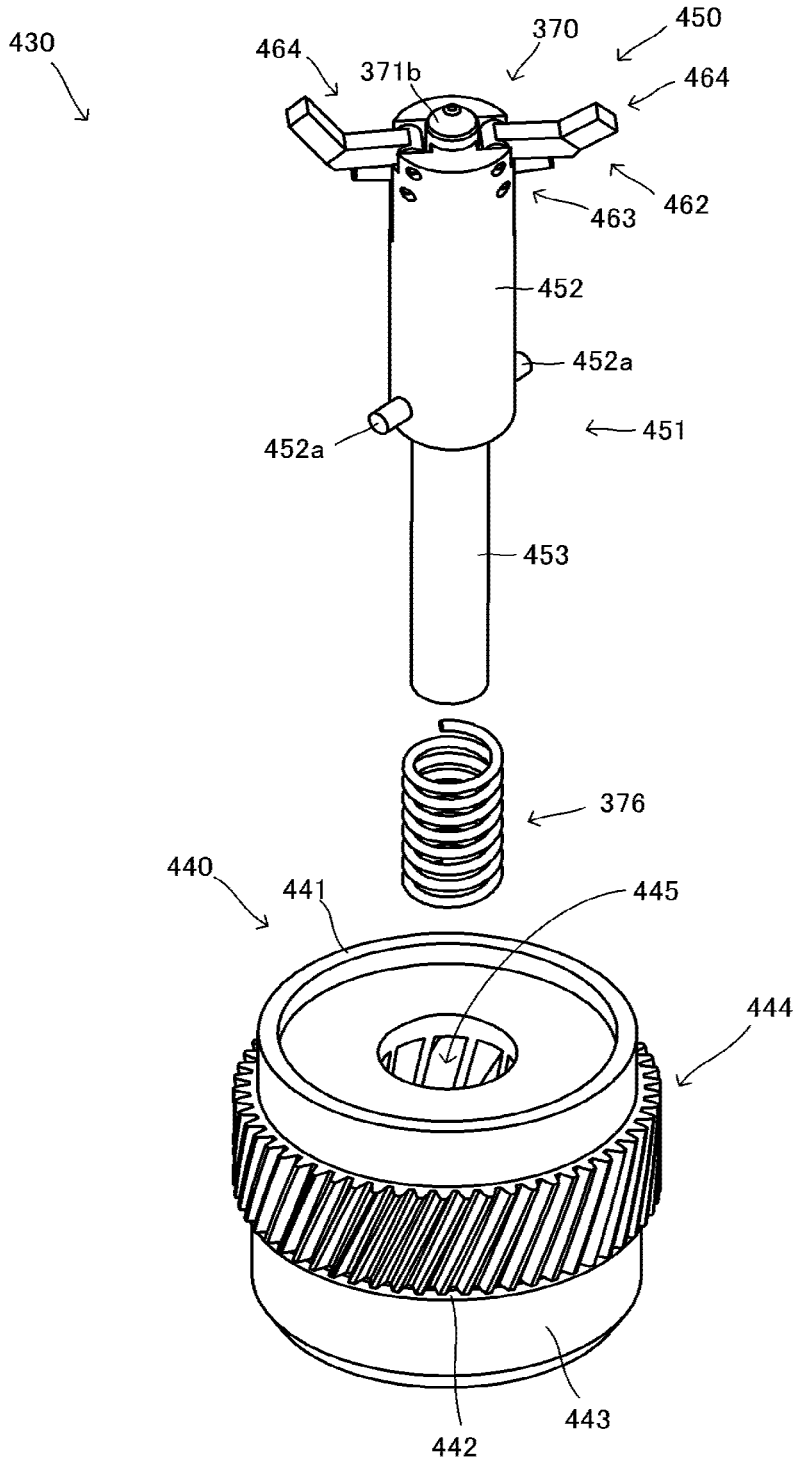
FIG. 43 is an exploded perspective view of an end member 430.

Subsequently, a fifth embodiment will be described. FIG. 43 shows an exploded perspective view of an end member 430 included in the fifth embodiment. The elements other than the end member 430 are similar to those in the first embodiment. Therefore, the descriptions thereof will be omitted. The end member 430 is also configured to include a bearing member 440 and a shaft member 450.

Figure 44C:
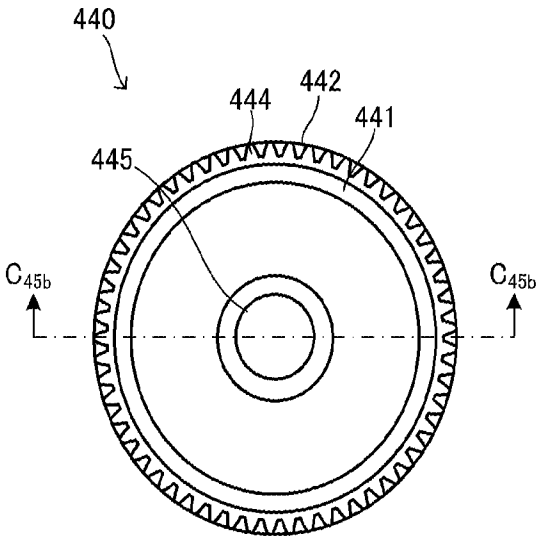
FIG. 44C is a plan view of the bearing member 440.
Figure 44B:
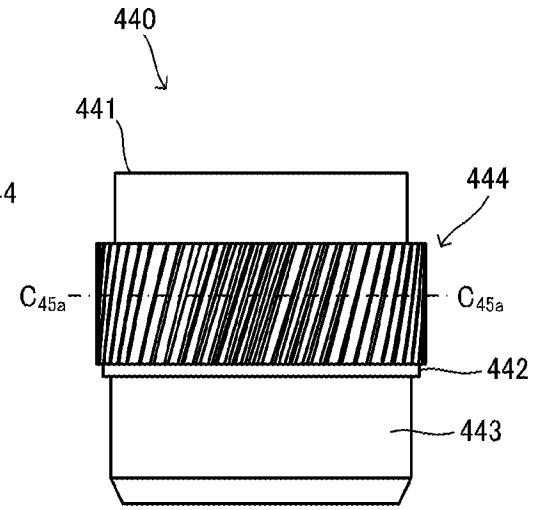
FIG. 44B is a front view of the bearing member 440.
Figure 44A:
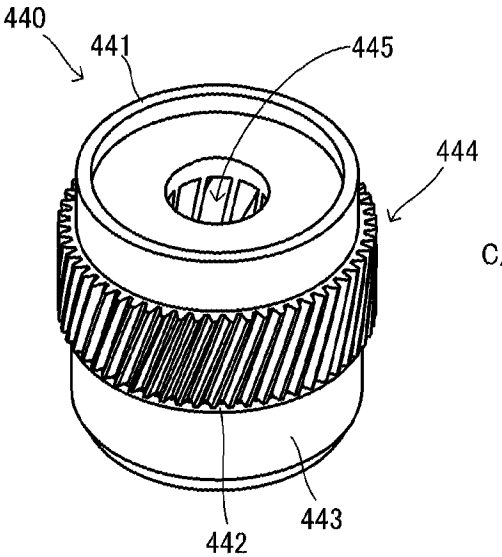
FIG. 44A is a perspective view of a bearing member 440.
Figure 45A:
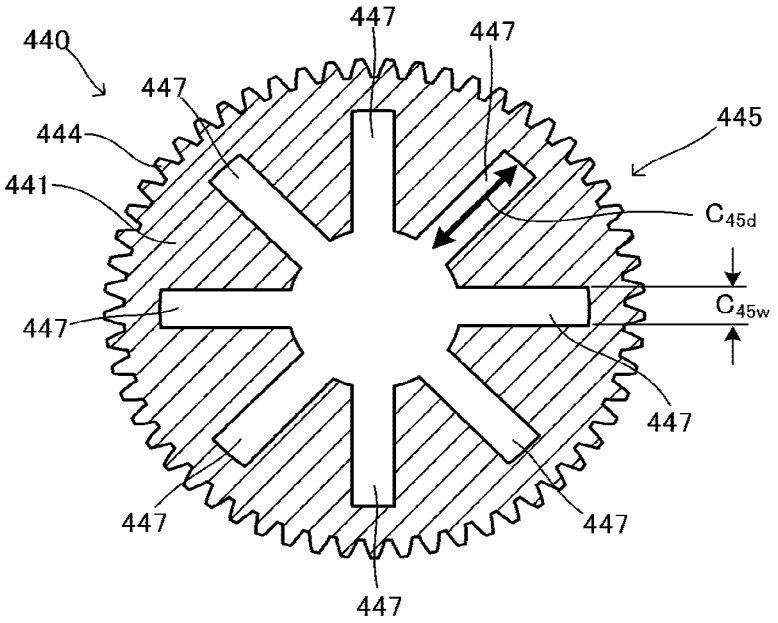
FIG. 45A is a cross-sectional view of the bearing member 440 seen in a direction perpendicular to an axial line.
Figure 45B:
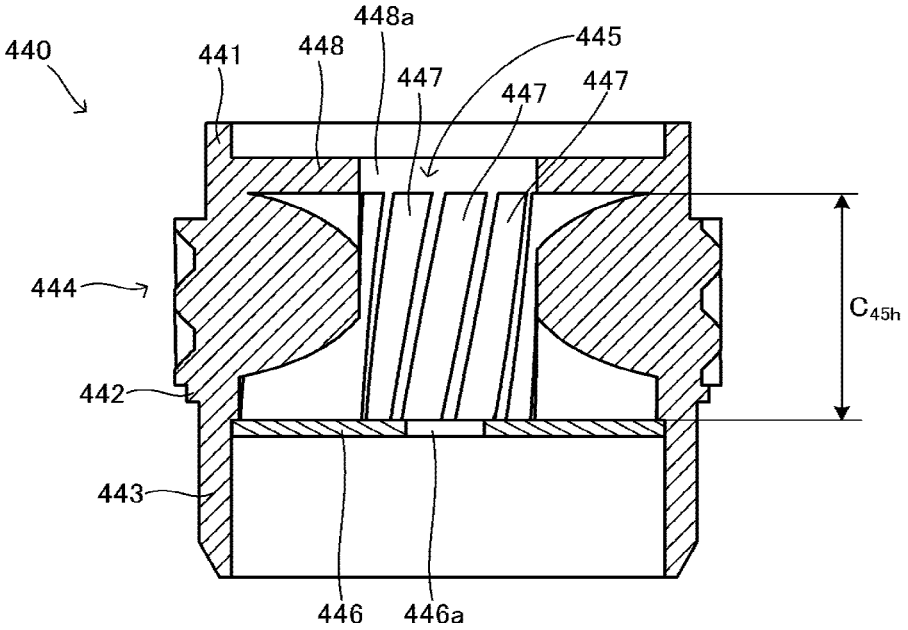
FIG. 45B is a cross-sectional view of the bearing member 440 seen in a direction along the axial line.

The bearing member 440 is a member which is bonded to the end of the photosensitive drum 11 in the end member 430. FIG. 44A shows a perspective view of the bearing member 440, FIG. 44B show a front view of the bearing member 440, and FIG. 44C shows a plan view of the bearing member 440 seen from a side on which the shaft member 450 is arranged. Moreover, FIG. 45A illustrates a cross-sectional view taken along line $C_{45a}$-$C_{45a}$ indicated in FIG. 44B. In other words, FIG. 45A shows the cross section which is a plane orthogonal to the axial line of the bearing member 440 and is a cross section obtained by cutting the bearing member 440. FIG. 45B is a cross-sectional view taken along line $C_{45b}$-$C_{45b}$ indicated in FIG. 44C. In other words, FIG. 45B is a cross-sectional view of the bearing member 440 in the direction along the axial line, including the axial line of the bearing member 440.

The bearing member 440 is configured to include, a tubular body 441, a contact wall 442, a fitting portion 443, a gear potion 444, and a shaft member holding portion 445.

The tubular body 441 is a cylindrical member in its entirety. The contact wall 442 and the gear potion 444 are arranged outside thereof, and the shaft member holding portion 445 is formed inside thereof. Regarding the portion inside the tubular body 441 in which at least the shaft member holding portion 445 is furnished, the inner diameter of the tubular body 441 is caused to be substantially the same as the outer diameter of the first turning shaft 452 to the extent at which a first turning shaft 452 of a turning shaft 451 of the shaft member 450 described below can move smoothly in the axial line direction and rotate while being centered around the axial line.

The contact wall 442 which comes into contact and engages with the end surface of the photosensitive drum 11 stands upright from a portion of the outer circumferential surface of the tubular body 441. Accordingly, while the end member 430 is in a posture of being mounted in the photosensitive drum 11, the insertion depth of the end member 430 with respect to the photosensitive drum 11 is regulated.

In addition, one side of the tubular body 441 having the contact wall 442 in the middle becomes the fitting portion 443 which is inserted into the photosensitive drum 11. The fitting portion 443 is inserted into the photosensitive drum 11 and is fixed onto the inner surface of the photosensitive drum 11 by using an adhesive. Accordingly, the end member 430 is fixed to the end of the photosensitive drum 11. Therefore, the outer diameter of the fitting portion 443 is substantially the same as the inner diameter of the photosensitive drum 11 within a range that allows insertion into the cylinder of the photosensitive drum 11. A groove may be formed on the outer circumferential surface in the fitting portion 443. Accordingly, the groove is filled with an adhesive, thereby improving the adhesive properties between the tubular body 441 (the end member 430) and the photosensitive drum 11 on account of an anchoring effect and the like.

The gear potion 444 is formed on the outer circumferential surface of the tubular body 441 on the side opposite to the fitting portion 443 having the contact wall 442 in the middle. The gear potion 444 is a gear which transmits rotary power to other members such as a developing roller unit 5. In the present embodiment, a helical gear is arranged. However, the type of the gear is not particularly limited so that a spur gear may be arranged, or both may be arranged side by side along the axial line direction of the tubular body 441. The gear is not necessarily provided.

The shaft member holding portion 445 is a member which is formed inside the tubular body 441 and functions to cause the shaft member 450 to be held by the bearing member 440 while ensuring a predetermined operation of the shaft member 450. The shaft member holding portion 445 also functions as means for moving and turning a rotary power reception member 462. The shaft member holding portion 445 includes a bottom plate 446, spiral grooves 447, and a lid 448.

As shown in FIG. 45B, the bottom plate 446 is an annular member, which is arranged so as to block and partition the inside of the tubular body 441. Therefore, a penetration hole 446*a* is provided in the center thereof. A second turning shaft 453 of the turning shaft 451 is inserted into the penetration hole 446*a*. Attachment of the bottom plate 446 with respect to the tubular body 441 can be performed by glueing, welding, or the like. In addition, the tubular body 441 and the bottom plate 446 may be formed integrally with each other.

As shown in FIG. 45B, the lid 448 is an annular member which is arranged at predetermined intervals in the axial line direction with respect to the bottom plate 446 and is arranged so as to block and partition the inside of the tubular body 441. Therefore, a penetration hole 448*a* is provided in the center thereof. The first turning shaft 452 of the turning shaft 451 is inserted into the penetration hole 448*a*. The spiral grooves 447 are arranged between the bottom plate 446 and the lid 448. Attachment of the lid 448 with respect to the tubular body 441 may be performed so as to be attachable and detachable by a claw, or may be performed so as to be firmly fixed by gluing, welding, or the like. In addition, the tubular body 441 and the lid 448 may be formed integrally with each other.

The spiral grooves 447 are a plurality of spiral grooves which are formed between the bottom plate 446 and the lid 448, on the inner surface of the tubular body 441. As indicated by $C_{45d}$ in FIG. 45A, the depth direction thereof is radially formed (in the radial direction) while being centered around the axial line of the tubular body 441. Meanwhile, as shown in FIG. 45B, the longitudinal direction of the spiral grooves 447 is the direction along the axial line of the tubular body 441, and one end side and the other end side thereof are distorted so as to be misaligned in a direction along the inner circumference of the tubular body 441, thereby being formed spirally. In addition, as indicated by $C_{45w}$ in FIG. 34A, an end of a projection 452*a* of the turning shaft 451 described below is inserted in the width direction of the spiral grooves 447, and the end of the projection 452*a* is formed so as to be substantially the same as the diameter of the projection 452*a* to the extent at which the end can move smoothly in the spiral grooves 447.

One end of each of the spiral grooves 447 in the longitudinal direction is blocked by the bottom plate 446 and the other end in the longitudinal direction is blocked by the lid 448.

In addition, as an index for indicating a degree of torsion of the spiral grooves 447, "a torsion rate" can be defined. In other words, "a torsion rate" is defined from a length of the spiral groove 447 in the axial line direction (the length indicated by $C_{45h}$ in FIG. 45B) and a total torsion angle which is an angle at which the spiral groove 447 in the length is distorted in the circumferential direction while being centered around the axial line, thereby being presented by the following expression.

Torsion Rate (°/mm)=Total Torsion Angle)(°)/Length (mm) of Spiral Groove in Axial Line Direction Moreover, the plurality of spiral grooves 447 are formed by at least one set which faces each other interposing the axial line of the tubular body 441. In the example of the present embodiment, there are four sets, that is, eight spiral grooves 447 are formed in total. However, one set, that is, two spiral grooves 447 in total may be formed. Meanwhile, two sets, three sets, or five or more sets of spiral grooves 447 may be provided. When performing injection molding of such spiral grooves 447, the injection molding is performed by injecting a material and separating the material from the die while turning the die.

The material configuring the bearing member 440 is not particularly limited so that a resin such as polyacetal, polycarbonate, and PPS, or a metal can be used. Here, when using a resin, in order to improve rigidity of the member, glass fibers, carbon fibers, and the like may be compounded in the resin in accordance with the load torque. In addition, in order to make attachment and movement of the shaft member 450 smooth, the resin may contain at least one type among fluorine, polyethylene, and silicon rubber so as to improve slidability. Moreover, the resin may be subjected to fluorine coating or may be coated with a lubricant.

When the bearing member 440 is fabricated by using a metal, it is possible to adopt carving performed by cutting, aluminum die-casting, zinc die-casting, a metal powder injection molding method (a so-called MIM method), a metal powder sintering lamination method (a so-called 3D printer), and the like. In addition, regardless of the material of a metal, iron, stainless steel, aluminum, brass, copper, and zinc, or an alloy thereof and the like may be used. Moreover, various types of plating are performed so that functionality of the surface (lubricity or corrosion resistance) can be improved.

Returning to FIG. 43, the shaft member 450 will be described. As seen in FIG. 43, the shaft member 450 is configured to include the turning shaft 451, the rotary power reception member 462, the regulation member 370, and the elastic member 376 for a turning shaft. Here, in the present embodiment, the elastic member 376 for a turning shaft is a helical spring. Here, since the regulation member 370 and the elastic member 376 for a turning shaft are the same as the above-described members, the same reference numerals are applied and the descriptions will be omitted.

Similar to the above-described rotary power reception member 362, the rotary power reception member 462 is a member which receives a rotary drive force from the apparatus body 2 (refer to FIG. 1) and transmits the drive force to the turning shaft 451 when the end member of the present embodiment is in a predetermined posture. In the present embodiment, the rotary power reception member 462 is arranged in the end on one side of the first turning shaft 452 of the turning shaft 451 (the side opposite to the side onto which the second turning shaft 453 is connected). The rotary power reception member 462 is configured to include a base portion 463, engagement members 464, and pins 465. Here, the base portion 463 and the pins 465 are the same as the base portion 363 and the pins 365 in the above-described embodiment, the descriptions will be omitted.

The engagement members 464 are rod-like members. In the present embodiment, each of the engagement members 464 has a bend therein and is provided with a tapered portion so as to have a hook shape. Then, a recessed portion orthogonal to the extending direction of the engagement member 464 is provided in one end thereof. The recessed portion is similar to the recessed portion 363*a* of the above-described embodiment.

In this manner, by providing the hook-like tapered portion in each of the engagement members 464, as described below with reference to FIG. 49, it is possible to generate pulling power (attracting power P) for moving the shaft member 450 in the direction indicated by Arrow $C_{49c}$ illustrated in FIG. 49, and thus, it is possible achieve stable rotation.

The turning shaft 451 is a member which transmits rotary power from the rotary power reception member 462 to the bearing member 440. As seen in FIG. 43, the turning shaft 451 includes the cylindrical first turning shaft 452 and the columnar second turning shaft 453 which has the outer diameter smaller than that of the first turning shaft 452. The turning shaft 451 has a structure in which the two turning shafts 452, 453 are coaxially arranged and are connected to each other at the ends.

In the first turning shaft 452, the two projections 452*a* are arranged on the side surface at an end on the side connected to the second turning shaft 453. The two projections 452*a* are provided on the same straight line in one diameter direction of the cylinder of the first turning shaft 452.

Figure 46:
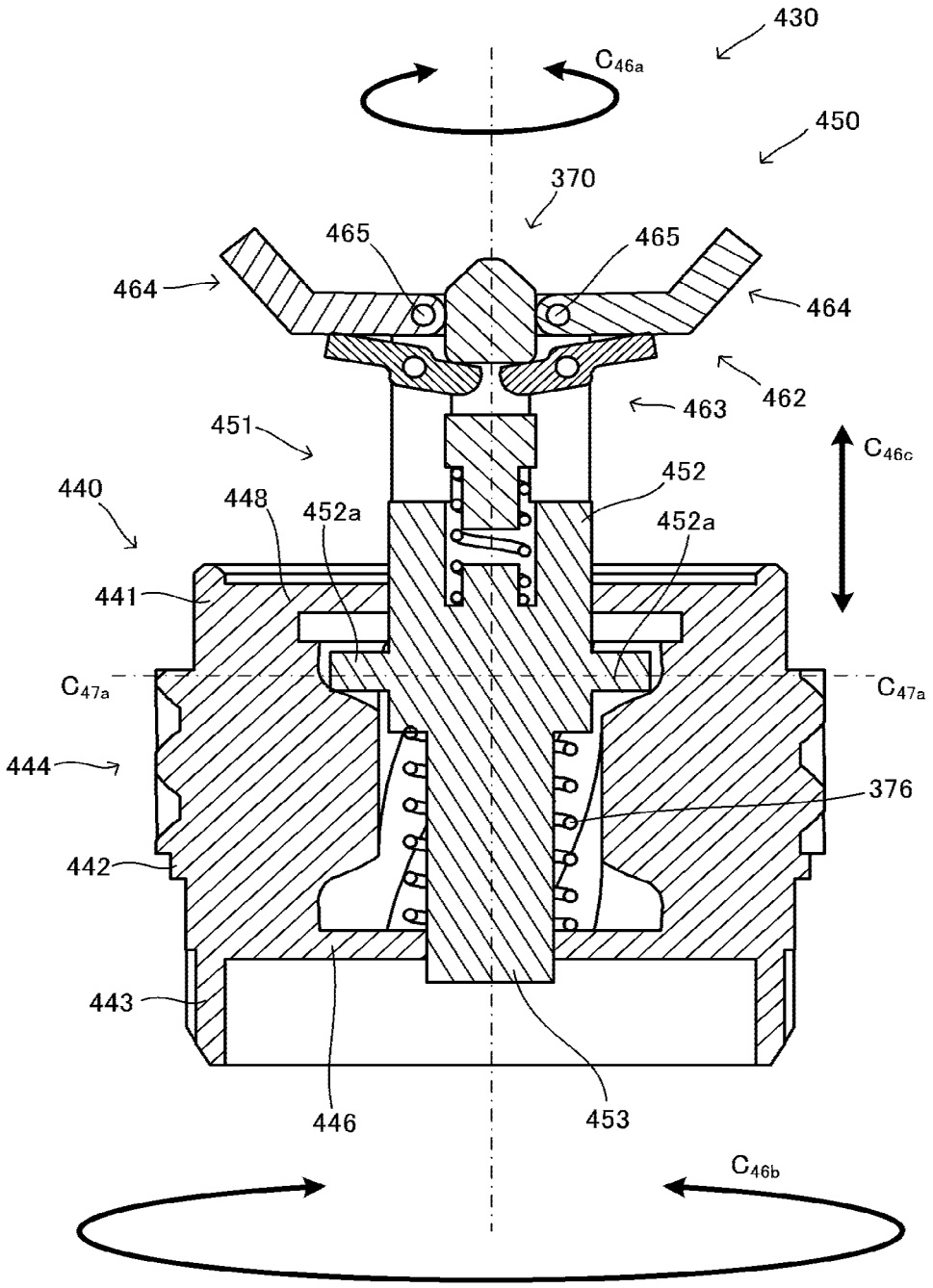
FIG. 46 is a cross-sectional view of the end member 430.
Figure 47A:
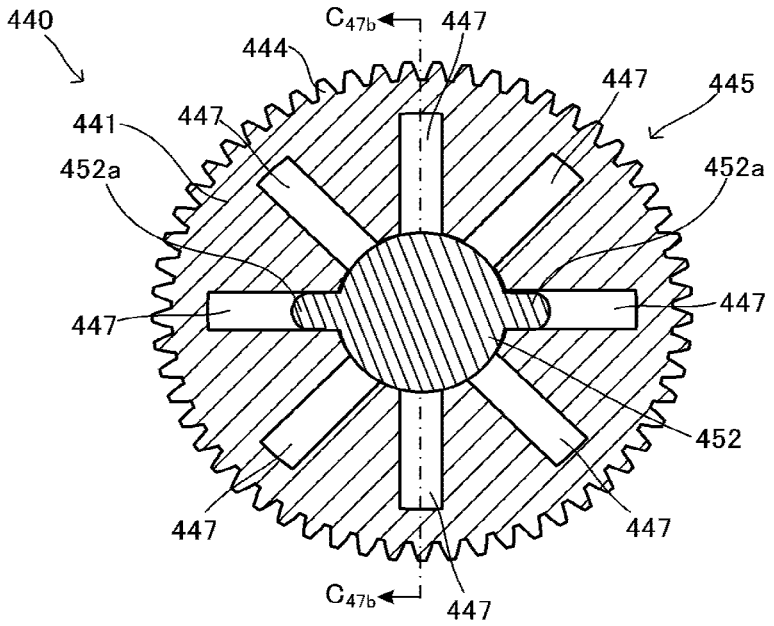
FIG. 47A is a cross-sectional view of the end member 430 seen in a direction perpendicular to the axial line.
Figure 47B:
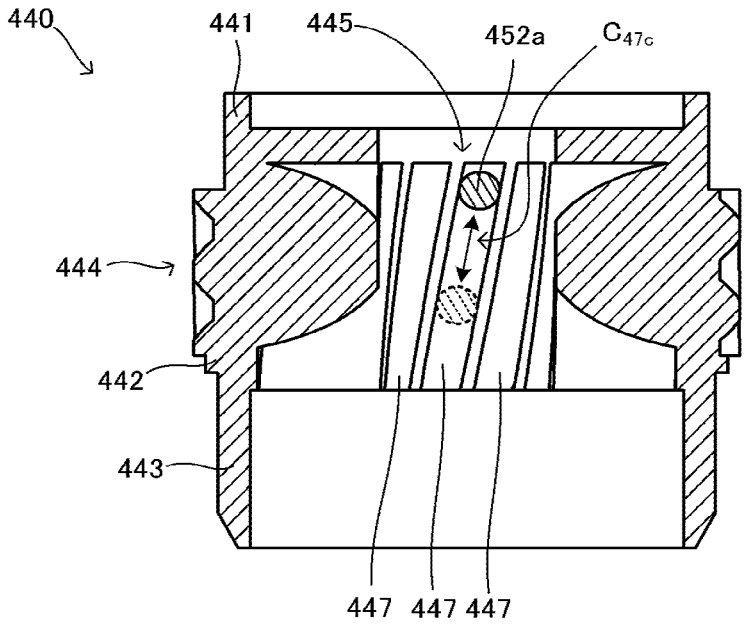
FIG. 47B is a cross-sectional view of the end member 430 seen in a direction along the axial line.

The bearing member 440 and the shaft member 450 described above are assembled as follows, thereby configuring the end member 430. Through the descriptions regarding the assembly, it is possible to understand the size of each of the members and the portions, the structure, and the relationship between the sizes of the members and portions. FIG. 46 is a cross-sectional view taken along the axial line direction of the end member 430. FIG. 47A is a cross-sectional view of the end member 430 taken along line $C_{47a}$-$C_{47a}$ indicated in FIG. 46, and FIG. 47B is a cross-sectional view of the end member 430 taken along line $C_{47b}$-$C_{47b}$ indicated in FIG. 47A. However, in FIG. 47B, only the projection 452*a* is shown regarding the shaft member 450.

As seen in FIG. 46, in the turning shaft 451, the second turning shaft 453 is inserted toward the bottom plate 446 side of the shaft member holding portion 445 which is formed inside the bearing member 440, thereby passing through the penetration hole 446*a*. In addition, the first turning shaft 452 passes through the penetration hole 448*a* of the lid 448. In this case, as illustrated in FIGS. 47A and 47B, the projection 452*a* protruding from the side surface of the turning shaft 451 is inserted into the spiral grooves 447 which are formed in the shaft member holding portion 445 of the bearing member 440.

In addition, as seen in FIG. 46, inside the bearing member 440, the second turning shaft 453 passes through the inside of the elastic member 376 for a turning shaft, and the elastic member 376 for a turning shaft is arranged between the bottom plate 446 and the first turning shaft 452. Therefore, one side of the elastic member 376 for a turning shaft comes into contact with the first turning shaft 452, and the other side thereof comes into contact with the bottom plate 446. Accordingly, the elastic member 376 for a turning shaft urges the turning shaft 451, and the turning shaft 451 is urged in a direction in which the turning shaft 451 protrudes from the bearing member 440. However, the projections 452*a* are inserted into the spiral groove 447 of the bearing member 440, and both the ends of the spiral groove 447 are blocked by the bottom plate 446 and the lid 448. Therefore, the turning shaft 451 is held in an urged state without coming off from the bearing member 440.

As described above, in the posture in which each of the members is assembled, the axial lines of the bearing member 440 and the turning shaft 451 coincide with each other.

Figure 48:
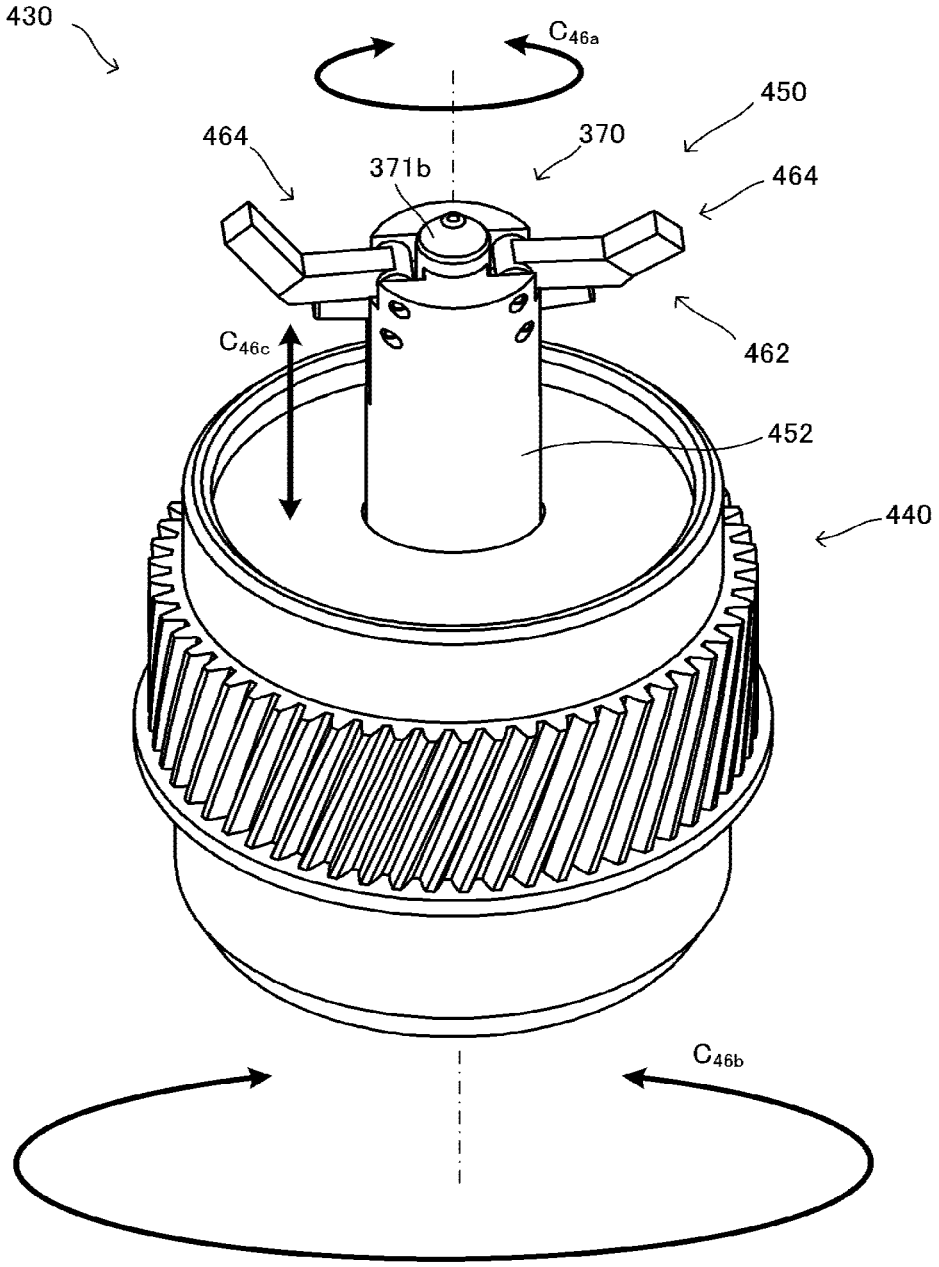
FIG. 48 is a perspective view of the end member 430.

Subsequently, descriptions will be given regarding how the end member 430 can be deformed, moved, and turned. FIG. 48 shows a perspective view of the end member 430 in one posture.

In the postures illustrated in FIGS. 46 to 48, the entirety of the shaft member 450 is in a posture protruding at the most from the bearing member 440 within the possible range on account of the elastic member 376 for a turning shaft. When there is no external force applied to the shaft member 450, the end member 430 is in the aforementioned posture.

The rotary power reception member 462 and the regulation member 370 operated as described above with reference to FIGS. 42A and 42B, descriptions thereof will be omitted. In addition, herein, descriptions are given exemplifying that the rotary power reception member 462 and the regulation member 370 are in the posture of FIG. 42A. However, the rotary power reception member 462 and the regulation member 370 operate similarly even in the posture of FIG. 42B.

In the postures of FIGS. 46 and 48 (the rotary power reception member 462 and the regulation member 370 in the posture of FIG. 42A), as indicated by Arrow $C_{46a}$ in FIGS. 46 and 48, when rotary power about the axial line is applied to the turning shaft 451 through the rotary power reception member 462, the projections 452*a* also turn following thereafter. Then, first, the projections 452*a* press the side walls of the spiral grooves 447, and rotations are transmitted to the bearing member 440, thereby turning the bearing member 440 as indicated by Arrow $C_{46b}$ in FIGS. 46 and 48. Accordingly, the photosensitive drum 11 attached to the bearing member 440 also rotates about the axial line.

Second, since the projections 452*a* are inserted into the spiral groove 447, when the turning shaft 451 turns, the projections 452*a* also move in the axial line direction as indicated by Arrow $C_{47c}$ in FIG. 47B. Accordingly, the turning shaft 451 attached with the projections 452*a*, and the rotary power reception member 462 and the regulation member 370 which are attached thereto move against an urging force of the elastic member 376 for a turning shaft or in the urging direction as indicated by Arrow $C_{46c}$ in FIGS. 46 and 48.

Therefore, in the end member 430, as the rotary power reception member 462 rotates, the end member 430 turns about the axial line, and the turning shaft 451 moves in the direction along the axial line.

In the posture in which the process cartridge 3 is mounted in the apparatus body 2, the drive shaft 70 engages with the rotary power reception member 462 which is furnished in the shaft member 450 of the end member 430, thereby transmitting rotary power. FIG. 49 illustrates a perspective view of an instance in which the rotary power reception member 462 of the end member 430 engages with the drive shaft 70.

Figure 49:
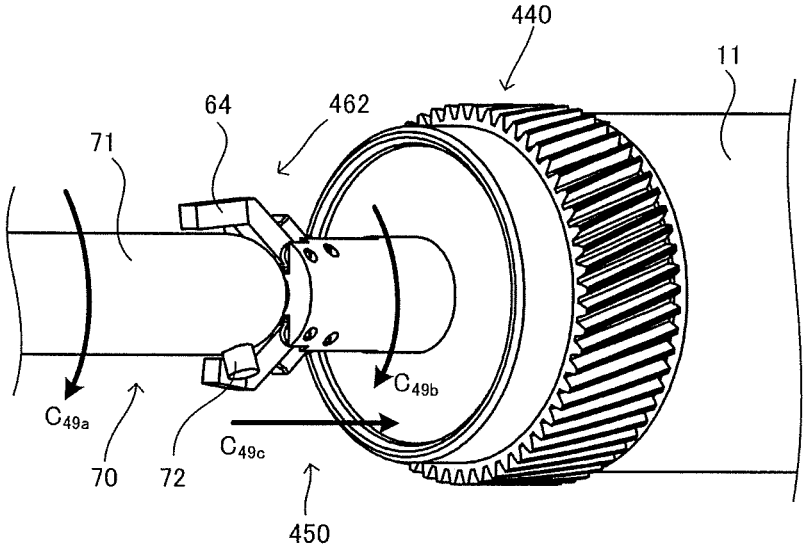
FIG. 49 is a perspective view illustrating an instance in which the end member 430 and the drive shaft 70 engage with each other.

As seen in FIG. 49, in the posture in which the drive shaft 70 and the rotary power reception member 462 engage with each other, the axial line of the drive shaft 70 and the axial line of the shaft member 450 are arranged so as to coincide with and abut against each other. In this case, the rotary power transmission projections 72 of the drive shaft 70 respectively engage with the two engagement members 464 of the rotary power reception member 462 from the side surfaces so as to be caught therein.

In the posture indicated by Arrow $C_{49a}$ in FIG. 49, when the drive shaft 70 rotates in a rotary power transmission direction, the rotary power transmission projections 72 are caught in the engagement members 464, and rotary power is transmitted to a turning shaft 451 as indicated by Arrow $C_{49b}$ in FIG. 49. In this case, the turning shaft 451 tends to move in the direction indicated by Arrow $C_{49c}$ in FIG. 49 due to an operation of the spiral grooves 447 and the projection 452*a* of the bearing member 440. However, since the rotary power transmission projections 72 of the drive shaft 70 engage with the engagement members 464 of the rotary power reception member 462, both are not disengaged from each other, thereby maintaining the connection therebetween. A force which tends to move in the direction indicated by Arrow $C_{49c}$ becomes power pulling the drive shaft 70 and operates so as to make the turning more stable.

However, in this case, pulling power of the spiral grooves 447 is weaker than an engagement force between the engagement member 464 and the drive shaft 70. More specifically, it is preferable to be configured as follows. That is, it is preferable that the following expression is established by attracting power P of the engagement member, an urging force Q of the elastic member for a turning shaft, and an axial line direction force R of the spiral groove, as the condition of rotative driving.

$$R \leq P+Q$$

Here, P is a force of moving in a direction approaching the drive shaft of the apparatus body during rotative driving on account of the shape of the engagement member of the distal end member. Q is a force of moving in a direction approaching the drive shaft of the apparatus body, generated by the elastic member for a turning shaft. R is a force for moving the turning shaft in a direction of being detached from the drive shaft of the apparatus body, generated by the spiral groove of the body during rotative driving.

Subsequently, descriptions will be given regarding an example of the operation of the drive shaft 70 when the process cartridge 3 including the end member 430 is mounted in the apparatus body 2 so as to be in the posture of FIG. 49, and the photosensitive drum unit 10. A first example is illustrated in FIGS. 50A-50C.

Figure 50A:
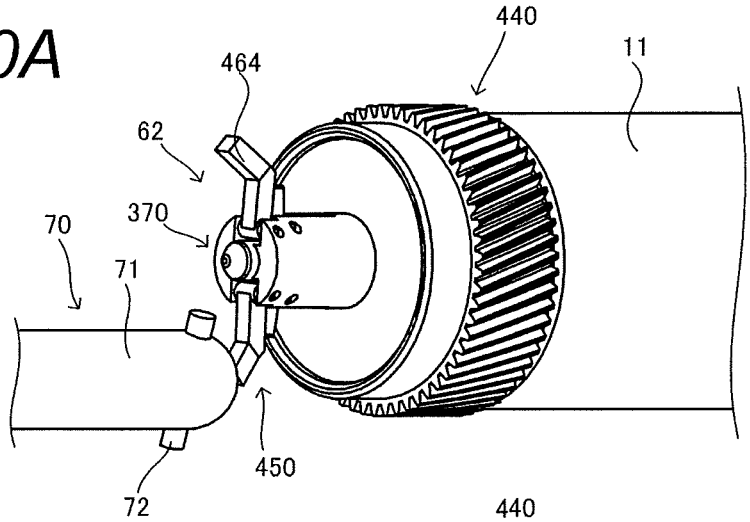
FIG. 50A is a perspective view illustrating an instance in which the drive shaft 70 and the photosensitive drum unit engage with each other.
Figure 50B:
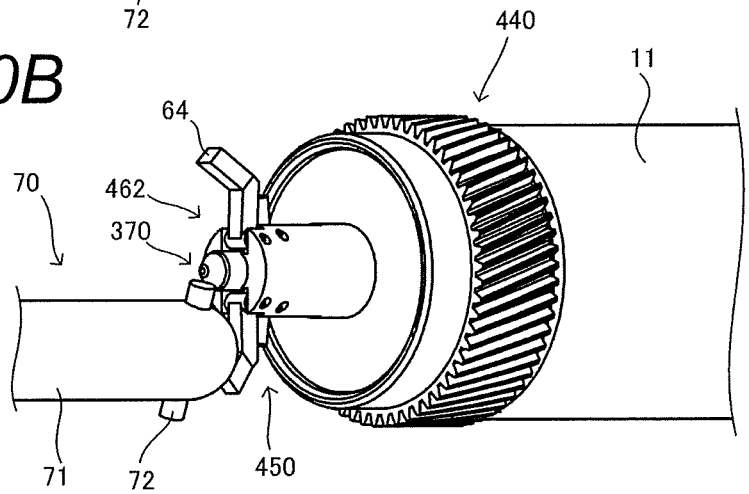
FIG. 50B is a perspective view illustrating another instance in which the drive shaft 70 and the photosensitive drum unit engage with each other.
Figure 50C:
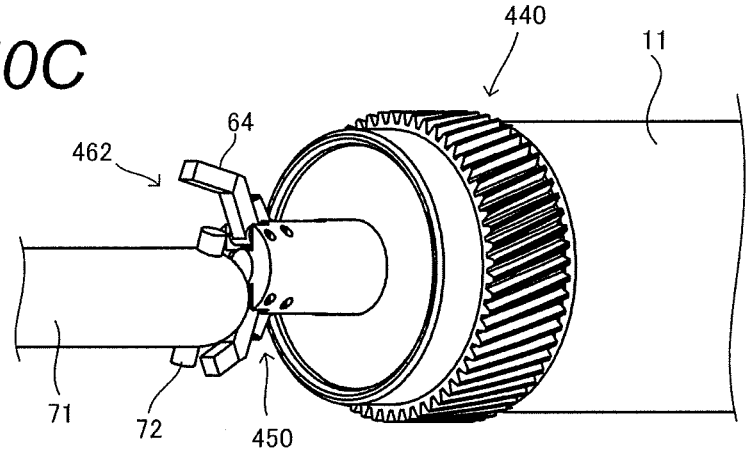
FIG. 50C is a perspective view illustrating another instance in which the drive shaft 70 and the photosensitive drum unit engage with each other.

In the first example, FIGS. 50A-50C are perspective views showing a process in which the drive shaft 70 engages with the rotary power reception member 462, in the order of those in FIGS. 50A to 50C. In the present example, before the drive shaft 70 presses the regulation shaft 371 of the regulation member 370, the drive shaft 70 comes into contact with the engagement members 464.

First, from the state illustrated in FIG. 50A, the photosensitive drum unit 10 approaches in the direction orthogonal to the axial line direction of the drive shaft 70 as illustrated in FIG. 50B. In this case, the end member 430 of the photosensitive drum unit 10 is oriented toward the drive shaft 70 side so as to cause the axial line thereof to be oriented parallel to the axial line of the drive shaft 70, thereby approaching the drive shaft 70 while moving in the direction orthogonal to the axial line. In this case, the shaft member 450 is in the posture illustrated in FIG. 46.

In the present example, as illustrated in FIG. 50B, the drive shaft 70 presses the engagement members 464 of the rotary power reception member 462. Accordingly, the shaft member 450 moves toward the bearing member 440 side. In accordance with the movement, rotations about the axial line are also generated due to an operation of the spiral grooves 447. Then, as seen in FIG. 50C, the drive shaft 70 passes over one of the engagement members 464, thereby being able to be in the posture of FIG. 49.

In the case of the present example, by performing the above-described process in reverse order, detachment between the drive shaft 70 and the rotary power reception member 462 can be performed.

In the above-described example, it is exemplified that the drive shaft 70 comes into contact with the engagement members 464 before the drive shaft 70 presses the regulation shaft 371 of the regulation member 370. Therefore, the drive shaft 70 needs to pass over the engagement members 464. In contrast, as a second example, it is possible to exemplify that the regulation shaft 371 is pressed without causing the drive shaft 70 to come into contact with the engagement members 464 (including slight contact not hindering the engagement). In this case, as the drive shaft 70 presses the regulation shaft 371, the engagement members 464 rise up, thereby smoothly engaging with the rotary power transmission projections 72 of the drive shaft 70.

Figure 51A:
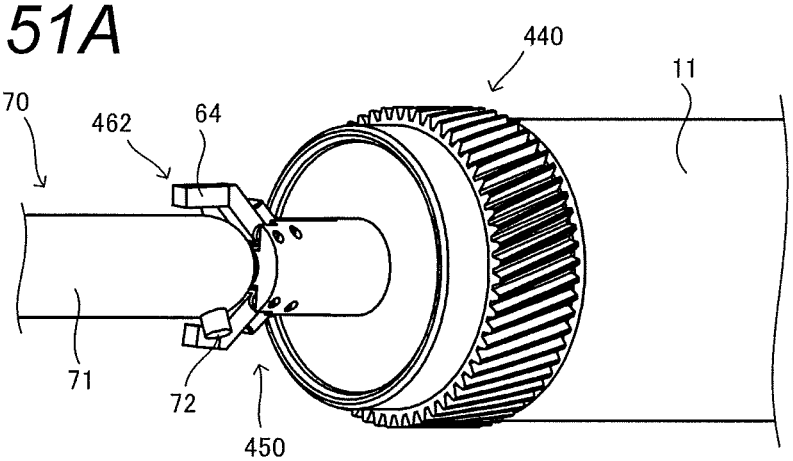
FIG. 51A is a perspective view illustrating an instance in which the drive shaft 70 and the photosensitive drum unit engage with each other.
Figure 51B:
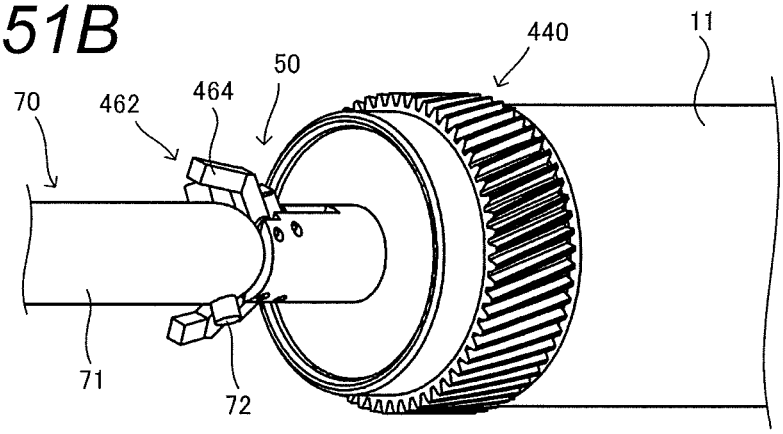
FIG. 51B is a perspective view illustrating another instance in which the drive shaft 70 and the photosensitive drum unit engage with each other.
Figure 51C:
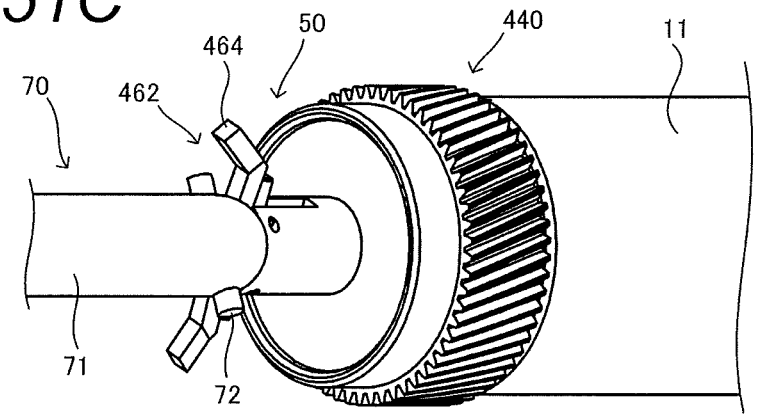
FIG. 51C is a perspective view illustrating another instance in which the drive shaft 70 and the photosensitive drum unit engage with each other.

Meanwhile, when separating both the drive shaft 70 and the rotary power reception member 462 from the engaged posture as illustrated in FIG. 49, there is a case where the detachment is performed in a direction different from that of the first example. In such a case, for example, the detachment proceeds as follows. FIGS. 51A-51C are explanatory diagrams. FIGS. 50A-50C are perspective view views showing a process in which the rotary power reception member 462 is detached from the drive shaft 70 in the order of the process in FIGS. 51A to 51C.

In the present example, when the photosensitive drum unit 10 is detached from the drive shaft 70 from the posture illustrated in FIG. 49, the rotary power transmission projections 72 of the drive shaft 70 are caught in the engagement members 464 as illustrated in FIG. 51A. In this case, the turning shaft 451 turns about the axial line as illustrated in FIG. 51B, by being caught therein. Then, due to an operation of the spiral grooves 447, the turning shaft 451 moves toward the bearing member 440 side along the axial line direction. In addition, as the regulation member 370 is detached from the shaft portion 71 of the drive shaft 70, a force pressing the regulation shaft 371 of the regulation member 370 is also cancelled, and thus, the engagement members 464 are deformed to the posture illustrated in FIG. 46. Accordingly, the rotary power transmission projections 72 and the engagement members 364 are disengaged from each other, thereby being able to be smoothly detached from each other as illustrated in FIG. 51C.

As described above, according to the present embodiment, engagement and detachment between the drive shaft 70 and the photosensitive drum unit 10 become smoother.

Figure 52:
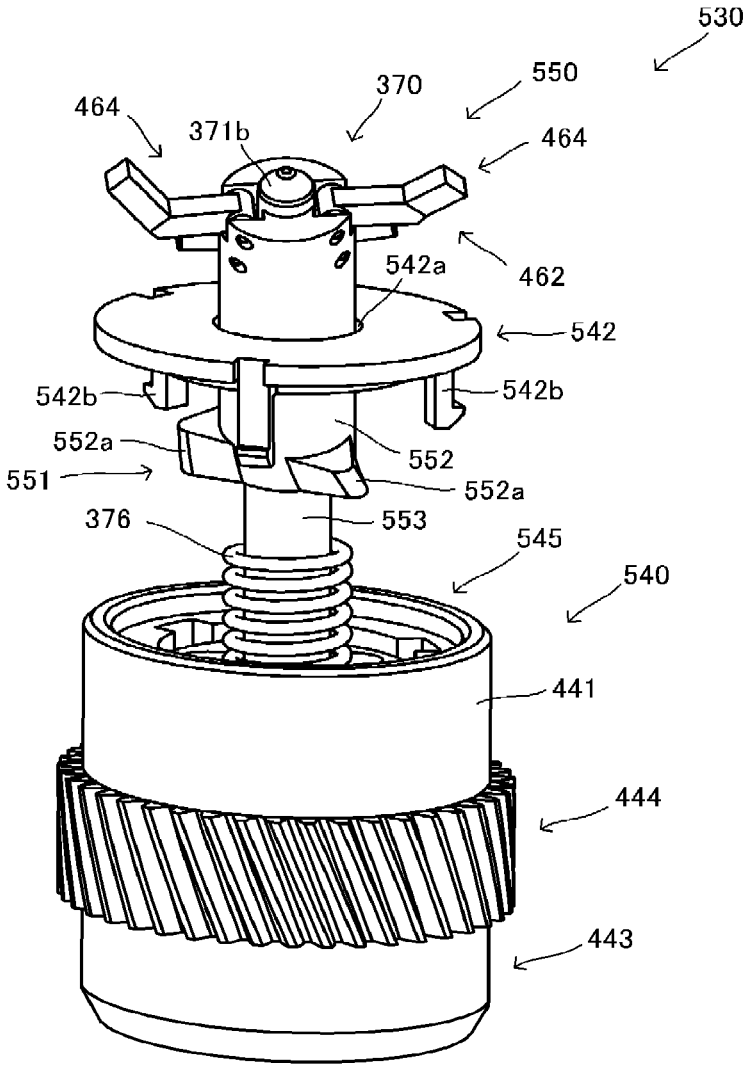
FIG. 52 is an exploded perspective view of an end member 530.

Subsequently, a sixth embodiment will be described. FIG. 52 is an exploded perspective view of an end member 530 included in the sixth embodiment. Similar to the end member 30, the end member 530 is a member which is attached to an end on the side opposite to the above-described lid member 20, between the ends of the photosensitive drum 11, and includes a bearing member 540 and a shaft member 550.

Figure 53A:
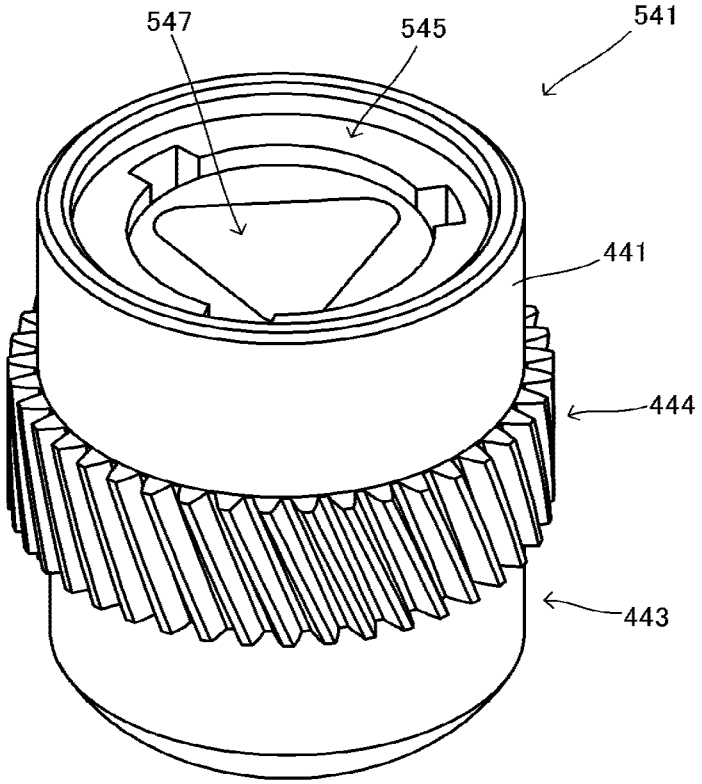
FIG. 53A is a perspective view of a body 541 of a bearing member 540.
Figure 53B:
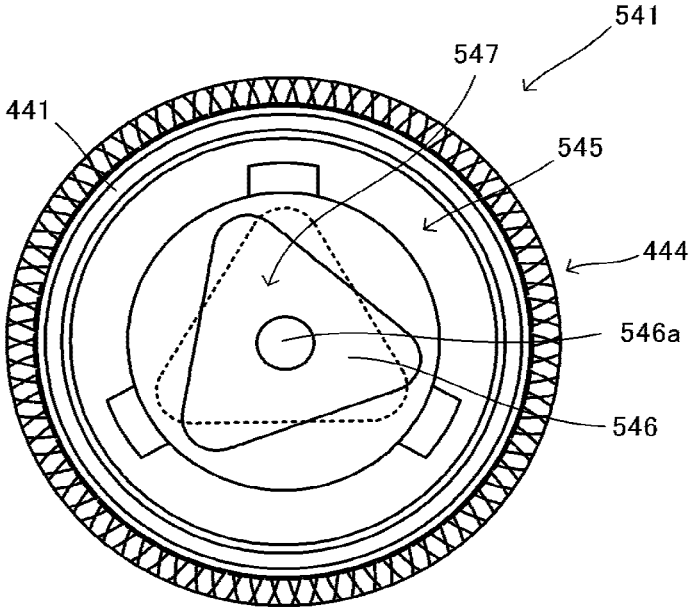
FIG. 53B is a plan view of the body 541 of the bearing member 540.

The bearing member 540 is a member which is bonded to the end of the photosensitive drum 11, in the end member 530. FIG. 53A illustrates a perspective view of a body 541 of the bearing member 540, and FIG. 53B illustrates a plan view of the body 541.

The bearing member 540 includes the body 541 and a lid member 542. As seen in FIGS. 52 and 53A, the body 541 is configured to include the tubular body 441, the fitting portion 443, the gear potion 444, and a shaft member holding portion 545.

The tubular body 441, the fitting portion 443, and the gear potion 444 are similar as those in the end member 430 described above. Therefore, the same reference numerals are applied and the descriptions will be omitted.

The shaft member holding portion 545 is a member which is formed inside the tubular body 441 and functions to cause the shaft member 550 to be held by the bearing member 540 while ensuring a predetermined operation of the shaft member 550. The shaft member holding portion 545 also functions as means for moving and turning the rotary power reception member 462. The shaft member holding portion 545 includes a bottom plate 546 and a spiral portion 547 of which the cross section is a space which is distorted in the axial line direction.

The bottom plate 546 is a disk-like member and is arranged so as to block and partition at least a portion groove of the inside of the tubular body 441, thereby supporting the shaft member 550. In the present embodiment, a penetration hole 546*a* is provided in the center thereof. In accordance with the end member 530, a second turning shaft 553 included in a turning shaft 551 of the shaft member 550 is inserted into the penetration hole 546*a* (refer to FIG. 46). Attachment of the bottom plate 546 with respect to the tubular body 441 can be performed by gluing, welding, or the like. In addition, the tubular body 441 and the bottom plate 546 may be formed integrally with each other.

The spiral portion 547 is a space formed inside the tubular body 441. As seen in FIG. 53B, in the present embodiment, the cross section orthogonal to the axial line direction is a substantially triangle, and the cross section is formed so as to gradually rotate while being centered around the axial line, along the axial line direction, thereby configuring a so-called distorted space having a triangular prism shape (in FIG. 53B, an opening edge of the spiral portion is indicated by a solid line, and the cross section at an inner side in the axial line direction in an example is indicated by a dotted line).

A portion of one end of a spiral groove 547 in the longitudinal direction is blocked by the bottom plate 546, and a portion of the other end on the opposite side is blocked by the lid member 542.

The lid member 542 is a circular plate-like member which is arranged on a side opposite to the bottom plate 546 interposing the shaft member holding portion 545, and a penetration hole 542*a* is included in the center thereof. In the present embodiment, a claw 542*b* is included therein, and the claw 542*b* engages with the body 441, thereby being fixed thereto by so-called snap-fitting. However, the mean for fixing a lid is not limited thereto. As another type of means therefor, it is possible to use an adhesive or to perform welding by heat or ultrasound waves.

Figure 54:
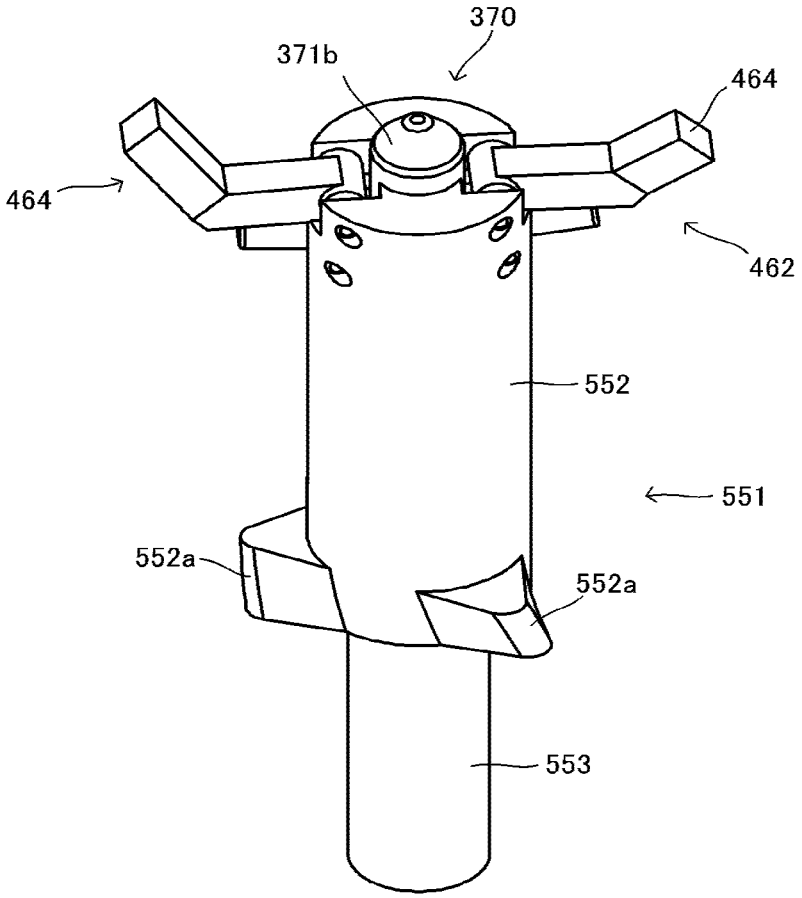
FIG. 54 is a perspective view of a turning shaft 551, a rotary power reception member 462, and a regulation member 370.

As seen in FIG. 52, the shaft member 550 is configured to include the turning shaft 551, the rotary power reception member 462, the regulation member 370, and the elastic member 376 for a turning shaft. Here, in the present embodiment, the elastic member 376 for a turning shaft is a helical spring. Here, the rotary power reception member 462, the regulation member 370, and the elastic member 376 for a turning shaft are the same as the above-described members, the same reference numerals are applied and the descriptions will be omitted. FIG. 54 shows a perspective view of the turning shaft 551, the rotary power reception member 462, and the regulation member 370.

The turning shaft 551 is a member which transmits rotary power from the rotary power reception member 462 to the bearing member 540. As seen in FIG. 54, the turning shaft 551 includes a cylindrical first turning shaft 552 and the columnar second turning shaft 553 which has the outer diameter smaller than that of the first turning shaft 552. The turning shaft 551 has a structure in which the two turning shafts 552, 553 are coaxially arranged and are connected to each other at the ends.

In the first turning shaft 552, three projections 552*a* are arranged on the side surface at an end on the side connected to the second turning shaft 553. The three projections 552*a* are arrayed at equal intervals around the axial line of the cylinder (at intervals of 120°), in the outer circumferential portion of the cylinder of the first turning shaft 552. Then, each of the projections 552*a* has a distorted shape corresponding to the shape of the spiral groove 547.

The bearing member 540 and the shaft member 550 described above are also assembled in accordance with the aforementioned end member 430. In this case, the projections 552*a* are arranged in the spiral groove 547 and operate similarly to the end member 430.

Figure 55:
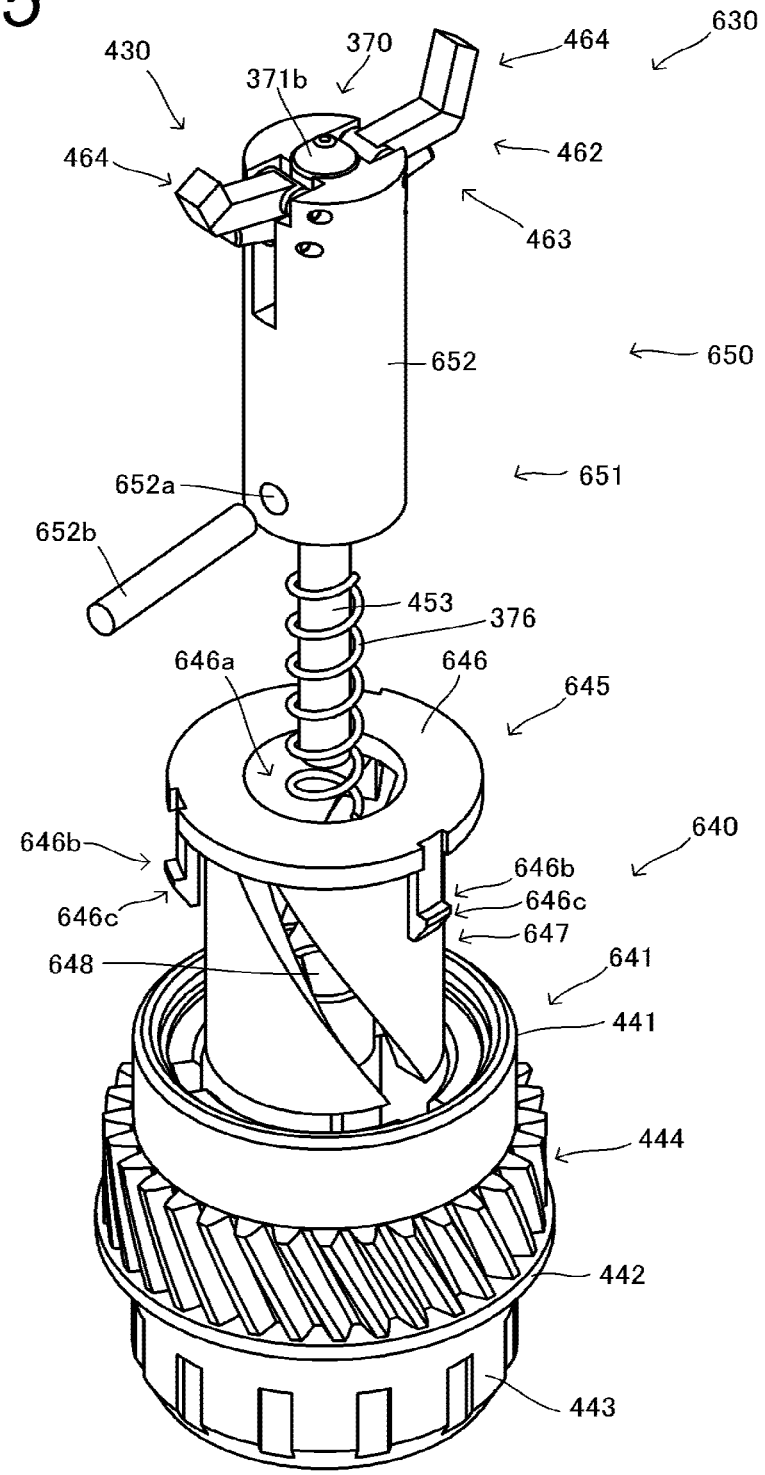
FIG. 55 is a perspective view of an end member 630.

Subsequently, a seventh embodiment will be described. FIG. 55 shows an exploded perspective view of an end member 630 included in the seventh embodiment. The elements other than the end member 630 are the same as those in the first embodiment. Therefore, the descriptions will be omitted. The end member 630 is also configured to include a bearing member 640 and a shaft member 650.

The bearing member 640 is bonded to an end of the photosensitive drum 11, in the end member 630. The bearing member 640 is a member which holds the shaft member 650. In the present embodiment, in the bearing member 640, a bearing member body 641 and a shaft member holding member 645 are configured to be separate members being connected to each other in an attachable and detachable manner.

Figure 56A:
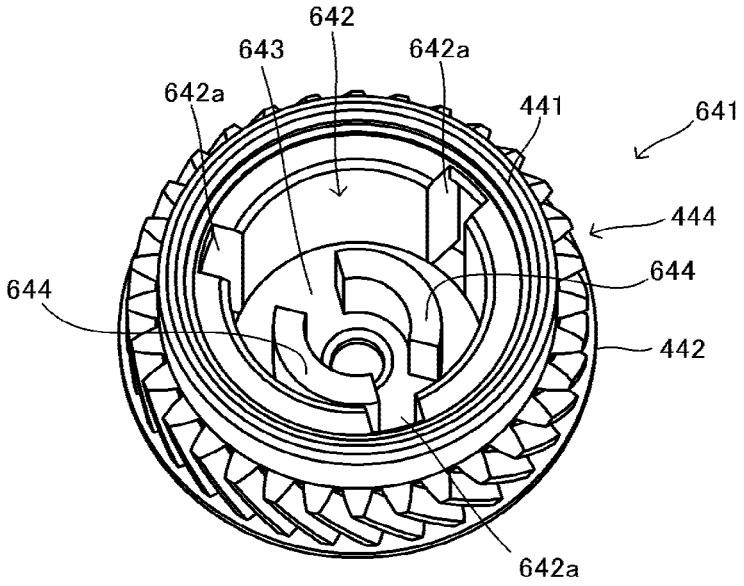
FIG. 56A is a perspective view of a bearing member body 641.
Figure 56B:
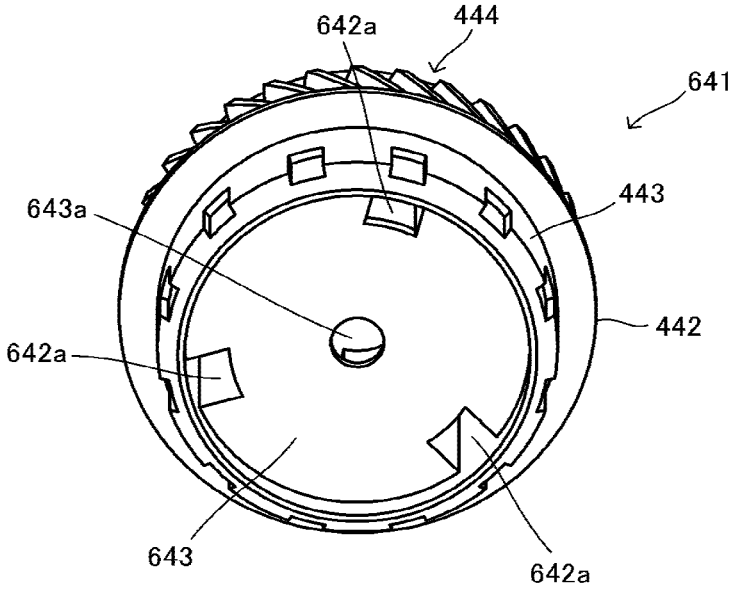
FIG. 56B is another perspective view of the bearing member body 641 seen from another view point.
Figure 57A:
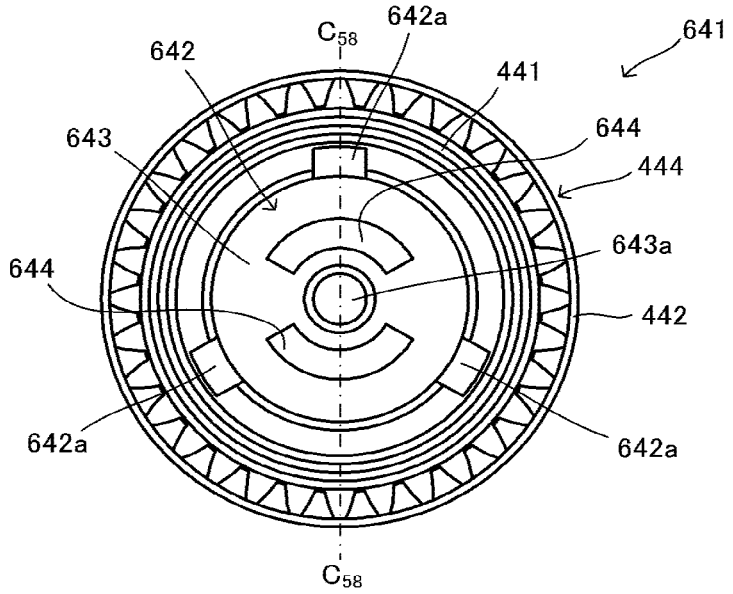
FIG. 57A is a plan view of the bearing member body 641.
Figure 57B:
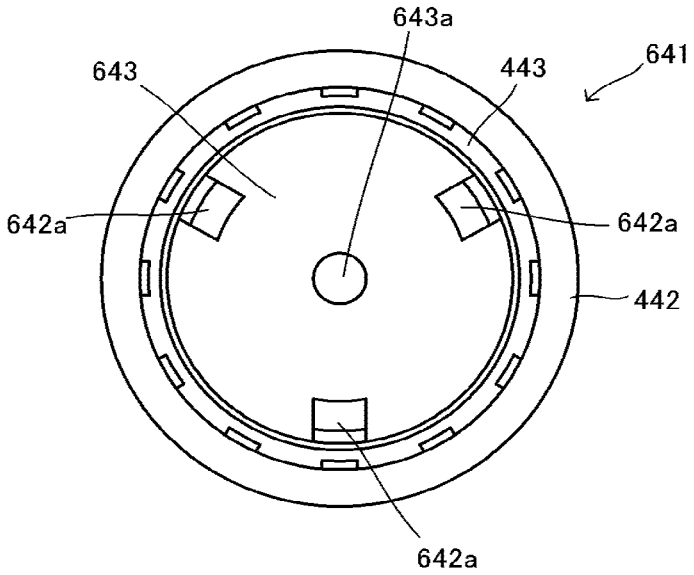
FIG. 57B is a bottom view of the bearing member body 641.
Figure 58:
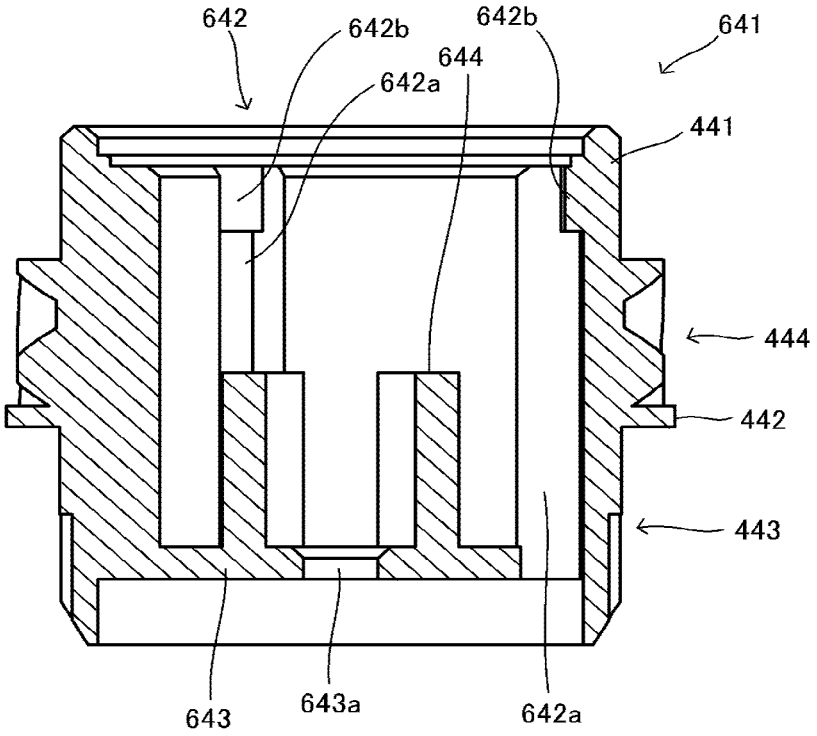
FIG. 58 is a cross-sectional view of the bearing member body 641.

FIG. 56A illustrates a perspective view of the bearing member body 641 seen from the side where the shaft member holding member 645 is inserted, and FIG. 56B illustrates a perspective view of the bearing member body 641 seen from the opposite side. In addition, FIG. 57A illustrates a plan view of the bearing member body 641 seen from the side where the shaft member holding member 645 is inserted, and FIG. 57B illustrates a bottom view of the bearing member body 641 seen from the opposite side. Moreover, FIG. 58 shows a cross-sectional view indicated by line $C_{58}$-$C_{58}$ in FIG. 57A.

The bearing member body 641 is configured to include the tubular body 441, the contact wall 442, the fitting portion 443, the gear potion 444, and a shaft member holding member attachment portion 642. The tubular body 441, the contact wall 442, the fitting portion 443, and the gear potion 444 are as described above. Therefore, herein, the same reference numerals are applied and the descriptions will be omitted.

The shaft member holding member attachment portion 642 is formed inside the tubular body 441. The shaft member holding member attachment portion 642 is a portion which functions to hold the shaft member holding member 645 inside the tubular body 441 of the bearing member body 641. In addition, the shaft member holding member attachment portion 642 functions as one type of means for moving and turning the rotary power reception member 462. In the present embodiment, the shaft member holding member attachment portion 642 includes engagement grooves 642*a*, a bottom plate 643, and a protrusion portion 644.

The engagement grooves 642*a* are grooves provided on the inner surface of the tubular body 441 and extend throughout the overall length of the tubular body 441 in the axial line direction with the direction along the axial line as the longitudinal direction of the tubular body 441. Therefore, as seen in FIG. 56B, the engagement grooves 642*a* are provided so as to penetrate the bottom plate 643. Accordingly, the bearing member body 641 is easily fabricated through an injection molding.

The engagement groove 642*a* functions as a portion of the so-called snap-fit structure which engages with an engagement claw 646*b* provided in the shaft member holding member 645. Therefore, as seen in FIG. 58, a protrusion portion 642*b* is provided on the bottom surface of the end on a side opposite to the bottom plate 643 side, in the engagement groove 642*a*. The engagement claw 646*b* engages with the protrusion portion 642*b*. The protrusion portion 642*b* is provided so as to protrude from the bottom surface of the engagement groove 642*a*. The protrusion portion 642*b* is embodied to include an undercut portion.

As seen in FIGS. 56B and 58, the bottom plate 643 is an annular member, which is arranged so as to block and partition the inside of the tubular body 441. Therefore, a penetration hole 643*a* is provided in the center thereof. The second turning shaft 453 of a turning shaft 651 is inserted into the penetration hole 643*a*. Attachment of the bottom plate 643 with respect to the tubular body 441 can be performed by gluing, welding, or the like. In addition, the tubular body 441 and the bottom plate 643 may be formed integrally with each other.

A protrusion portion 644 is a ring-like projection which stands upright from the surface that becomes the side of the shaft member holding member attachment portion 642, in the bottom plate 643. The protrusion portion 644 is arranged so as to cause the central axis of the annular shape to coincide with the axial line of the tubular body 441. In addition, in the present embodiment, portions of the protrusion portion 644 are cut open.

Figure 59:
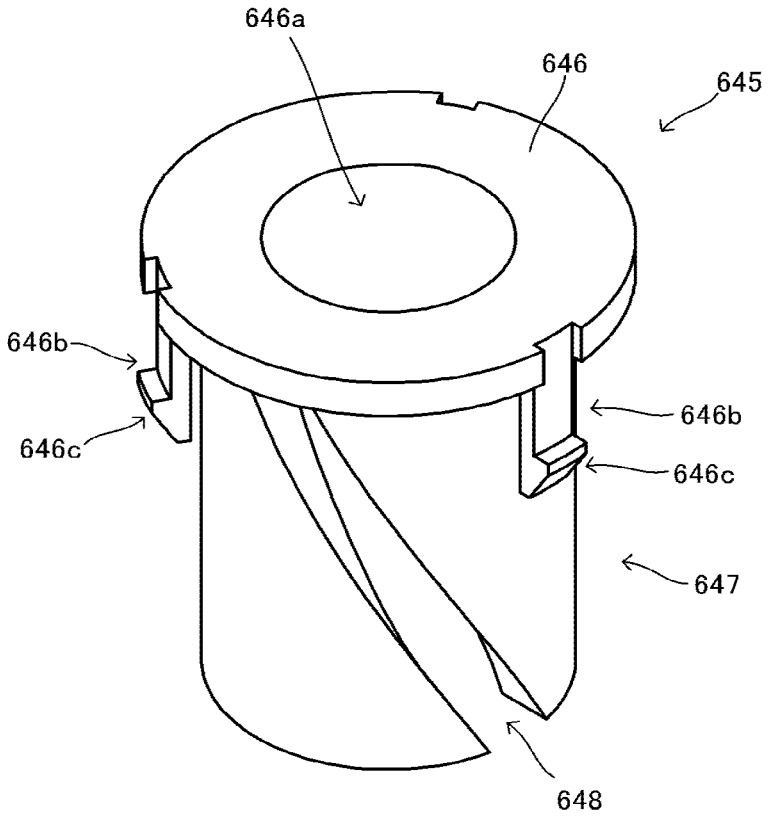
FIG. 59 is a perspective view of a shaft member holding member 645.
Figure 60A:
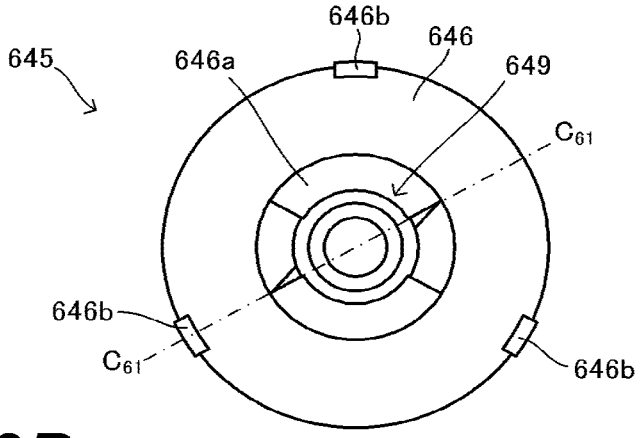
FIG. 60A is a plan view of the shaft member holding member 645.
Figure 60B:
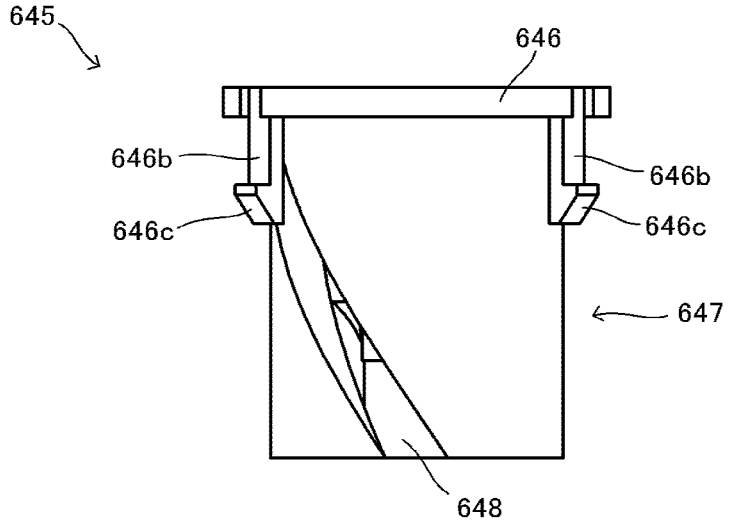
FIG. 60B is a front view of the shaft member holding member 645.
Figure 60C:
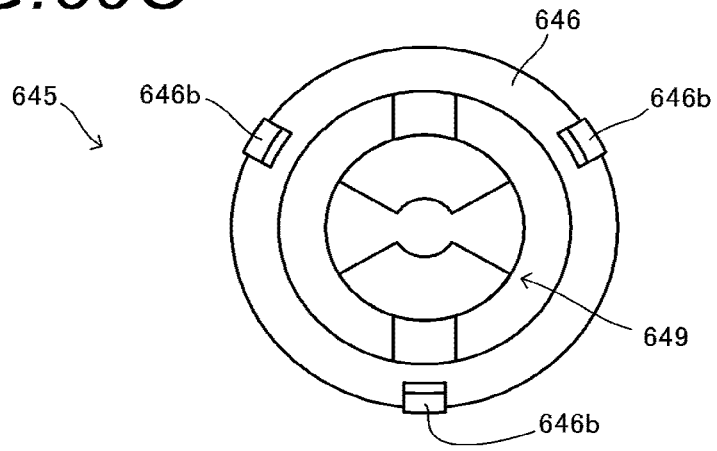
FIG. 60C is a bottom view of the shaft member holding member 645.

The shaft member holding member 645 is configured to include a lid 646 and a spiral portion 647. FIG. 59 is a perspective view of the appearance of the shaft member holding member 645. FIG. 60A is a plan view of the shaft member holding member 645, FIG. 60B is a front view of the shaft member holding member 645, and FIG. 60C is a bottom view of the shaft member holding member 645. In addition, FIG. 61 shows a cross-sectional view taken along line $C_{61}$-$C_{61}$ indicated in FIG. 60A.

Figure 62:
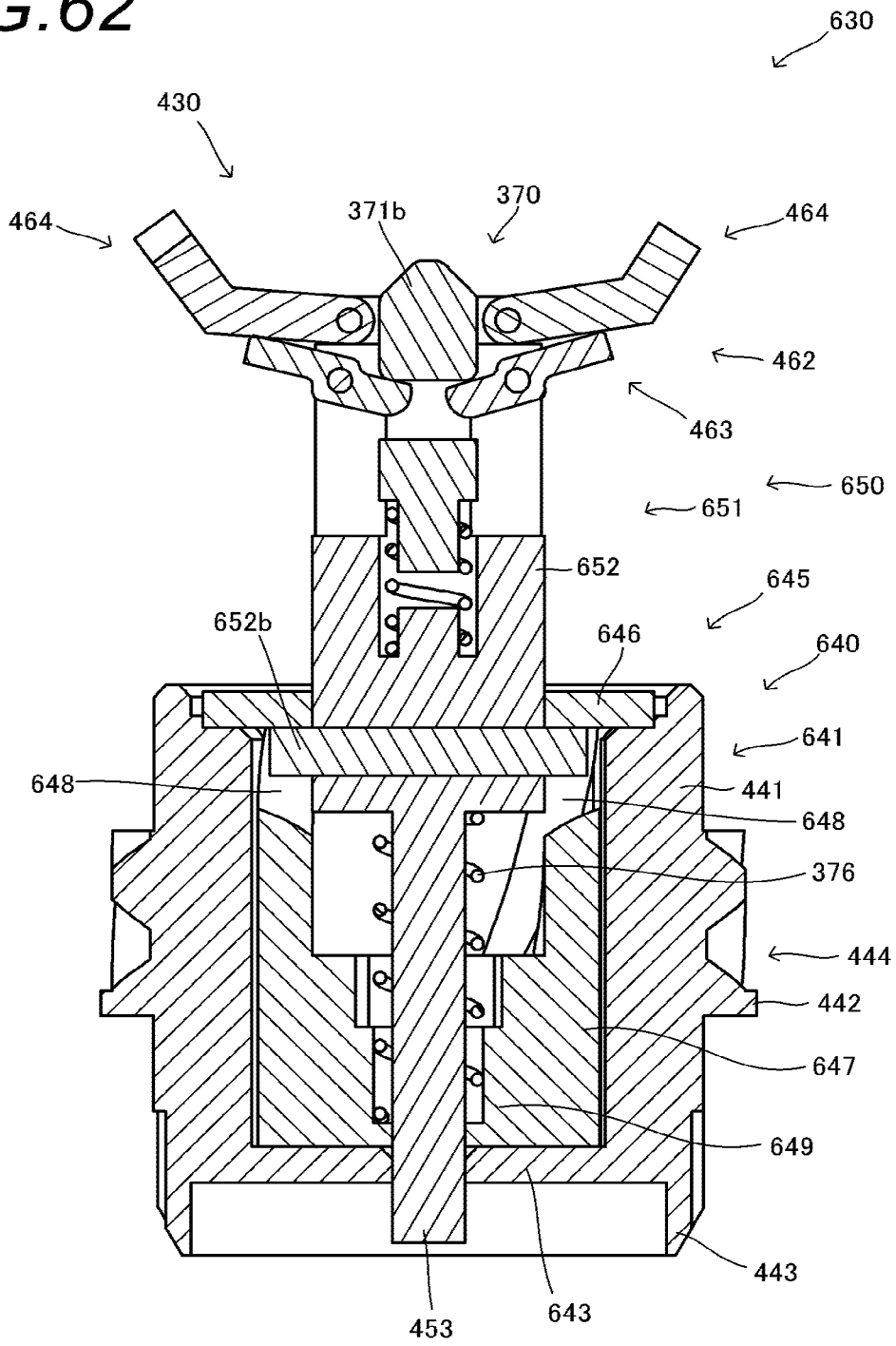
FIG. 62 is a cross-sectional view of the end member 630.

The lid 646 is an annular member which is arranged at a predetermined interval with respect to the bottom plate 643 in the axial line direction, in a posture in which the shaft member holding member 645 is attached to the bearing member body 641 (refer to FIG. 62). The lid 646 is arranged so as to block and partition the inside of the tubular body 441. Therefore, a penetration hole 646*a* is provided in the center thereof. A first turning shaft 652 of the turning shaft 651 is inserted into the penetration hole 646*a*. In addition, the lid 646 is provided with the engagement claw 646*b* in order to be attached to the tubular body 441. The engagement claw 646*b* is inserted into the engagement groove 642*a* of the bearing member body 641 and engages with the protrusion portion 642*b* (refer to FIG. 58) which is provided therein. In the present embodiment, three engagement claws 646*b* are provided at equal intervals in the outer circumference of the lid 646. As seen in FIG. 60B, the distal end of lid 646 includes a protrusion portion 646*c*. Accordingly, the protrusion portion 646*c* of the engagement claw 646*b* engages with the protrusion portion 642*b* of the engagement groove 642*a* so as to be caught therein, thereby configuring the so-called snap-fit structure. The protrusion portion 646*c* of the engagement claw 646*b* is provided so as to protrude and is embodied to include the undercut portion.

The spiral portion 647 is a cylindrical member for forming spiral grooves 648. In other words, the spiral portion 647 has a cylindrical shape which is arranged coaxially with the lid 646 from one surface of the lid 646. The wall of the spiral portion 647 is provided with two spiral grooves 648 which are slits formed to have spiral shapes. The slits extend in the axial line direction. One end side and the other end side of the wall in the extending direction are distorted so as to be misaligned in a direction along the circumference. In the present embodiment, the two spiral grooves 648 are formed at positions opposite to each other interposing the axial line. The concept of the spiral groove is the same as that of each example described so far.

Figure 61:
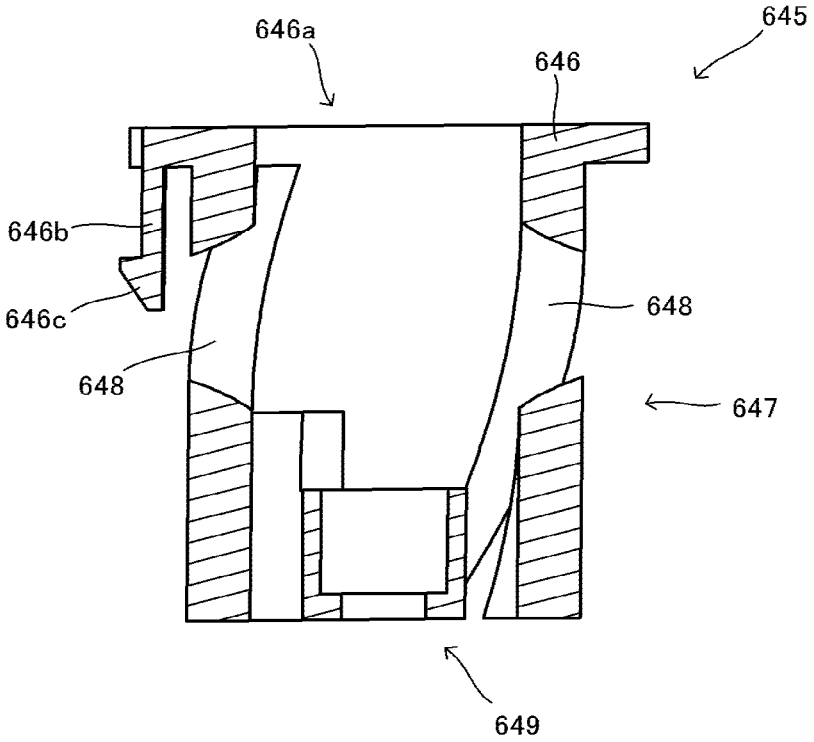
FIG. 61 is a cross-sectional view of the shaft member holding member 645.

In addition, as seen in FIGS. 60A, 60C, and 61, in the spiral portion 647, the tubular body 649 is arranged in the inner end on the side opposite to the side in which the lid 646 is arranged. As seen in FIG. 61, the tubular body 649 is coaxial with the spiral portion 647, and both the ends in the axial line direction are open. However, in the openings, the opening on the side opposite to the lid 646 is narrowed. In addition, as seen clearly in FIG. 60C, a portion of the wall of the tubular body 649 is cut open. As described below, the elastic member 376 for a turning shaft is held in the tubular body 649.

The material configuring the bearing member 640 can be considered to be similar as that of the above-described bearing member 440.

Returning to FIG. 55, the shaft member 650 will be described. As seen in FIG. 55, the shaft member 650 is configured to include the turning shaft 651, the rotary power reception member 462, the regulation member 370, and the elastic member 376 for a turning shaft. Here, in the present embodiment, the elastic member 376 for a turning shaft is a helical spring. In addition, since the regulation member 370, and the elastic member 376 for a turning shaft, and the rotary power reception member 462 are the same as the above-described members, the same reference numerals are applied and the descriptions will be omitted.

The turning shaft 651 is a member which transmits rotary power from the rotary power reception member 462 to the bearing member 640. As seen in FIG. 55, the turning shaft 651 includes the tubular first turning shaft 652 and the tubular second turning shaft 453 which has the outer diameter smaller than that of the first turning shaft 652. The turning shaft 651 has a structure in which the two turning shafts 652 and 653 are coaxially arranged and are connected to each other at the ends.

In the first turning shaft 652, a hole 652*a* which penetrates the first turning shaft 652 in the diameter direction is provided on a side surface of an end on the side connected to the second turning shaft 453, and a pin 652*b* is inserted into the hole 652*a*. The pin 652*b* is formed to be longer than the diameter of the first turning shaft 652. While the pin 652*b* is in a posture of being inserted into the hole 652*a* of the first turning shaft 652, both the ends of the pin 652*b* protrude further than the side surface of the first turning shaft 652 and operates similarly to the above-described two projections 452*a*.

The bearing member 640 and the shaft member 650 are assembled as follows, thereby configuring the end member 630. Through the descriptions regarding the assembly, it is possible to understand the size of each of the members and the portions, the structure, and the relationship between the sizes of the members and portions. FIG. 62 is a cross-sectional view taken along the axial line direction of the end member 630.

As seen in FIG. 62, in the bearing member 640, the shaft member holding member 645 is inserted into the bearing member body 641. In this case, the lid 646 of the shaft member holding member 645 is inserted so as to be on the side opposite to the bottom plate 643 of the bearing member body 641, and the lid 646 is arranged so as to shut the opening of the bearing member body 641. In this case, the protrusion portion 646*c* of the engagement claw 646*b* of the lid 646 is inserted into the engagement groove 642*a* of the bearing member body 641 and engages with the protrusion portion 642*b*.

Meanwhile, in the turning shaft 651, the second turning shaft 453 is inserted toward the bottom plate 643 of the bearing member body 641, thereby passing and penetrating the penetration hole 643*a* of the bottom plate 643 and the tubular body 649 of the shaft member holding member 645. In addition, the first turning shaft 652 passes through the penetration hole 646*a* of the lid 646. In this case, the projection formed with the pin 652*b* from the side surface of the first turning shaft 652 is inserted into the spiral groove 648 which is formed in the spiral portion 647 of the shaft member holding member 645, as illustrated in FIG. 62.

In addition, as seen in FIG. 62, inside the bearing member 640, the second turning shaft 453 passes through the inside of the elastic member 376 for a turning shaft, and the elastic member 376 for a turning shaft is arranged in a position between a portion at which the opening is narrowed and the edge, in the tubular body 649 of the shaft member holding member 645. Therefore, the elastic member 376 for a turning shaft is held in the tubular body 649. One side thereof comes into contact with the first turning shaft 652, and the other side comes into contact with the shaft member holding member 645. Accordingly, the turning shaft 651 is urged in a direction in which the elastic member 376 for a turning shaft urges the turning shaft 651 so as to cause the turning shaft 651 to protrude from the bearing member 640. However, the projection formed by the pin 652*b* is inserted into the spiral groove 648 of the bearing member 640, and both the ends of the spiral groove 648 are blocked by the bottom plate 643 and the lid 646. Therefore, the turning shaft 651 is held in an urged state without coming off from the bearing member 640.

As described above, in the posture in which each of the members is assembled, the axial lines of the bearing member 640 and the turning shaft 651 coincide with each other.

Figure 63B:
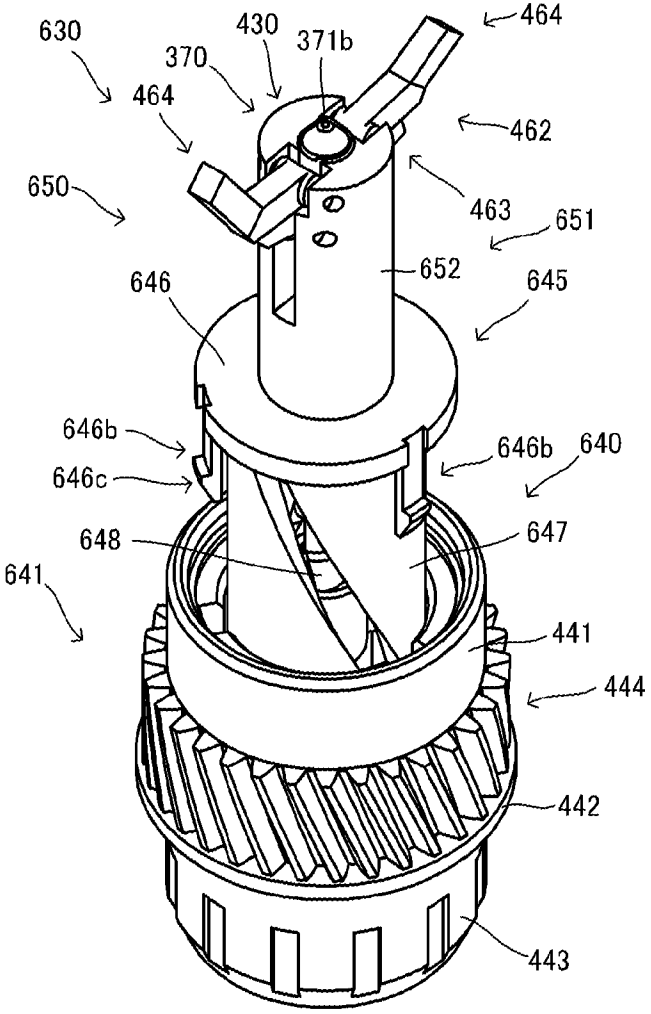
FIG. 63B is a perspective view illustrating another instance in which the end member 630 is assembled.
Figure 63A:
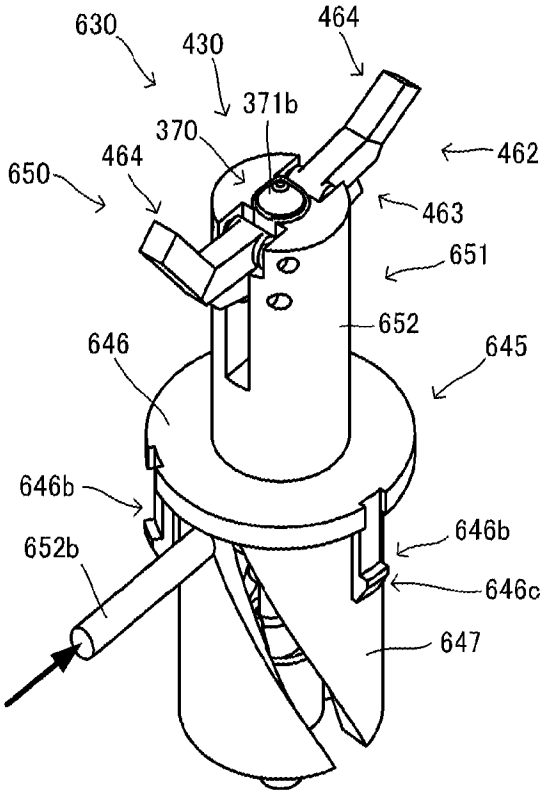
FIG. 63A is a perspective view illustrating an instance in which the end member 630 is assembled.

Here, for example, the end member 630 can be assembled as follows. FIGS. 63A and 63B show explanatory perspective views. FIG. 63A shows an instance in which the shaft member 650 is assembled with the shaft member holding member 645, and FIG. 63B shows an instance in which the aforementioned assembly is further assembled with the bearing member body 641.

As seen in FIG. 63A, the shaft member 650 in a state having the pin 652*b* detached is inserted into the shaft member holding member 645 together with the elastic member 376 for a turning shaft. In this case, the position of the penetration hole 652*a* provided in the first turning shaft 652 is positioned so as to coincide with the position of the spiral groove 648 of the shaft member holding member 645. Then, as indicated by the straight line arrow in FIG. 63A, the pin 652*b* is caused to penetrate the spiral groove 648 and is inserted to the penetration hole 652*a*. Accordingly, the shaft member 650 and the shaft member holding member 645 are assembled with each other so as to not be detached from each other.

Then, as seen in FIG. 63B, the shaft member 650 and the shaft member holding member 645 which are assembled with each other are assembled with the bearing member body 641.

As described above, it is possible to efficiently assemble the end member 630. In other words, assemblability can be improved.

The end member 630 also operates similarly to the above-described end member 430. Moreover, in accordance with such an end member 630, as the shaft member holding member 645 is detached from the bearing member body 641, the shaft member 650 can be easily detached from the bearing member 640, and thus, it is possible to achieve an improvement in reusability.

Figure 64:
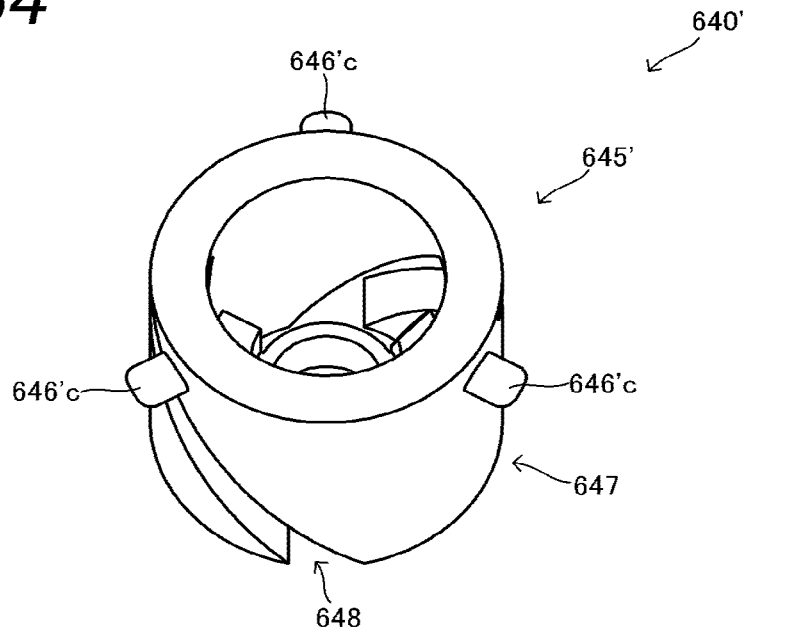
FIG. 64 is a diagram illustrating a first modification example of the end member 630, showing a perspective view of the appearance of a shaft member holding member 645' and a bearing member body 641'.
Figure 64:
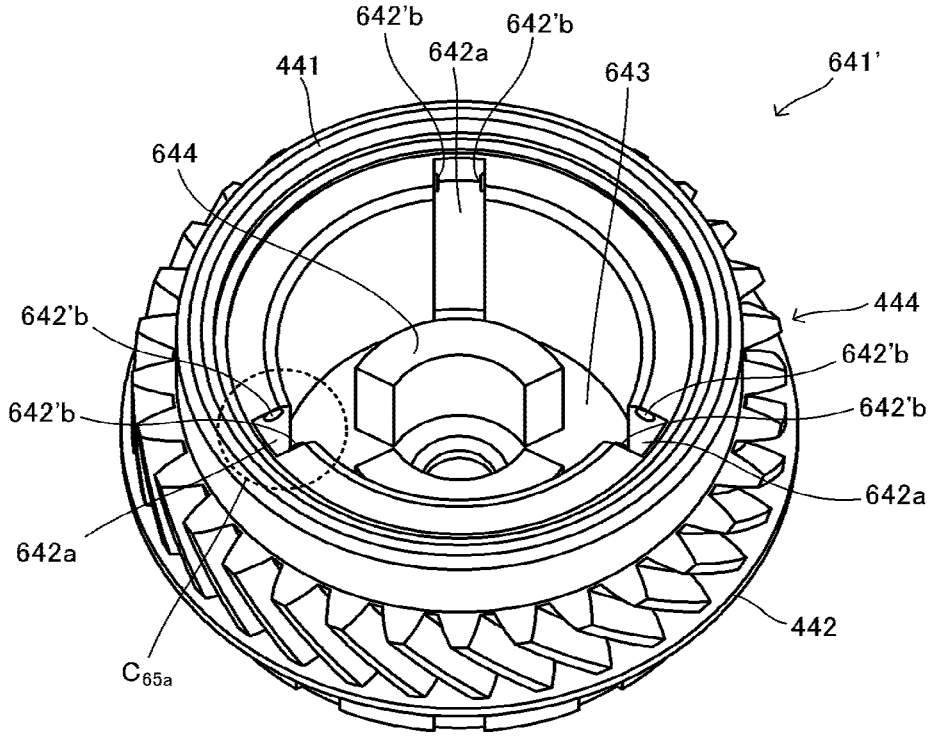

FIG. 64 illustrates an exploded perspective view of a bearing member 640' in the end member which is a first modification example of the end member 630. As seen in FIG. 64, the bearing member 640' includes a bearing member body 641' and a shaft member holding member 645'. Since the shaft member is the same as the above-described shaft member 650, illustration and descriptions will be omitted.

In the first modification example, the bearing member body 641' is provided with protrusion portions 642'*b* in place of the protrusion portion 642*b* which is included in the engagement groove 642*a* of the bearing member body 641. In addition, in the first modification example, a shaft member holding member 645' is provided with a protrusion portion 646'*c* in place of the protrusion portion 646*c* of the shaft member holding member 645. Since other configurations can be formed in accordance with the example of the bearing member 640, herein, the protrusion portions 642'*b* and the protrusion portion 646'*c* will be described.

Figure 65A:
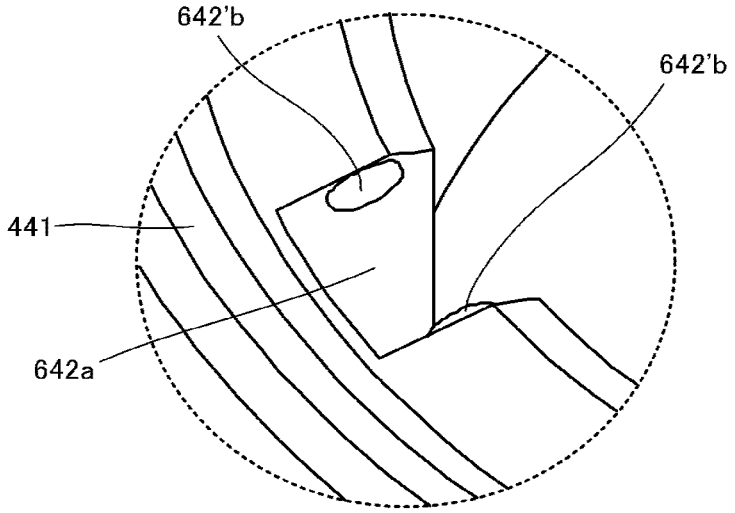
FIG. 65A is a partially enlarged view of the bearing member body 641'.

FIG. 65A shows an enlarged diagram of the portion indicated by $C_{65a}$ in FIG. 64. As seen in FIG. 65A, the bearing member body 641' is provided with two protrusion portions 642'*b* which face each other on the walls of the side surface of the groove in the end on the side opposite to the bottom plate 643, in the engagement groove 642*a* thereof. The groove width of the engagement groove 642*a* is caused to be narrow, thereby configuring a portion of the so-called snap-fit structure. The protrusion portions 642'*b* is provided so as to protrude from the side surface of the engagement groove 642*a* and is embodied to include the undercut portion.

Meanwhile, as seen in FIG. 64, the shaft member holding member 645' is provided with the protrusion portion 646'*c* which is a projection standing upright from the side surface of the spiral portion 647. The protrusion portion 646'*c* is provided at a position of being inserted into the engagement groove 642*a* in a posture in which the shaft member holding member 645' is assembled in the bearing member body 641'. Then, in terms of the size, the protrusion portion 646'*c* is thinner than the engagement groove 642*a* and is thicker than the gap between the protrusion portions 642'*b* provided in the engagement groove 642*a*. Accordingly, the protrusion portions 642'*b* and the protrusion portion 646'*c* configure the snap-fit structure.

Figure 65B:
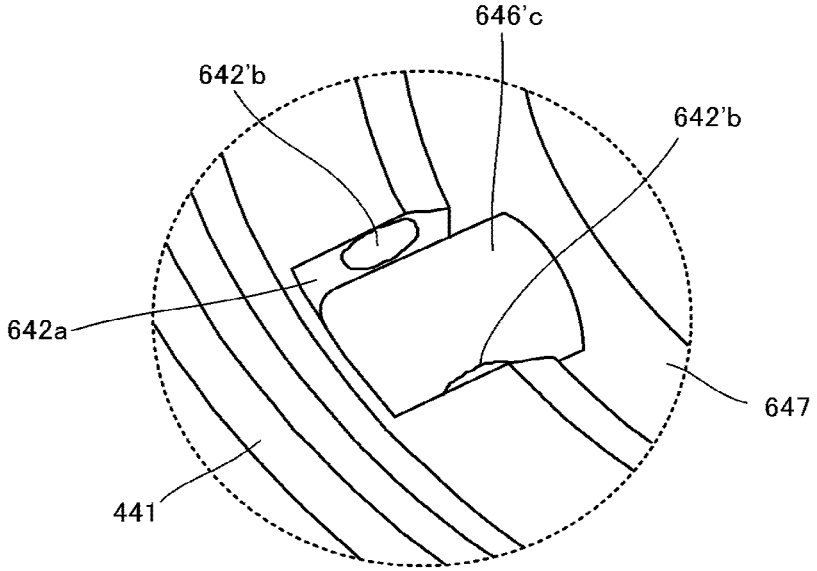
FIG. 65B is a partially enlarged view of an instance in which the shaft member holding member 645' is assembled in the bearing member body 641'.

The assembly of the shaft member holding member 645' with respect to the bearing member body 641' is similar to the above-described end member 630. However, in the first modification example, as illustrated in FIG. 65B, the assembly is carried out by performing engagement so as to cause the protrusion portion 646'*c* to be caught in the protrusion portions 642'*b*.

The end member of the present example also operates similarly to the above-described end member 630.

Figure 66:
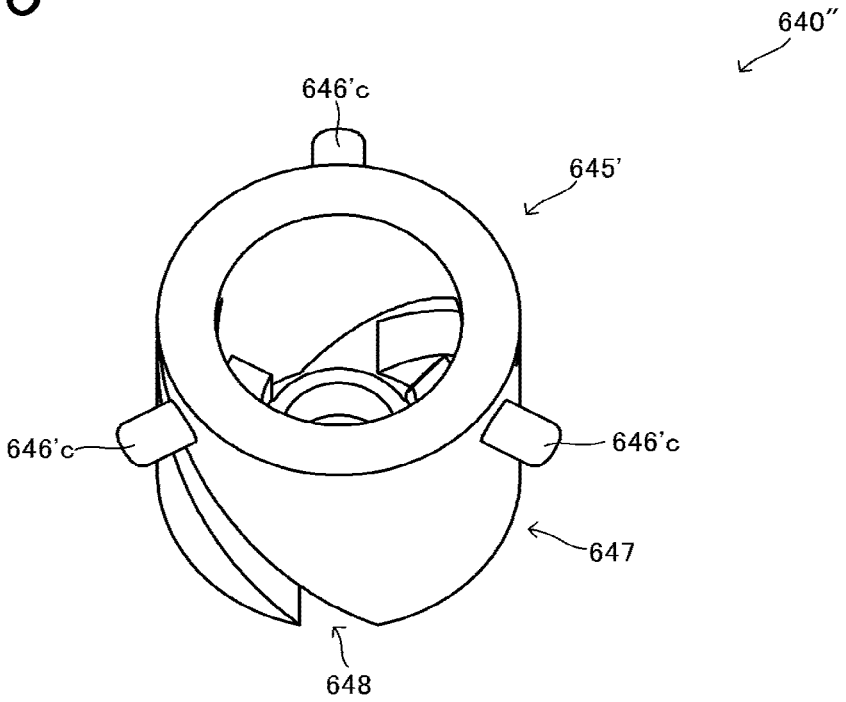
FIG. 66 is a diagram illustrating a second modification example of the end member 630, showing a perspective view of the appearance of a shaft member holding member 645" and a bearing member body 641"
Figure 66:
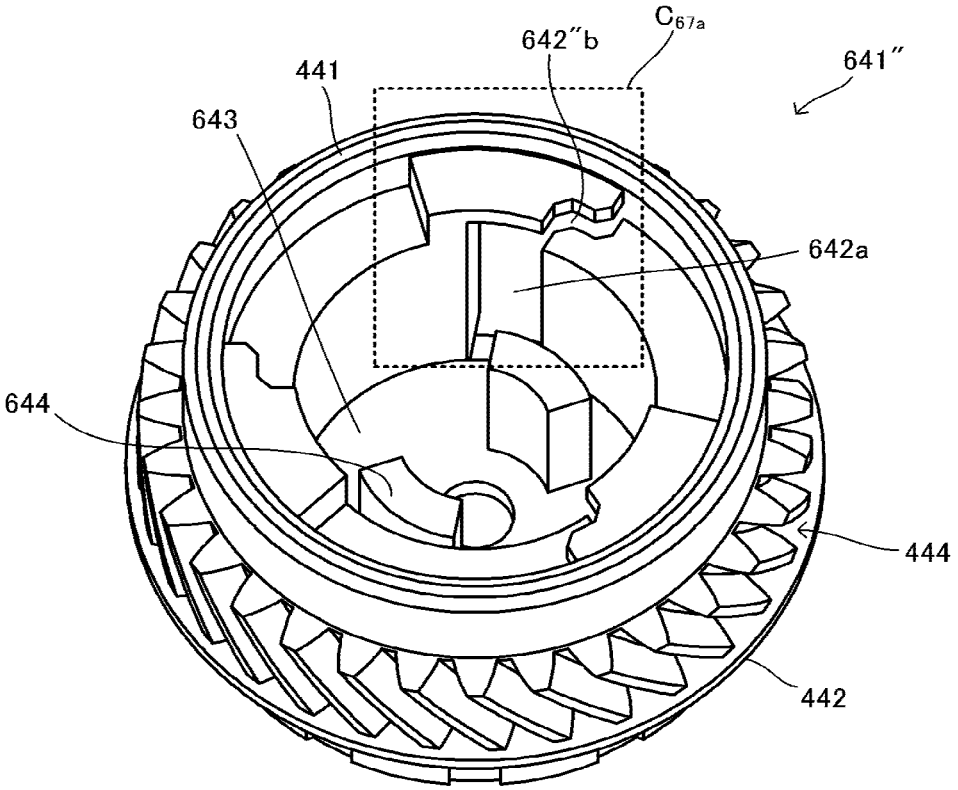

FIG. 66 illustrates an exploded perspective view of a bearing member 640" in the end member which is a second modification example of the end member 630. As seen in FIG. 66, the bearing member 640" includes a bearing member body 641" and the shaft member holding member 645'. As seen in FIG. 66 as well, in the second modification example, the shaft member holding member 645' is embodied to be the same as that in the first modification example, but the bearing member body is different therefrom. Therefore, herein, the bearing member body 641" will be described.

In the second modification example, the bearing member body 641" is provided with an introduction groove 642"*b* which continues from the end of the engagement groove 642*a* and extends along the inner circumferential direction of the tubular body 441, in place of the protrusion portion 642*b* which is included in the engagement groove 642*a* of the bearing member body 641. Since other configurations can be formed in accordance with the example of the bearing member 640, herein, the introduction groove 642"*b* will be described.

Figure 67A:
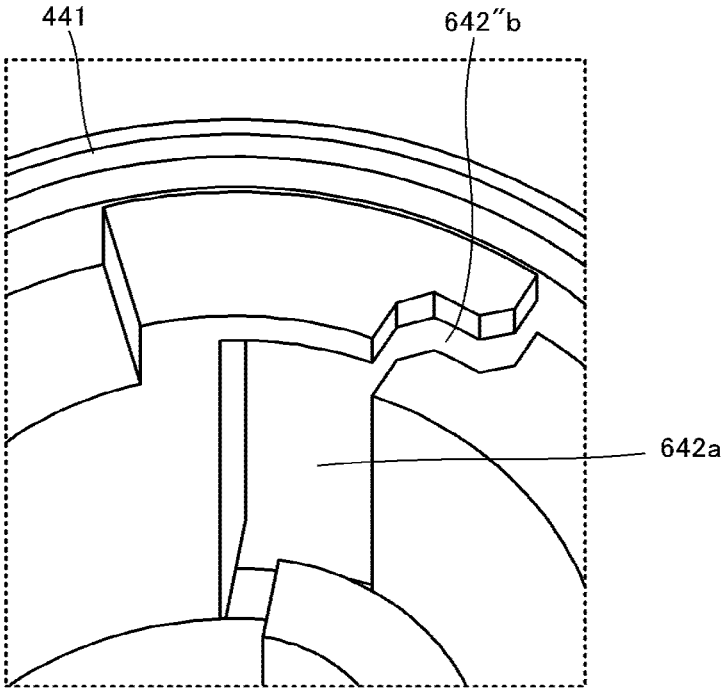
FIG. 67A is a partially enlarged view of the bearing member body 641"

FIG. 67A shows an enlarged diagram of the portion indicated by $C_{67a}$ in FIG. 66. As seen in FIG. 67A, the bearing member body 641" is provided with the introduction groove 642"*b* of which the end on the side opposite to the bottom plate 643 is shut, in the engagement groove 642*a* thereof. The introduction groove 642"*b* extends in the circumferential direction of the tubular body 441 continuously from the side surface of the engagement groove 642*a* in the end. The end of the introduction groove 642"*b* on the side opposite to the side which continues to the engagement groove 642*a* is open.

Figure 67B:
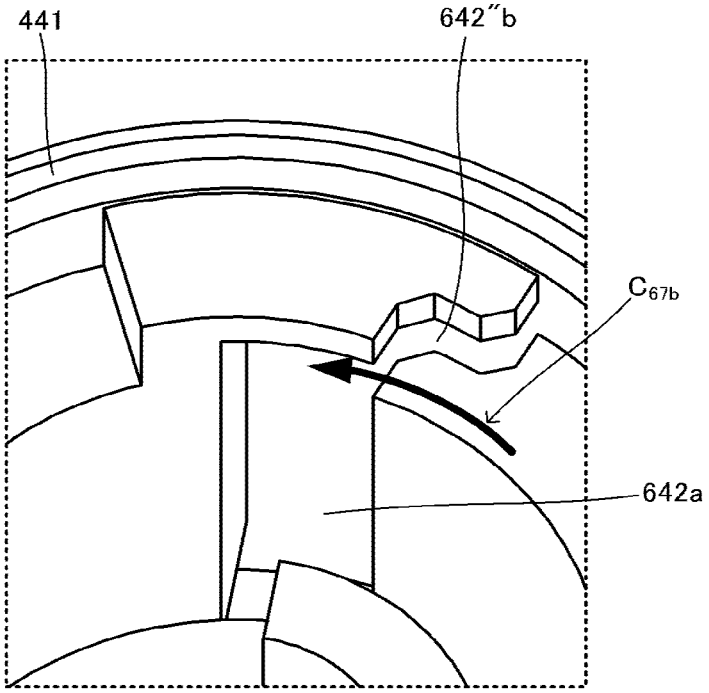
FIG. 67B is a diagram illustrating an instance in which the shaft member holding member 645" is assembled in the bearing member body 641"

When the shaft member holding member 645' is assembled with respect to the bearing member body 641", the protrusion portion 646'*c* of the shaft member holding member 645' is first arranged in the vicinity of the opening portion of the introduction groove 642"*b*. Thereafter, the shaft member holding member 645' rotates while being centered around the axial line thereof, and the protrusion portion 646'*c* moves in the introduction groove 642"*b* as indicated by Arrow $C_{67b}$ in FIG. 67B. Accordingly, the protrusion portion 646'*c* moves in an introduction groove 642" from the opening of the introduction groove 642"*b* and reaches the engagement groove 642*a*, thereby being arranged inside the engagement groove 642*a*. In the second modification example, since the end of the engagement groove 642*a* is shut, the protrusion portion 646'*c* does not come off from the bearing member body 641" in the axial line direction, and the shaft member holding member 645' is held by the bearing member body 641".

The end member of the second modification example also operates similarly to the above-described end member 630.

So far, the end member has been described with reference to the plurality of embodiments. Hereinafter, another embodiment will be described regarding the casing of the process cartridge. The photosensitive drum unit including any one of the above-described end members can be applied to the below-described casing.

Figure 68:
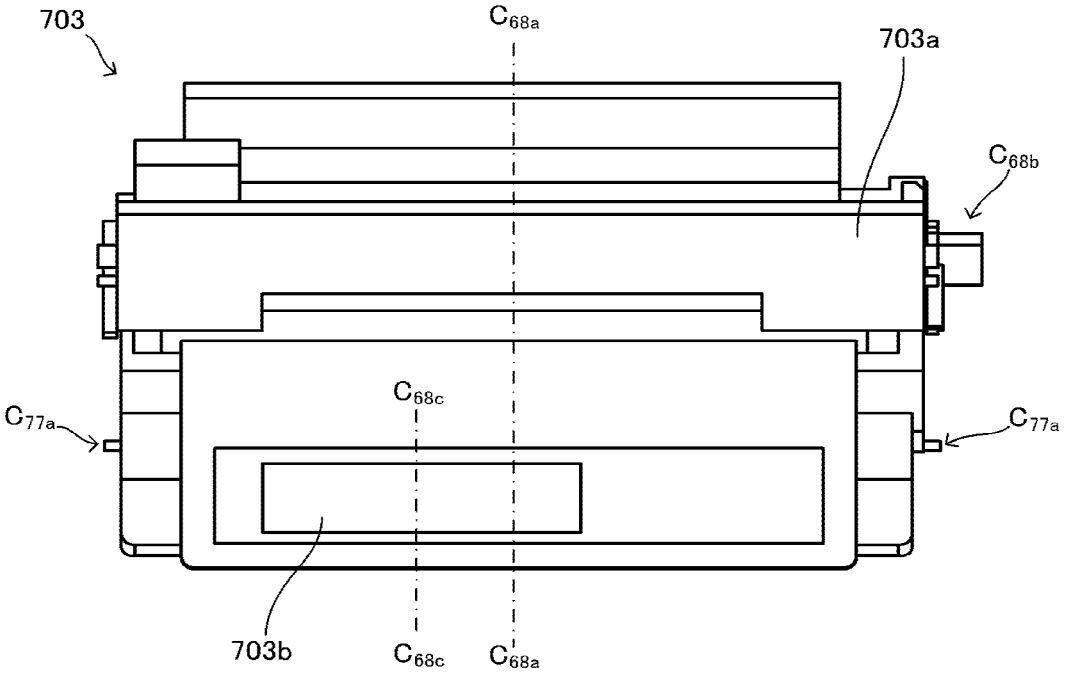
FIG. 68 is a plan view of a process cartridge 703.

FIG. 68 is a plan view of a process cartridge 703 which includes a casing 703*a* of a first example. In FIG. 68, Arrow $C_{68b}$ shows a position of the end member on the side which engages with the drive shaft 70 of the apparatus body 2. In the present embodiment, a central position of an operation portion 703*b* in the width direction indicated by $C_{68c}$-$C_{68c}$ (the transverse direction on the sheet surface, the extending direction of the photosensitive drum unit) is arranged so as to be misaligned to the side opposite to the end member (may be disclosed as "a non-drive side portion") on the drive shaft side away from the center of the process cartridge 703 in the width direction indicated by $C_{68a}$-$C_{68a}$ (the transverse direction on the sheet surface, the extending direction of the photosensitive drum unit), thereby functioning as an oblique detachment encouraging means. In other words, in the present example, the oblique detachment encouraging means encourages a user so as to hold the non-drive side portion and to perform an operation.

Figure 69:
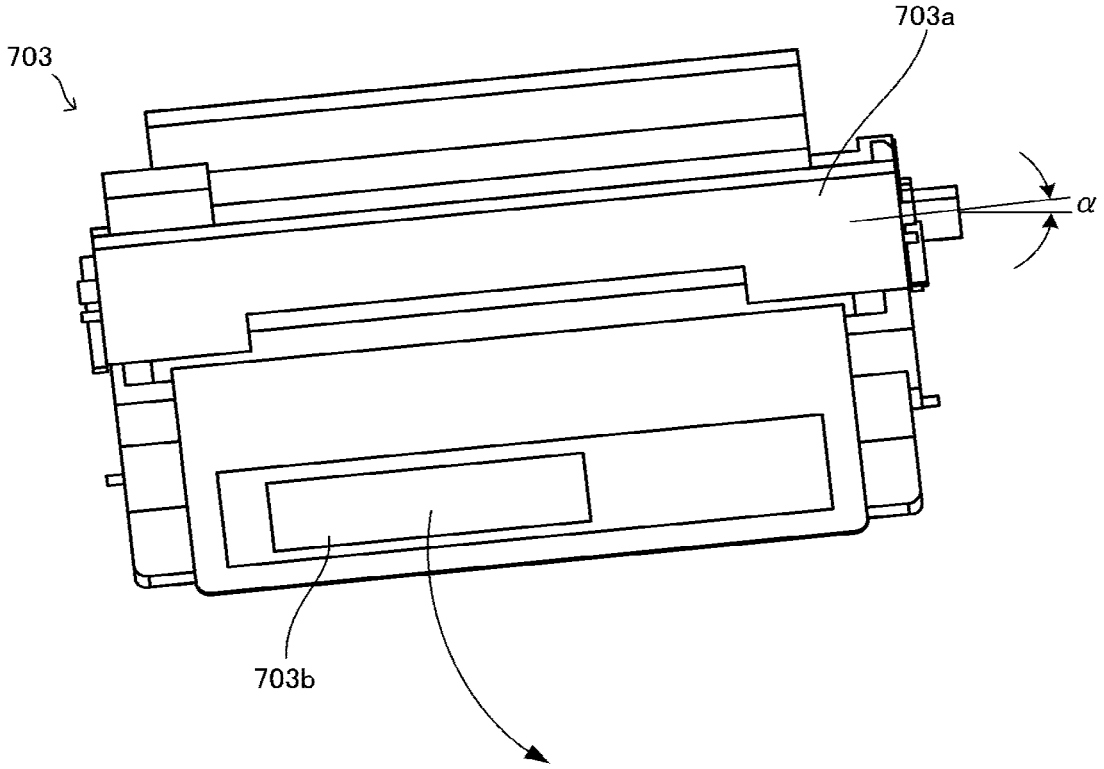
FIG. 69 is diagram illustrating an instance of detachment of the process cartridge 703.

According to such a process cartridge 703, as illustrated in FIG. 69, when the process cartridge 703 is detached from the apparatus body 2, the center of the operation portion 703*b* is pulled, and thus, the side opposite to a side which engages with the drive shaft 70 can be drawn out further. Accordingly, as indicated by an angle α in FIG. 69 (an angle α formed between the axial line of the photosensitive drum unit and the axial line of the drive shaft of the apparatus body), the end member can be inclined, and the end member can be easily detached from the drive shaft. The angle α ranges from 1.5° to 10°. Among thereof, it is preferable to be 2° or greater. In this manner, the end member can be smoothly detached.

Figure 70:
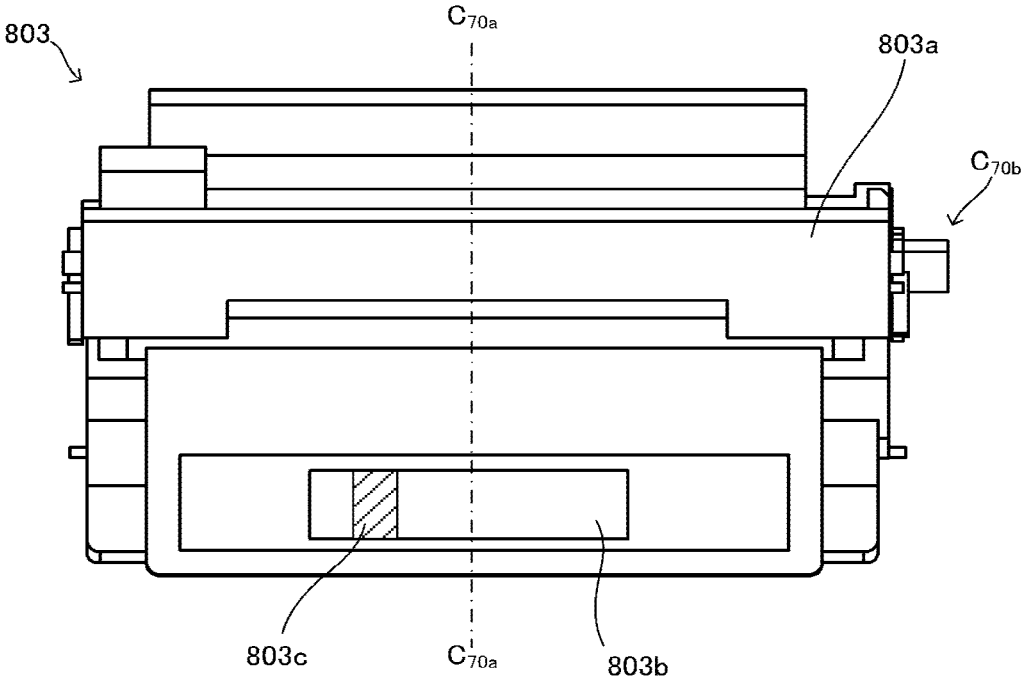
FIG. 70 is a plan view of a process cartridge 803.

FIG. 70 is a plan view of a process cartridge 803 which includes a casing 803*a* of a second example. FIG. 70 shows a position of the end member on the side which engages with the drive shaft 70 of the apparatus body 2, indicated by Arrow $C_{70b}$. In the present example, a mark 803*c* is arranged in the non-drive side portion away from the center of the process cartridge 803 in the width direction indicated by $C_{70a}$-$C_{70a}$ in an operation portion 803*b* (the transverse direction on the sheet surface, the extending direction of the photosensitive drum unit), thereby configuring the oblique detachment encouraging means. The specific form of the mark 803*c* is not particularly limited. A seal, printing, forming of irregularity, or the like can be exemplified. Moreover, an instruction may be displayed.

It is possible to operate similarly to the above-described case even by using the casing 803*a* which includes the oblique detachment encouraging means. Then, in the example as well, the oblique detachment encouraging means encourages a user so as to hold the non-drive side portion and to perform an operation.

Figure 71:
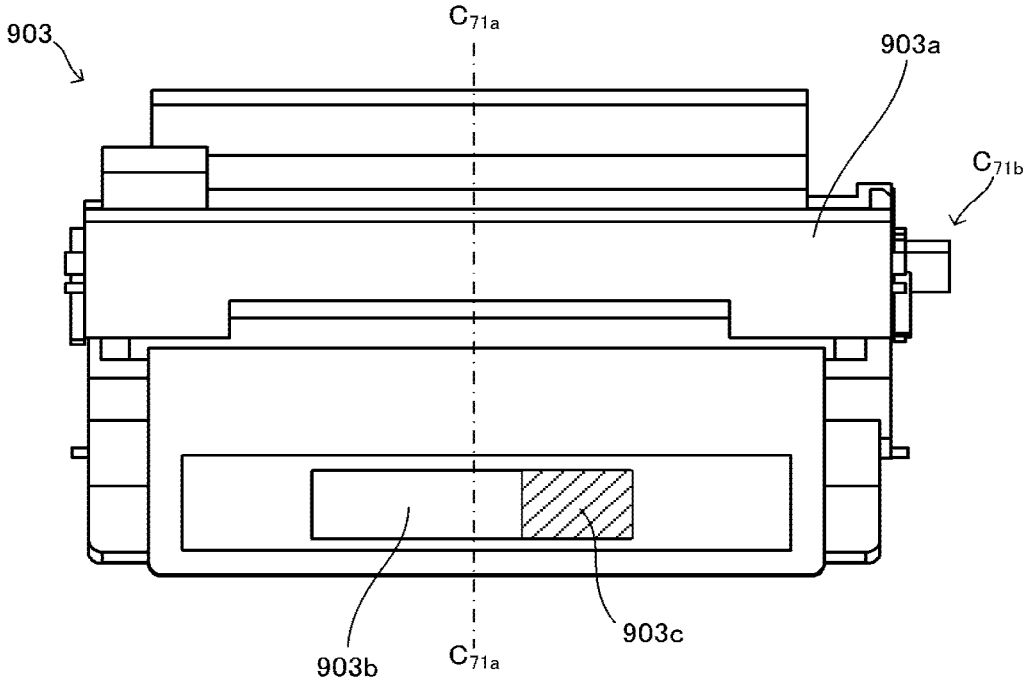
FIG. 71 is a plan view of a process cartridge 903.

FIG. 71 is a plan view of a process cartridge 903 which includes a casing 903*a* of a third example. FIG. 71 shows a position of the end member on the side which engages with the drive shaft 70 of the apparatus body 2 indicated by Arrow $C_{71b}$. In the present example, an operation portion 903*b* is formed to have a recessed shape, and means 903*c* for blocking at least a portion of the operation portion 903*b* is arranged on the end member side of the drive shaft side away from the center of the process cartridge 903 in the width direction indicated by $C_{71a}$-$C_{71a}$ (the transverse direction on the sheet surface, the extending direction of the photosensitive drum unit), thereby configuring the oblique detachment encouraging means. The means for blocking the operation portion 903*b* is not particularly limited. A seal can be pasted, a resin or a metal can be embedded in the recessed portion, or a fitting jig can be adopted.

It is possible to operate similarly to the above-described case even by using the casing 903*a* which includes the oblique detachment encouraging means. Then, in the example as well, the oblique detachment encouraging means encourages a user so as to hold the non-drive side portion and to perform an operation.

Figure 72A:
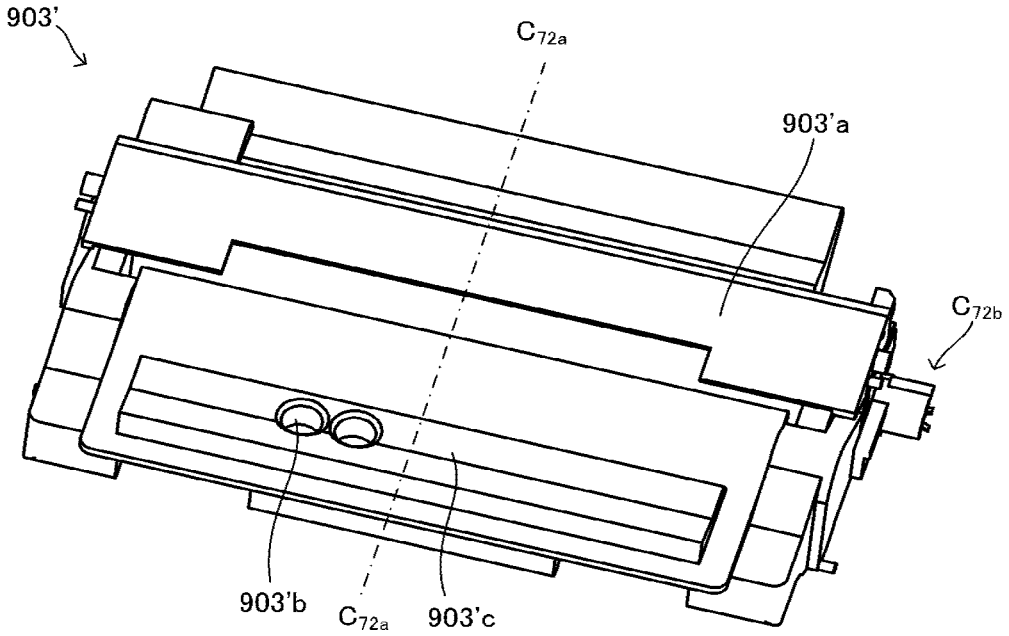
FIG. 72A is a perspective view seen from a planar view side of a process cartridge 903'.
Figure 72B:
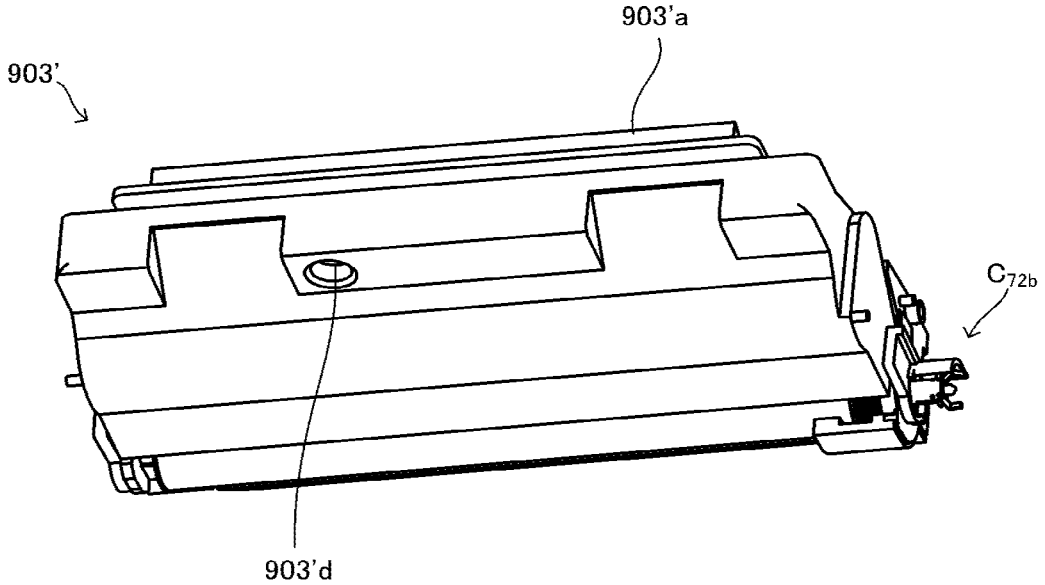
FIG. 72B is a perspective view seen from the bottom surface side of the process cartridge 903'.

FIG. 72A is a perspective view of the process cartridge 903' furnished with a casing 903'*a* which is a modification example of the third example, seen from a planar view side. FIG. 72B is a perspective view seen in the bottom surface direction. FIGS. 72A and 72B show a position of the end member on the side which engages with the drive shaft 70 of the apparatus body 2 indicated by Arrow $C_{72b}$. In the present example, an operation portion 903'*b* is formed to have a recessed shape, and the means 903'*c* for blocking at least a portion of the operation portion 903'*b* is arranged on the end member side of the drive shaft side away from the center of the process cartridge 903 in the width direction indicated by $C_{72a}$-$C_{72a}$ (the transverse direction on the sheet surface, the extending direction of the photosensitive drum unit). Eventually, the operation portion 903'*b* having a two-hole shape in which fingers can be inserted is formed in the non-drive side portion. In other words, the blocking means 903'*c* becomes the oblique detachment encouraging means. The forming method of the means for blocking the operation portion 903*b* is not particularly limited. A seal can be pasted, a resin or a metal can be embedded in the recessed portion, or a fitting jig can be adopted. In addition, in the present example, as seen in FIG. 72B, there is also provided a hole 903'*d* for an operation on the bottom surface side, in which fingers can be inserted. Accordingly, operability can be improved further. However, the hole 903'*d* is not necessarily provided.

It is possible to operate similarly to the above-described case even by using the casing 903'*a* which includes the oblique detachment encouraging means. Then, in the example as well, the oblique detachment encouraging means encourages a user so as to hold the non-drive side portion and to perform an operation.

Figure 73:
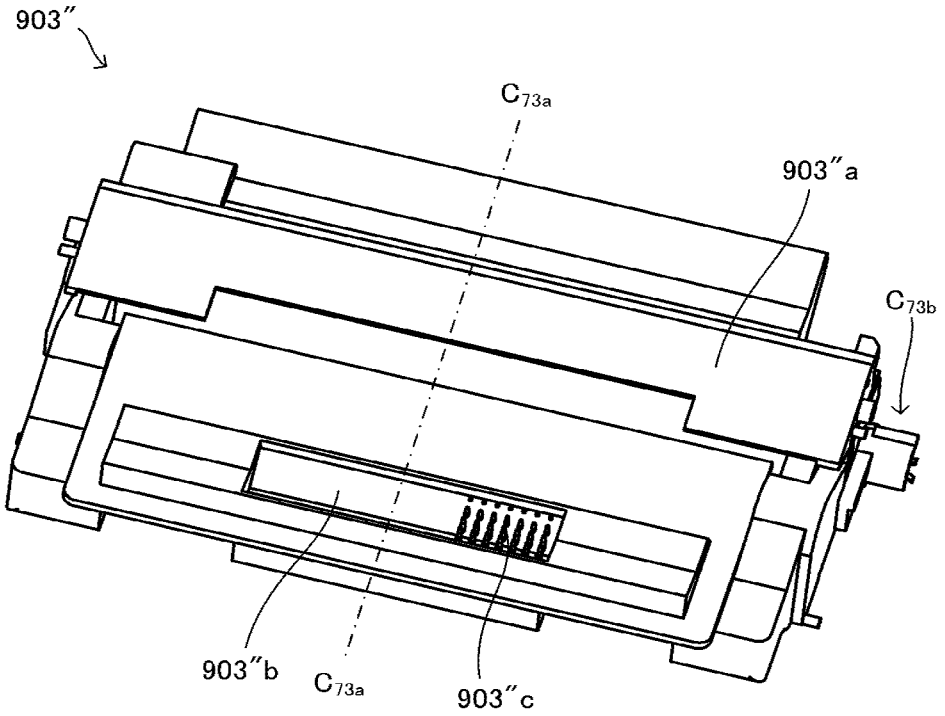
FIG. 73 is a perspective view seen from a planar view side of a process cartridge 903"

FIG. 73 is a perspective view a process cartridge 903" furnished with a casing 903"*a* which is another modification example of the third example, seen from a planar view side. FIG. 73 shows a position of the end member on the side which engages with the drive shaft 70 of the apparatus body 2 indicated by Arrow $C_{73b}$. In the present example, an operation portion 903"*b* is formed to have a recessed shape, and a projection 903"*c* is arranged in at least a portion of the operation portion 903"*b*, on the end member side of the drive shaft side away from the center of the process cartridge 903" in the width direction indicated by $C_{73a}$-$C_{73a}$ (the transverse direction on the sheet surface, the extending direction of the photosensitive drum unit), thereby configuring the oblique detachment encouraging means. In the present example, the projection 903"*c* is embodied so as to cause the member having a plurality of projections to stand upright from the bottom of the operation portion 903"*b*. The projection-shaped member has the projections which are not harmful to a user. The member may be formed of a resin, a metal, or the like. Otherwise, a seal having the projections may be pasted on the member.

It is possible to perform an operation similar to that in the above-described case even by using the casing 903"*a* which includes the oblique detachment encouraging means. Then, in the example as well, the oblique detachment encouraging means encourages a user so as to hold the non-drive side portion and to perform an operation.

Figure 74:
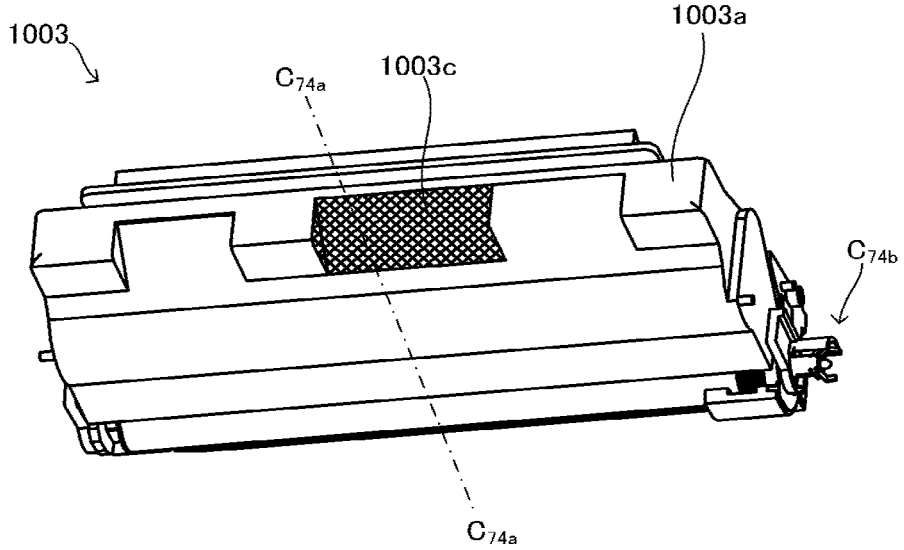
FIG. 74 is a perspective view seen from the bottom surface side of a process cartridge 1003.

FIG. 74 is a perspective view of a process cartridge 1003 furnished with a casing 1003*a* of a fourth example, seen from the bottom surface side. FIG. 74 shows a position of the end member on the side which engages with the drive shaft 70 of the apparatus body 2, indicated by Arrow $C_{74b}$. In the present example, the operation portion (the shape is not particularly limited, not illustrated) is formed on the plane side. As seen in FIG. 74, a member 1003*c* for hindering a user's grasp is arranged on the end member side on the drive shaft side away from the center of the process cartridge 1003 in the width direction indicated by $C_{74a}$-$C_{74a}$ on the bottom surface side (the transverse direction on the sheet surface, the extending direction of the photosensitive drum unit), thereby configuring the oblique detachment encouraging means. Accordingly, a user grasps the casing 1003*a* avoiding the hindering member 1003*c*, and thus, it is possible to grasp the position where the process cartridge 1003 can be naturally and obliquely detached.

The means for blocking the operation portion 1003*b* is not particularly limited. A seal can be pasted, a resin or a metal can be embedded in the recessed portion, or a fitting jig can be adopted.

It is possible to operate similarly to the above-described case even by using the casing 1003*a* which includes the oblique detachment encouraging means. Then, in the example as well, the oblique detachment encouraging means encourages a user so as to hold the non-drive side portion and to perform an operation.

Figure 75A:
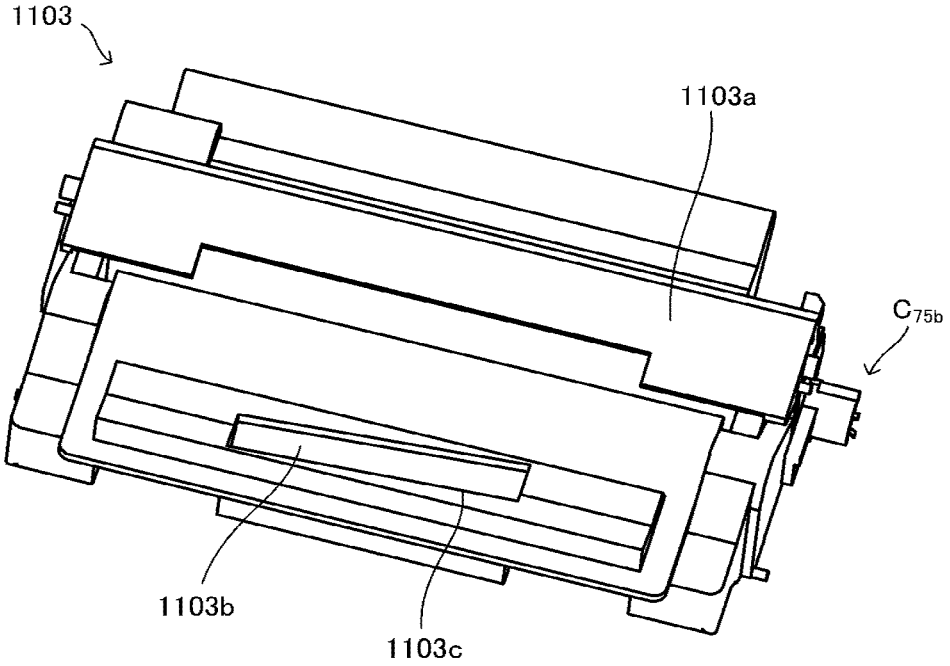
FIG. 75A is a perspective view seen from a planar view side of a process cartridge 1103.
Figure 75B:
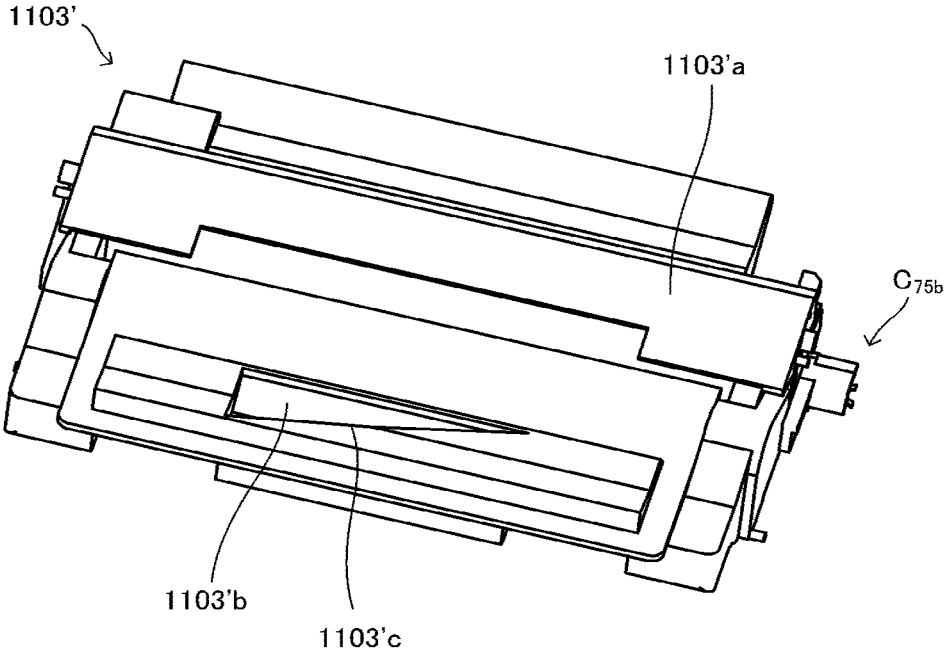
FIG. 75B is a perspective view seen from a planar view side of a process cartridge 1103'.

FIGS. 75A and 75B are perspective views of process cartridges 1103 and 1103' which are furnished with casings 1103*a* and 1103' of a fifth example and a modification example thereof, seen from a planar view side. FIGS. 75A and 75B show positions of the end member (may be disclosed as "a drive side end member") on the side which engages with the drive shaft 70 of the apparatus body 2 indicated by Arrow $C_{75b}$. In the present example, operation surfaces 1103*c* and 1103'*c* which a user's grasp comes into contact with when drawing out in operation portions 1103*b* and 1103'*b* the process cartridges 1103 and 1103' are formed. The operation surfaces 1103*c* and 1103'*c* incline so as to approach the drawing-out side (downward of the sheet surface) as the operation surfaces 1103*c* and 1103'*c* are disposed away from the drive side end member (is arranged at the position of $C_{75b}$), thereby functioning as the oblique detachment encouraging means.

The means for forming such an operation surface is not particularly limited. The inclination surface may be formed by using a resin or a metal with respect to the non-inclination operation portion, or a jig may be attached thereto.

The example in FIG. 75A is a planar view of the process cartridge 1103, and an operation portion 1103*b* is a parallelogram. The example in FIG. 75B is a planar view of a process cartridge 1103', and an operation portion 1103'*b* is a triangle. However, the shape of the planar view is not particularly limited.

It is possible to operate similarly to the above-described case even by using the casings 1103 and 1103' which include the oblique detachment encouraging means. Then, in the example, the oblique detachment encouraging means is configured to allow the process cartridge to be obliquely detached by itself when a user only perform a drawing-out operation.

Figure 76:
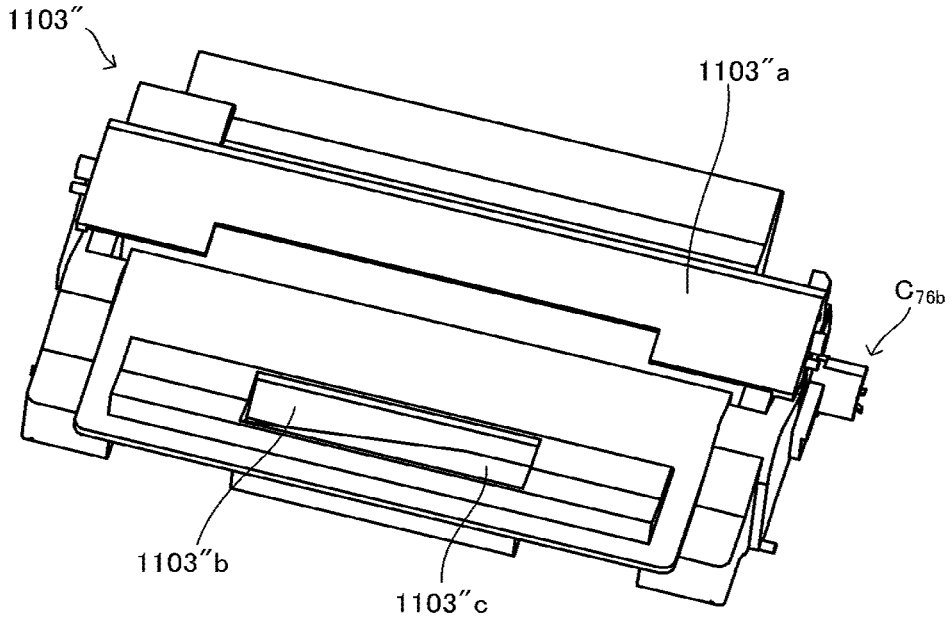
FIG. 76 is a perspective view seen from a planar view side of a process cartridge 1103"

FIG. 76 is a perspective view of the process cartridge 1103" furnished with a casing 1103"*a* which is another modification example of the fifth example, seen from a planar view side. FIG. 76 shows a position of the end member on the side which engages with the drive shaft 70 of the apparatus body 2 indicated by Arrow $C_{76b}$. In the present example, an operation surface 1103"*c* which is a surface which a user comes into contact when drawing out a process cartridge 1103" is formed inside an operation portion 1103"*b* of which a planar view is a rectangle and which is formed to have a recessed shape. Then, the operation surface 1103"*c* inclines so as to approach the drawing-out side (downward of the sheet surface) as the operation surface 1103"*c* is disposed away from the drive side end member, thereby functioning as the oblique detachment encouraging means.

It is possible to operate similarly to the above-described case even by using the casing 1103" which includes the oblique detachment encouraging means. Then, in the example as well, the oblique detachment encouraging means is configured to allow the process cartridge to be obliquely detached by itself when a user only perform a drawing-out operation.

Figure 77:
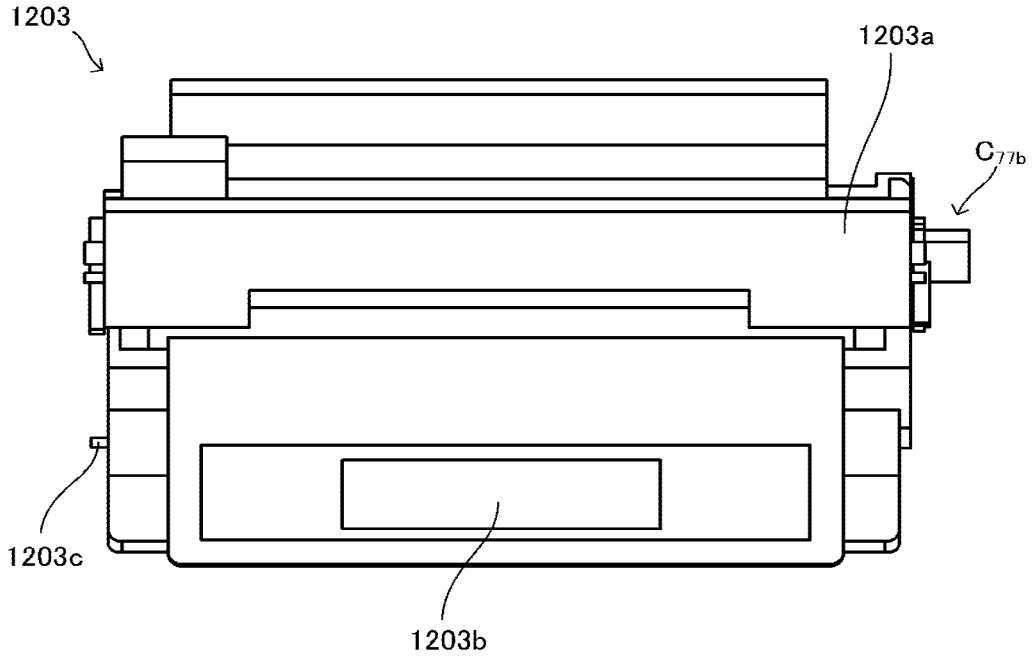
FIG. 77 is a plan view of a process cartridge 1203.

FIG. 77 is a plan view of a process cartridge 1203 furnished with a casing 1203*a* of a sixth example. FIG. 77 shows a position of the end member (may be disclosed as "a drive side end member") on the side which engages with the drive shaft 70 of the apparatus body 2 indicated by Arrow $C_{77b}$. In the present example, an operation portion 1203*b* is included (the embodiment of the operation portion 1203*b* is not particularly limited). A positioning projection 1203*c* of the process cartridge 1203 is arranged in only the non-drive side portion and is not provided on the side in which the opposite drive side end member is arranged. In the present example, the positioning projection 1203*c* functions as the oblique detachment encouraging means. Generally, as indicated by $C_{77a}$ in FIG. 68, the positioning projection is arranged on both sides.

Such oblique detachment encouraging means does not hinder the process cartridge from inclining when a user draws out the process cartridge, and thus, the oblique removal can be smoothly performed.

Figure 78:
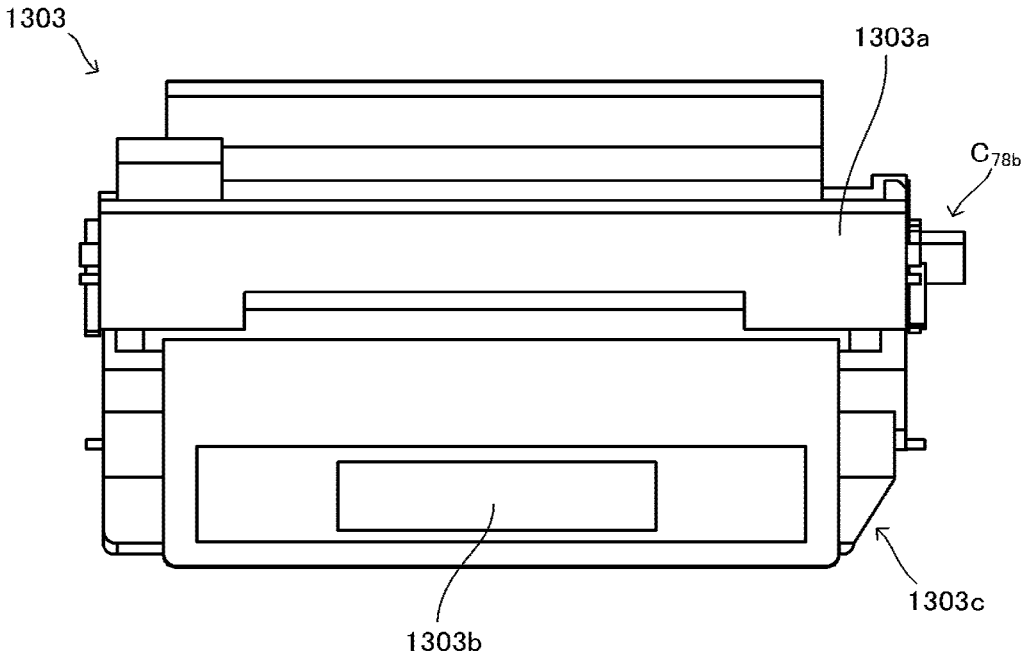
FIG. 78 is a plan view of a process cartridge 1303.

FIG. 78 is a plan view of a process cartridge 1303 furnished with a casing 1303*a* of a seventh example. FIG. 78 shows a position of the end member (may be disclosed as "a drive side end member") on the side which engages with the drive shaft 70 of the apparatus body 2 indicated by Arrow $C_{78b}$. In the present example, an operation portion 1303*b* is included (the embodiment of the operation portion 1303*b* is not particularly limited). In the process cartridge 1303, a corner portion on the drawing-out side on the drive side end member side (downward of the sheet surface) includes an open cut 1303*c*. In the present example, the open cut 1303*c* functions as the oblique detachment encouraging means. In the present example, the open cut 1303*c* includes the inclination surface. However, the open cut 1303*c* may be a stepped open cut in a rectangular shape.

Such oblique detachment encouraging means does not hinder the process cartridge from inclining when a user draws out the process cartridge as well, and thus, the oblique removal can be smoothly performed.

In the above descriptions, the process cartridge includes the oblique detachment encouraging means in order to easily perform oblique removal having such inclination described above. However, even though such the oblique detachment encouraging means is not included, the process cartridge can be similarly inclined and detached by a method of pulling the side opposite to the end member on the drive shaft side away from the center position of the process cartridge in the width direction as indicated by $C_{68a}$-$C_{68a}$ and $C_{70a}$-$C_{70a}$ in FIGS. 68 and 70.

Subsequently, regarding detachment of the process cartridge performed by inclining as described above, a test has been carried out. The test will be described. In the test, a process cartridge was prepared corresponding to a laser printer (HP LaserJet P2055) manufactured by Hewlett-Packard Company. The end member of the above-described first embodiment was arranged in the laser printer.

In the test, sixty instances of "general detachment" were attempted. The "oblique removal" was carried out by the above-described method (the method of pulling the side opposite to the end member on the drive shaft side away from the center position of the operation portion in the width direction) in a case where the process cartridge could not be detached even when pulled by a strong force. Here, "general detachment" denotes that the process cartridge is drawn out in a direction orthogonal to the axial line direction of the photosensitive drum unit and the process cartridge is detached.

Here, "each detachment" configuring the sixty instances of detachment is as follows. That is, the process cartridge was mounted in the apparatus body, and idling was performed so as to cause the drive shaft of the apparatus body and the end member to appropriately engage with each other. Thereafter, rendering (rendering of the test for confirming whether an image is formed, the rendering was performed in only every five turns among sixty detachments) was performed in designated instances. Then, "general detachment" of the process cartridge was attempted. Then, the process cartridge which could not detached by "general detachment" was subjected to "oblique removal". The "oblique removal" was performed by a method in which the process cartridge was inclined and detached by a method of pulling the side opposite to the end member on the drive shaft side away from the center position of the process cartridge in the width direction as indicated by $C_{68a}$-$C_{68a}$ and $C_{70a}$-$C_{70a}$ in FIGS. 68 and 70.

In the test, the process cartridge which could not be detached by general detachment was subjected to the oblique removal test. However, it is possible to consider that the process cartridge which could be detached by general detachment is also reliably detached by oblique removal.

The results are shown in Table 1. In Table 1, "cartridge detachment succeeded" denotes that the process cartridge could be detached, and "cartridge detachment failed" denotes that the process cartridge could not be detached.

TABLE 1

| | General detachment | Oblique Removal |
|---|---|---|
| cartridge detachment succeeded | 28 instances | 60 instances |
| cartridge detachment failed | 32 instances | Zero instances |
| Total | 60 instances | 60 instances |

As seen in Table 1, in general detachment, the process cartridge could not be detached for 32 times (53%). However, all of the process cartridges could be detached by performing oblique removal. In other words, according to oblique removal, the process cartridge can be detached at the rate of 100%.

What is claimed is:

1. An end member to be arranged at an end of a columnar rotor mounted in an image forming apparatus body, the end member including:

a tubular bearing member; and a shaft member that is held by the bearing member, wherein the shaft member includes:

a shaft which moves in an axial line direction, a rotary power reception member which is arranged at one end of the shaft and includes an engagement member engaging with a drive shaft of the image forming apparatus body without inclination respect to rotational axis, and a regulation member which is positioned to engage with or be separated from the shaft or the rotary power reception member, wherein a position of the regulation member with respect to the shaft or the rotary power reception member is adjustable along the axial line direction such that the engagement member switches between an engagement posture and a non-engagement posture with respect to the drive shaft.

2. The end member according to claim 1, wherein the regulation member includes a first projection and the rotary power reception member includes a second projection, and wherein, in the engagement posture, the first projection is moved in the axial line direction to overlap with the second projection along the axial line direction so as to transmit rotary drive force from the drive shaft to the end member.

3. The end member according to claim 2, wherein the first projection and the second projection are spaced apart in the axial line direction in the non-engagement posture such that rotary drive force is not transmitted.

4. The end member according to claim 1, wherein the shaft member has a cylindrical shape.

5. The end member according to claim 1, wherein the shaft member includes a rotary power transmission pin that transmits a rotary power applied from the drive shaft to the bearing member.

6. The end member according to claim 5, wherein the shaft member includes a hole that extends radially about the shaft member to accommodate the rotary power transmission pin.

7. The end member according to claim 6, wherein the regulation member includes a regulation shaft including a long hole elongated in the axial line direction and extending radially about the regulation shaft to accommodate the rotary power transmission pin.

8. The end member according to claim 1, wherein the engagement member extends radially outward from the rotary power reception member.

9. The end member according to claim 8, wherein the rotary power reception member includes a pair of the engagement members extending in radially opposite directions.

10. The end member according to claim 1, wherein an elastic member urges the shaft away from the bearing member in the axial line direction.

11. The end member according to claim 1, wherein the regulation member includes a frustoconical contact portion.

12. The end member according to claim 1, wherein the shaft is not inclined.

13. The end member according to claim 1, wherein the regulation member has a conical shape or a pyramid shape.

14. An end member to be arranged at an end of a columnar rotor mounted in an image forming apparatus body, the end member including:

a tubular bearing member; and a shaft member that is held by the bearing member, wherein the shaft member includes:

a shaft which moves in an axial line direction, a rotary power reception member which is arranged at one end of the shaft and includes an engagement member engaging with a drive shaft of the image forming apparatus body without inclination respect to rotational axis, and a regulation member which as one with the bearing member and is positioned to engage with or be separated from the shaft or the rotary power reception member, wherein a position of the regulation member with respect to the shaft or the rotary power reception member is adjustable along the axial line direction such that the engagement member switches between an engagement posture and a non-engagement posture with respect to the drive shaft.

* * * * *